US007789226B2

(12) United States Patent
Carrigan et al.

(10) Patent No.: US 7,789,226 B2
(45) **Date of Patent: *Sep. 7, 2010**

(54) PACKAGED BANDED ENVELOPES

(75) Inventors: David J. Carrigan, Somers, CT (US); Witold Misiaszek, West Warren, MA (US)

(73) Assignee: MeadWestvaco Corporation, Richmond, VA (US)

( * ) Notice: Subject to any disclaimer, the term of this patent is extended or adjusted under 35 U.S.C. 154(b) by 182 days.

This patent is subject to a terminal disclaimer.

(21) Appl. No.: 11/378,994

(22) Filed: Mar. 17, 2006

(65) Prior Publication Data

US 2006/0157367 A1 Jul. 20, 2006

Related U.S. Application Data

(63) Continuation-in-part of application No. 11/224,475, filed on Sep. 12, 2005, now Pat. No. 7,310,922.

(60) Provisional application No. 60/609,293, filed on Sep. 13, 2004, provisional application No. 60/616,171, filed on Oct. 5, 2004.

(51) Int. Cl.
*B65D 75/00* (2006.01)

(52) U.S. Cl. ..... 206/215; 206/451

(58) Field of Classification Search ..... 206/449, 206/451, 425, 820, 497, 499, 214, 215
See application file for complete search history.

(56) References Cited

U.S. PATENT DOCUMENTS

| | | | | |
|---|---|---|---|---|
| 978,591 | A | 12/1910 | Jayne | |
| 1,807,867 | A * | 6/1931 | Novick | 493/332 |
| 2,425,895 | A * | 8/1947 | Overly | 206/215 |
| 2,691,922 | A | 10/1954 | Pearce | |
| 2,741,885 | A * | 4/1956 | Allison | 53/586 |
| 2,893,581 | A | 7/1959 | Cushman | |

(Continued)

FOREIGN PATENT DOCUMENTS

| | | |
|---|---|---|
| DE | 2263477 | 7/1973 |

(Continued)

OTHER PUBLICATIONS

Web page of CardSupply advertising Crane's Product W9881 (date of first publication unknown). Applicants admit the status of this publication as prior art for the limited purpose of examination of this application, but otherwise reserve the right to challenge the status of this publication as prior art.

(Continued)

*Primary Examiner*—Jacob K Ackun, Jr.
(74) *Attorney, Agent, or Firm*—Alison R. Scheidler; Donald G. Bauer; Steven J. Elleman

(57) ABSTRACT

An envelope package including a plurality of generally aligned envelopes, the plurality of envelopes being compressed together. The package further includes a generally non-elastic band extending around the plurality of compressed envelopes and retaining the envelopes in a state of compression. The plurality of envelopes exert an expansion force of at least about ½ pound such that the plurality of envelopes are sufficiently compressed to generally seal ambient air out of the plurality of envelopes to thereby reduce absorption of moisture and warpage thereof.

21 Claims, 66 Drawing Sheets

U.S. PATENT DOCUMENTS 2,917,884 A * 12/1959 Winkler et al. ..... 53/586
2,996,859 A 8/1961 Winkler et al.
3,030,750 A 4/1962 Lowe et al.
3,117,815 A 1/1964 Creskoff
3,227,481 A 1/1966 Creskoff
3,269,089 A 8/1966 Heywood
3,286,434 A 11/1966 Winkler et al.
3,350,834 A 11/1967 Heywood et al.
3,411,641 A 11/1968 Dean
3,542,241 A 11/1970 Middleditch
3,579,944 A 5/1971 Heywood et al.
3,640,562 A 2/1972 Creskoff
3,729,886 A 5/1973 Lucas et al.
3,975,045 A 8/1976 Abarotin et al.
3,976,205 A 8/1976 Gorannson
4,184,628 A 1/1980 Schultz
4,210,250 A 7/1980 Yale
4,406,728 A 9/1983 Ohba et al.
4,516,762 A 5/1985 Moltrasio et al.
4,540,614 A 9/1985 Omori
4,627,218 A 12/1986 Akerstrom et al.
4,627,219 A 12/1986 Omori
4,635,988 A 1/1987 Potters et al.
4,658,715 A 4/1987 Stobb
4,750,132 A 6/1988 Pessina et al.
4,753,564 A 6/1988 Pearce et al.
4,772,170 A 9/1988 Oldfield
4,817,260 A 4/1989 Martin
4,828,304 A 5/1989 No et al.
4,870,807 A 10/1989 Palamides et al.
4,879,862 A 11/1989 Nolte et al.
4,899,518 A 2/1990 Beeman et al.
4,910,944 A 3/1990 Segalowitz et al.
4,911,098 A 3/1990 Tabata
4,928,899 A 5/1990 Reist
4,930,977 A 6/1990 Beeman et al.
4,949,835 A 8/1990 Beeman et al.
4,995,563 A 2/1991 Kälin
5,048,264 A 9/1991 Fröhlich
5,088,720 A 2/1992 Beeman et al.
5,088,878 A 2/1992 Focke et al.
5,178,268 A 1/1993 Talley et al.
5,207,412 A 5/1993 Coons, Jr. et al.
5,222,861 A 6/1993 Focke et al.
5,232,332 A 8/1993 Focke
5,287,976 A 2/1994 Mayer et al.
5,414,974 A 5/1995 Van de Ven et al.
5,425,565 A 6/1995 Rogovein et al.
5,425,665 A 6/1995 Kennedy
5,464,316 A * 11/1995 Kranz ..... 414/798.2
5,478,185 A 12/1995 Kranz
5,511,773 A 4/1996 Burger
5,524,876 A 6/1996 Porter
5,560,180 A 10/1996 Rodriguez et al.
5,727,832 A 3/1998 Holter
5,733,099 A 3/1998 Honneger
5,984,623 A 11/1999 Smith et al.
5,996,314 A 12/1999 Pennini et al.
5,996,798 A 12/1999 Gessert
6,006,499 A 12/1999 Rämö
6,058,684 A 5/2000 Suokas
6,082,254 A 7/2000 De Vlaam
6,085,487 A 7/2000 De Vlaam
6,209,449 B1 4/2001 Otto et al.
6,213,167 B1 4/2001 Greenland
6,223,500 B1 5/2001 Kramps
6,230,473 B1 5/2001 Rudolf
6,282,868 B1 9/2001 Vlaam
6,363,689 B1 4/2002 Rodriguez et al.
6,464,079 B1 10/2002 Newman
6,467,768 B1 10/2002 Vary et al.
6,487,833 B1 12/2002 Jaenson et al.
6,550,221 B1 * 4/2003 Neri ..... 53/399
6,619,014 B2 9/2003 Muller
6,663,100 B2 12/2003 Crowley
6,755,411 B2 6/2004 Janatka et al.
6,769,848 B2 8/2004 Rostoker
6,860,531 B2 3/2005 Sherwin
7,310,922 B2 12/2007 Carrigan et al.
2002/0073651 A1 6/2002 Muller
2002/0083689 A1 7/2002 Muller
2002/0116900 A1 8/2002 Cranston, III et al.
2003/0120387 A1 6/2003 Sherwin
2004/0040879 A1 3/2004 Éclair-Heath
2004/0065050 A1 4/2004 Sauer

FOREIGN PATENT DOCUMENTS

DE 19857614 6/2000
EP 0411523 2/1991
EP 0411523 A1 2/1991
EP 0411523 9/1992
EP 0623541 11/1994
EP 0623541 A1 11/1994
EP 0623541 10/1997
EP 1352845 10/2003
EP 1352845 A1 10/2003
EP 1352845 8/2005
FR 2579190 9/1986
JP 3-32586 2/1991

OTHER PUBLICATIONS

Web page printout showing promotional materials for PreVac rotary vane vacuum pump (date of first publication unknown).
Web page showing promotional materials for Schmaiz vacuum components (date of first publication unknown).
Web page showing promotional materials for Unigripper vacuum components (date of first publication unknown).
Web page showing promotional materials for Vaccon vacuum components (date of first publication unknown).
Web page showing promotional materials for PIAB vacuum components (date of first publication unknown).
International Search Report "W02006031755A3" published Mar. 23, 2006.
Supplementary European Search Report issued regarding European Application No. 05795402.6 [Feb. 18, 2008].
Supplementary European Search Report issued regarding European Application No. 05795402.6 (Feb. 18, 2008).
Official Action issued May 26, 2006 regarding U.S. Appl. No. 11/224,475.
Official Action issued Nov. 13, 2006 regarding U.S. Appl. No. 11/224,475.
Notice of Allowance and Fee(s) Due issued Sep. 5, 2007 regarding U.S. Appl. No. 11/224,475.

* cited by examiner

PACKAGED BANDED ENVELOPES

This application is a continuation-in-part of U.S. patent application Ser. No. 11/224,475 filed on Sep. 12, 2005, now U.S. Pat. No. 7,310,922 which in turn claims priority to provisional application Ser. No. 60/609,293 filed on Sep. 13, 2004, and provisional application Ser. No. 60/616,171 filed on Oct. 5, 2004. The entire contents of all three of these applications are hereby incorporated by reference.

The present invention is directed to packaging of banded envelopes and methods for packaging banded envelopes.

BACKGROUND

Existing envelope manufacturing machinery can create large numbers of envelopes at a rapid rate. Such machinery creates stacks of envelopes for subsequent packaging, shipping and processing. The envelopes are then shipped to a customer or end user which may add inserts into the envelopes, affix postage, and enter the envelopes into a mail or package delivery system. The envelope inserting and processing is typically carried out by automated envelope inserting machinery.

In order to ensure proper operation of the envelope inserting machinery, the envelopes processed by the machinery should be uniform and meet sufficient quality control standards. In particular, after their formation envelopes may be prone to absorbing moisture from the ambient air, which causes warping of the envelopes. The absorption of moisture and warping of the envelope over time is known as "propellering." Propellering of the envelopes can cause the opposing corners of the envelopes to twist away from each other in the fashion of a propeller, which can cause the envelopes to be improperly fed into and/or improperly processed by the envelope inserting machinery. This can lead to jamming or malfunction of the envelope inserting machinery, which increases down time and lowers efficiency.

Most of the moisture absorbed by the envelopes takes place after formation and packaging of the envelopes, while the envelopes are in storage, being shipped, or awaiting insertion. Accordingly, as disclosed herein envelopes may be packaged together in a compressed state to reduce moisture, reduce warpage and ensure consistently flat envelopes.

In addition, difficulties can arise in stacking and storing the individual envelope packages. Accordingly there is a need for an improved system and method for packaging, storing and transporting packages of banded envelopes.

SUMMARY

In one embodiment, the present invention is a method for packaging envelopes which reduces absorption of moisture, thereby reducing warpage and ensuring more consistently flat envelopes. In particular, the present invention may involve compression-packaging a plurality of envelopes together, and retaining the envelopes in a state of compression by use of at least one band. The banded envelopes are thereby relatively sealed to keep moisture and air away from the banded envelopes. In addition, the bands provide various other advantages in processing, storing and shipping the packaged envelopes.

More particularly, in one embodiment the invention is a method for processing envelopes including the steps of providing a plurality of generally aligned envelopes and compressing the plurality of envelopes together. The method further includes the step of placing a band around the compressed envelopes such that the band retains the plurality of envelopes in a state of compression.

In another embodiment the invention is an envelope package including a plurality of generally aligned envelopes, the plurality of envelopes being compressed together, and a generally non-elastic band extending around the plurality of compressed envelopes and retaining the envelopes in a state of compression.

In another embodiment the invention is a system for processing envelopes including an envelope delivery mechanism configured to deliver a plurality of envelopes to a support surface to thereby form a generally aligned stack of envelopes. The system also has a bander configured to form a band around the stack of envelopes such that the band retains the stack of envelopes in a state of compression.

In yet another embodiment the invention is a method for handling a package of banded envelopes including the step of providing a package of envelopes including plurality of generally aligned compressed envelopes. The package further includes a generally non-elastic band extending around the plurality of envelopes and retaining the envelopes in a state of compression. The method further includes the step of moving the package of envelopes.

DETAILED DESCRIPTION

Figure 1A:
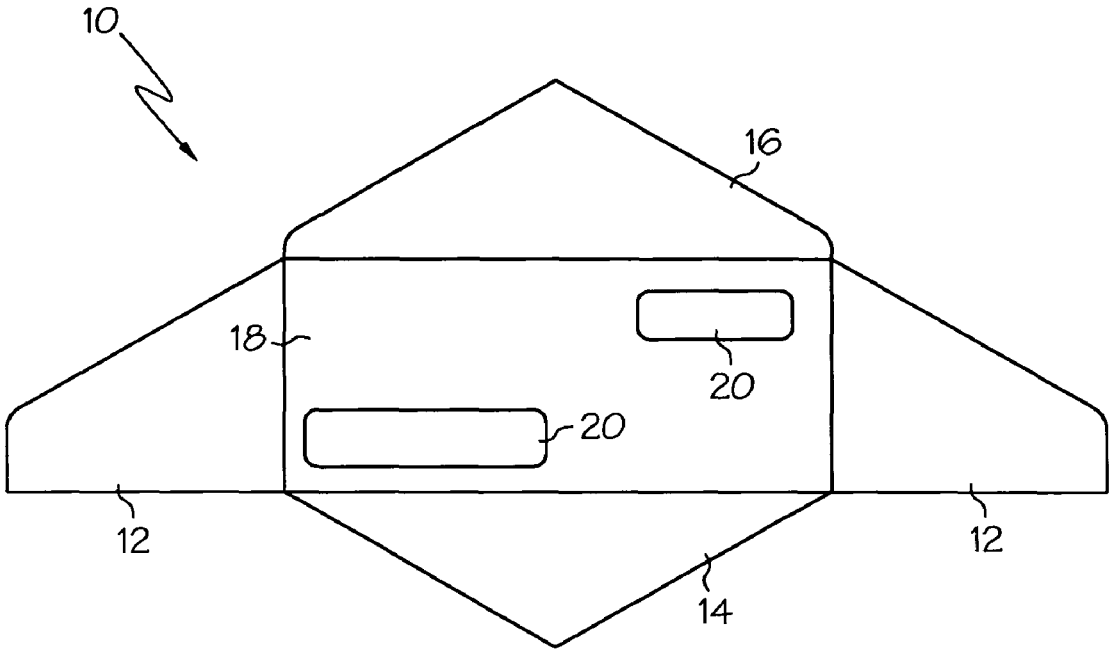
FIG. 1A is a front view of an unassembled envelope.
Figure 1B:
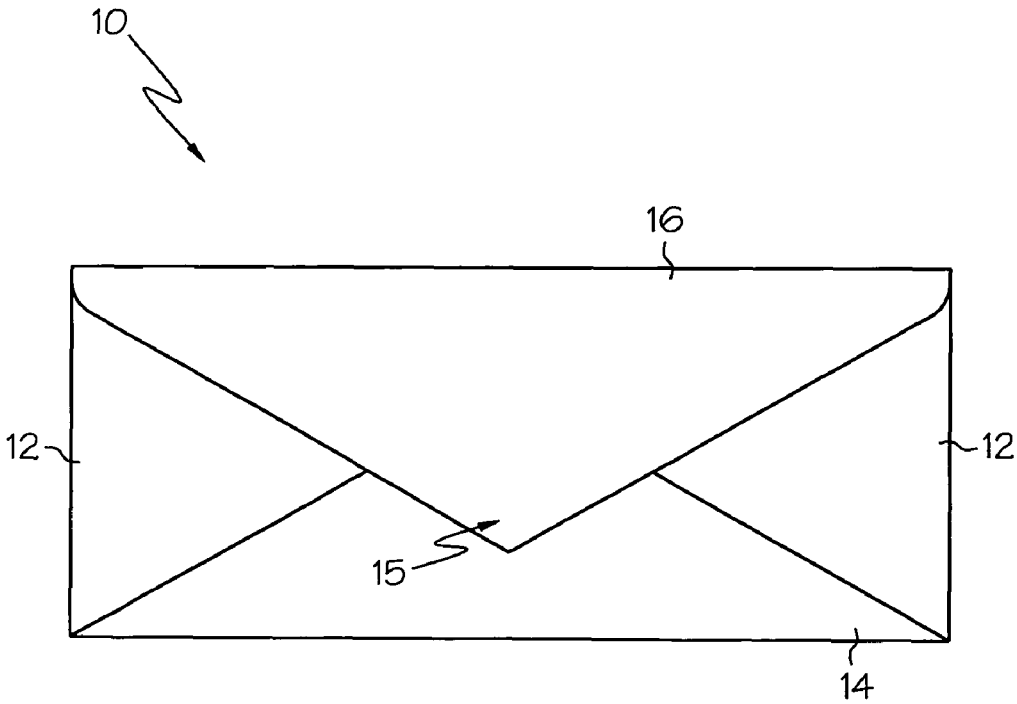
FIG. 1B is a front view of the envelope of FIG. 1A, shown in an assembled state.

FIGS. 1A and 1B illustrate a envelope 10 in its unassembled and assembled conditions, respectively. FIGS. 1A and 1B illustrate an diamond or diagonal cut envelope, but the invention can be implemented and used with envelopes of nearly any shape or configuration. The envelope 10 of FIGS. 1A and 1B includes a pair of side flaps 12, a bottom flap 14, a top flap 16, and a central portion 18. The side flaps 12, bottom flap 14 and top flap 16 are each foldable on top of the central portion 18 and can be adhered together to provide the envelope 10 shown in FIG. 1B. The top flap 16 is pivotable to an open position to provide access to the inner cavity of the envelope 10, and includes an adhesive strip (not shown) to seal the envelope 10 in the well-known manner. In the illustrated embodiment, the envelope 10 includes a pair of front windows 20 made of transparent, sheet-like material at the addressee location and at the addressor location of the envelope 10. However, the envelope 10 may include only a single window (at either the addressee or addressor location), or may not include any windows. In addition, the envelope 10 can take a wide variety of shapes and configurations beyond that specifically shown in FIGS. 1A and 1B.

Figure 2A:
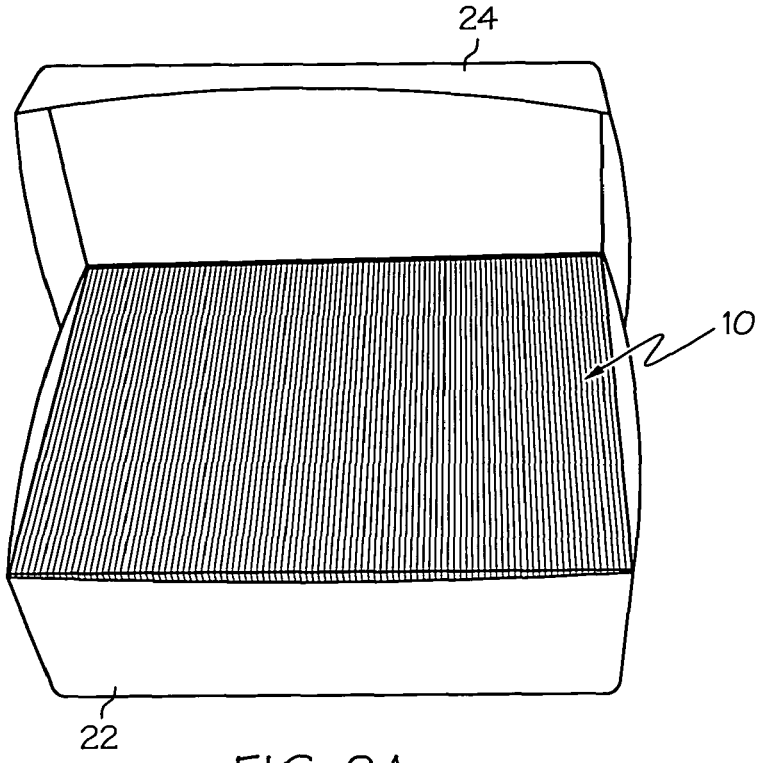
FIG. 2A is a top perspective view of a packaging box including a plurality of envelopes received therein.
Figure 2B:
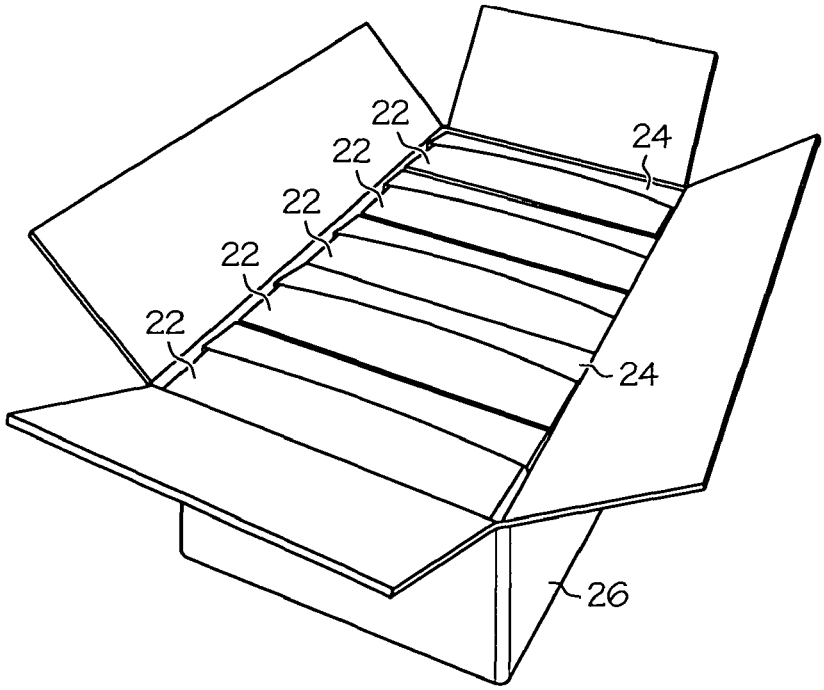
FIG. 2B is a top perspective view of a shipping box including a plurality of the packaging boxes of FIG. 2A received therein.

FIGS. 2A and 2B illustrate a system for storing and shipping envelopes. In that system, a packaging box 22 having a removable lid 24 receives a loose stack of envelopes 10 therein (FIG. 2A). The envelopes 10 can be inserted into the packaging box 22 either manually or by an automated process. The lid 24 is then fitted on the packaging box 22, and a number of packaging boxes 22 (i.e., five packaging boxes 22) are inserted into a shipping box 26 as shown in FIG. 2B. Various other methods for storing and shipping envelopes may be used, such as placing two stacks or row of envelopes in a side-by-side configuration into a shipping case, with a divider between the stacks/rows. However, these methods of storing and shipping envelopes do not prevent the absorption of moisture by the envelopes, and present various other difficulties in shipping and handling.

Figure 3A:
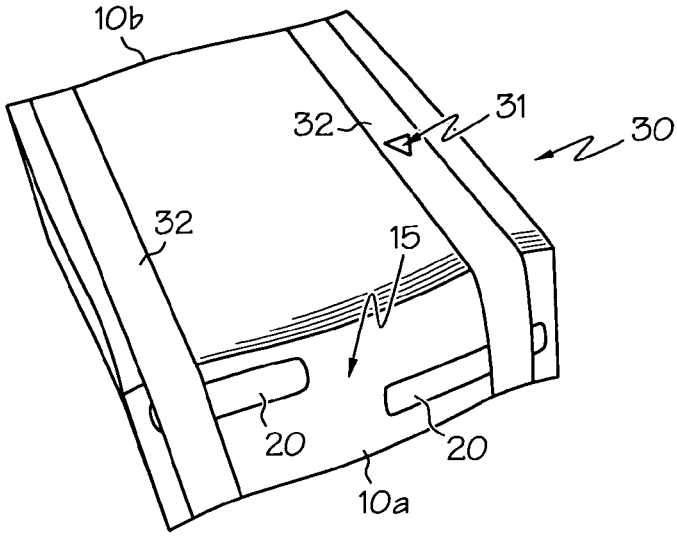
FIG. 3A is a front perspective view of a package of banded envelopes.
Figure 3B:
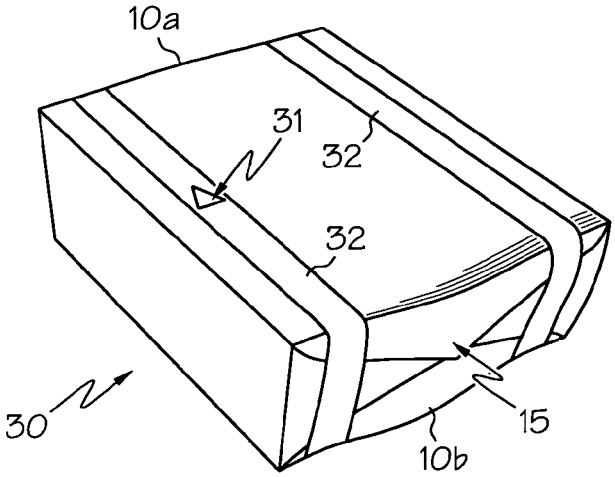
FIG. 3B is a rear perspective view of the package of FIG. 3A.
Figure 3C:
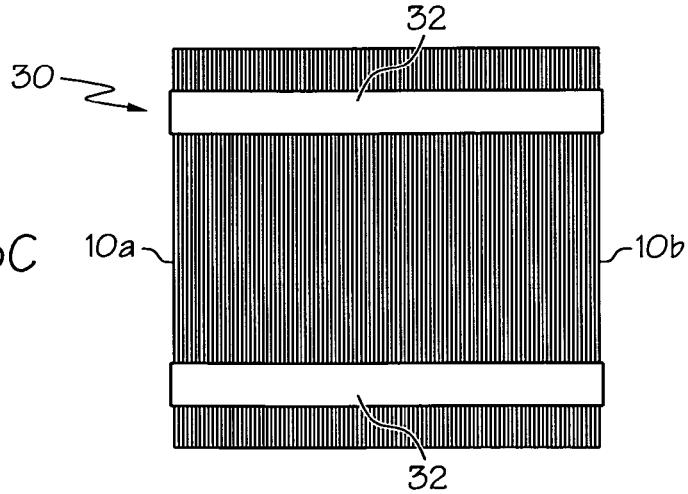
FIG. 3C is a top view of the package of FIG. 3A.

FIGS. 3A, 3B and 3C illustrate a package or stack 30 of banded envelopes 10. The stack of envelopes 30 includes a plurality of envelopes 10 that are generally aligned (i.e. their outer edges are generally aligned). The stack of envelopes 30 includes pair of bands 32 extending around the outer periphery of the stack 30. The bands 32 may be located on the outer longitudinal edges of each envelope 10 and each band 32 may be spaced apart from the associated adjacent lateral edge by the same distance. The bands 32 may extend only around the longitudinal edges of the inner envelopes 10 (as well as the front and rear surfaces of the end envelopes 10*a*, 10*b*, respectively) such that all of the inner envelopes in the stack 30 include two free (unbound) lateral edges.

FIG. 3B illustrates the envelopes 10 in a "flaps-up" configuration wherein the top flap 16 is located adjacent to, or forms, the upper edge of the envelope 10. However, if desired the envelopes can be located in a "flaps-down" configuration wherein the envelopes 10 are inverted from their configuration shown in FIG. 3B.

The bands 32 can be made of a wide variety of materials, including, but not limited to, paper, coated paper, plastic, cardboard, ribbon material, wire, rubber bands or other elastic material, non-elastic or generally non-elastic materials, MYLAR® film sold by E.I. DuPont de Nemours and Company of Wilmington, Del., or any combination of these materials. The bands 32 may be made of a relatively thin, flexible continuous material, such as material having a thickness between about 0.05 mm and about 0.5 mm.

The bands 32 retain the stack of envelopes 30 in a compressed condition. Adjacent envelopes 10 in the stack 30 have a gap therebetween, and the gaps will typically be reduced due to the compressed nature of the stack 30. The stack of envelopes 30 may be compressed such that the stack 30 exerts an expansion force of at least about ½ pound, or at least about two pounds, or at least about five pounds, or at least about ten pounds. Thus, the bands 32 should be able to withstand an expansion force applied by the stack of envelopes 30 of at least about ½ pound, or at least about two pounds, or at least about five pounds, or at least about ten pounds. In addition, each stack of envelopes 30 should be sufficiently compressed to generally seal air and moisture out away from the innermost envelopes 10 in the stack 30. For example, the stack of envelopes 30 may be compressed at least about 1 inch, or about 10%, or at least about 20%, or at least about 30%, or at least about 50% from its uncompressed state (i.e., a state wherein each of the envelopes 30 touches any adjacent envelopes 10 but no external compressive forces are applied).

Although greater compression may, in general, provide greater sealing between adjacent envelopes 10 and thereby keep air and moisture away from the envelopes 10, over-compression of the envelopes 10 can lead to excessive bowing in the stack. In particular, the center portions 15 of each envelope 10 have a four-ply or five-ply thickness due to the overlapping nature of the five panels 12, 14, 16, 18 at that location. The remaining portions of the envelope 10 include only two-ply or three-ply thicknesses. Accordingly, if the bands 32 are too tight and the envelopes 10 are over-compressed, the outer edges of the envelopes 10 will be pulled inwardly and the entire stack of envelopes 30 will bow about the center portion 15 of the envelopes 10. This bowing can impart an undesired curvature to the envelopes 10 and therefore should be limited. Thus the stack of envelopes 30 should form a generally rectangular prism. For example, the stack of envelopes 30 may be configured such that each envelope 10 in the stack is bowed (i.e., pulled out of plane) by a distance of no greater than about ⅜", or no greater than about one quarter inch, or no greater than about one-fortieth of the length of the envelope 10.

Besides the compression advantages provided by the bands 32, the bands 32 also provide advantages with respect to packaging and/or handling of the envelopes 10. For example, each band 32 may provide a flat surface upon which suction cups or other suction devices may be able to act to thereby grip, lift and manipulate the stack of envelopes 30. Thus, each band 32 may have a width of at least, for example, about ¼", or about one inch, or at least about one-tenth of the length of the envelope 10, to provide sufficient surface area upon which suction cups can act. Thus, the bands 32 may be of a generally airtight (or generally non-air permeable) material that allows suction cups to seal thereto. Of course, various other methods of lifting and moving the envelopes may be utilized.

The bands 32 may be printed with various markings located thereon (see marking 31 of FIGS. 3A and 3B). For example, various marks, indicia, targets, text, bar codes, computer or human readable information, or the like which can be identified or tracked by optical equipment associated with a robot or the like (collectively termed "marking" or "markings" herein) may be printed on the bands 32. This markings 31 can be utilized by a vision-guided robot in an envelope inserting/stuffing machine. The markings 31 can be a mark located a predetermined distance from the ends of the stack 30 (i.e., a predetermined distance from the front envelope 10*a* and/or rear envelope 10*b*, or from the sides of the stack 30) so that the optical equipment can determine the location of the outer edges of the package 30. The bands 32 may also include markings 31 useful to a human operator, for example, an arrow indicating the orientation and/or front end of the stack 30 for insertion into envelope inserting or processing equipment.

Each package 30 may include any of a desired number of envelopes. In one embodiment each package 30 has between about 50 and about 1,000 envelopes, and in one embodiment has about 250 envelopes. Each package of envelopes 30 may have a depth of between about 1 inch to about 12 inches, and more particularly about 6 inches.

Figure 4:
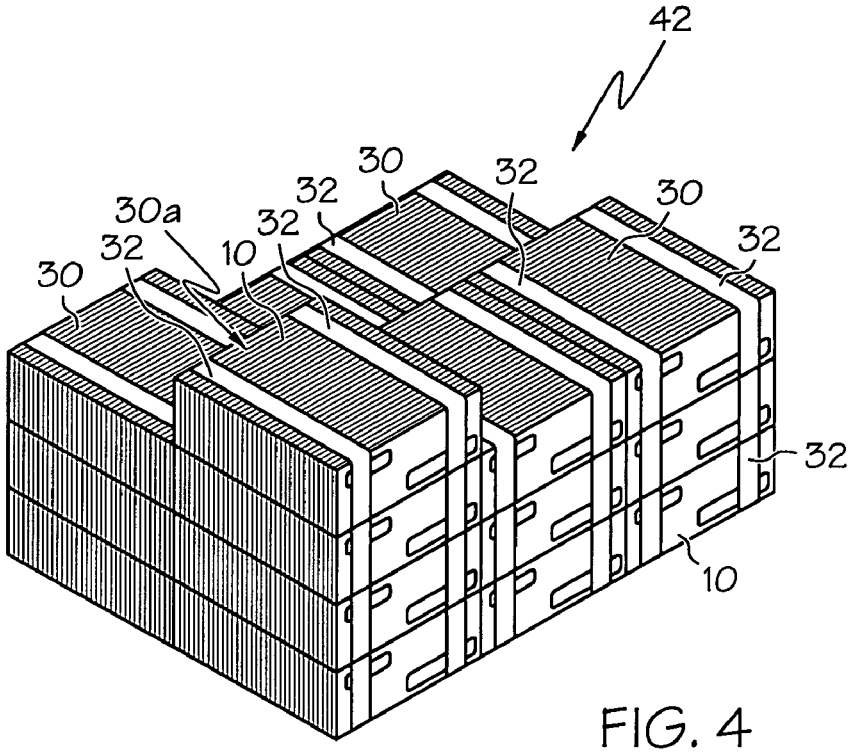
FIG. 4 is a stack of a plurality of envelope packages.

The banded nature of the envelopes 10 allows the envelopes 10 to be stacked and handled in an improved manner as compared to nonbanded envelopes. For example, as shown in FIG. 4, a stack 42 of packaged, banded envelopes 30 can be created on a flat surface, in a box or the like. When the stack 42 shown in FIG. 4 is located in a box or on the floor, each of the packages 30, including the topmost package of envelopes 30*a* can support themselves as freestanding units. If the envelopes 10 of the stack 30*a* were not banded, the envelopes 10 of that package 30*a* would not be able to be freestanding, and would fall forward and/or backward and be difficult to contain.

Accordingly the banded nature of the packages 30 allows a user to extract a limited number of envelopes 10 for processing by simply gripping and lifting a package 30 off of the stack 42 of packages 30 shown in FIG. 4 without causing the tumbling of loose envelopes. Thus the packages 30 need not be bound on all sides by a container, and quicker and easier access to the packages 30 is provided. In addition, handling equipment (such as lifting slats or arms) can be inserted between the bands 32 and stack of envelopes 30 to lift, move and manipulate the stack of envelopes 30.

Finally, because the packages of envelopes 30 are compression-bound, a pile or stack 42 of packages 30 as shown in FIG. 4 can be created and stacked relatively high. In particular, the compression-bound nature of the envelopes lends stiffness to the packages 30 (i.e., in the vertical direction) and allows multiple packages 30 to be piled or stacked on top of each other in a secure and stable manner. This allows greater stacking efficiency and reduces freight costs and warehouse space.

Figure 3D:
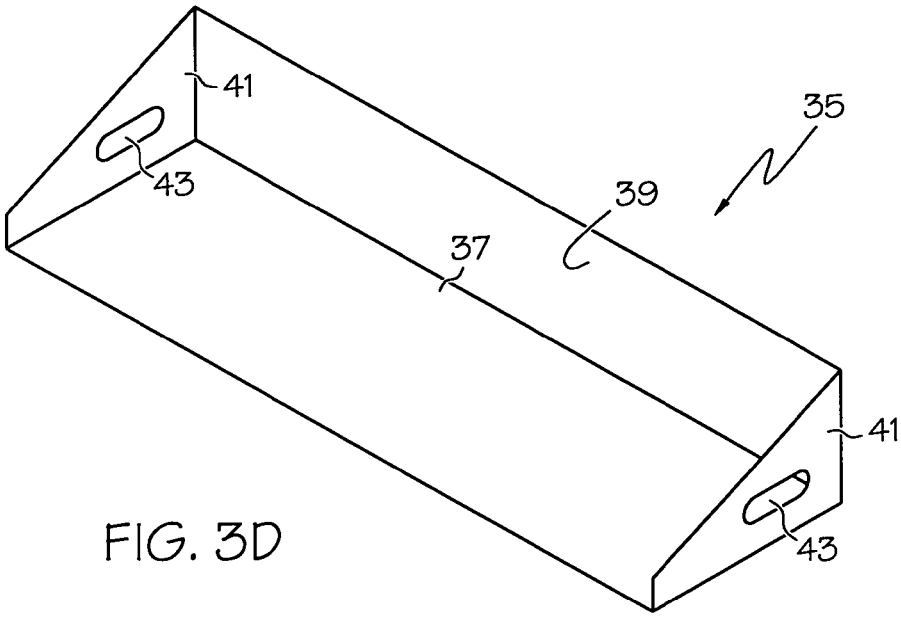
FIG. 3D is a front perspective view of an envelope dispenser.

As shown in FIG. 3D, an envelope dispenser 35 may be provided for use with the envelope packages 30. The envelope dispenser 35 may have a lower support panel 37, an upstanding back panel 39 oriented generally perpendicular to the support panel 37, and a pair of opposed, upstanding side panels 41. Each side panel 41 has an opening 43 through which a user can extend his or her hands to grip and carry the envelope dispenser 35.

Figure 3E:
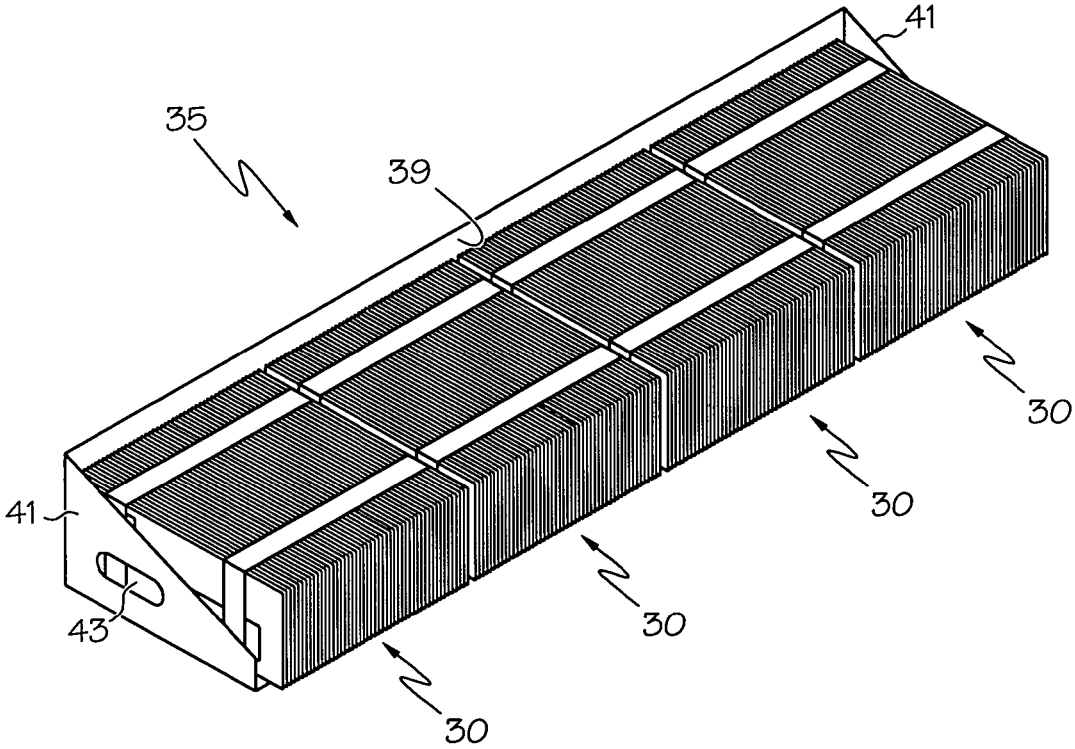
FIG. 3E is a front perspective view of the envelope dispenser of FIG. 3D receiving four envelope packages therein.

As shown in FIG. 3E the envelope dispenser 35 is configured to store a predetermined number of envelope packages 30 (four packages 30 in the illustrated embodiment). In this manner the envelope dispenser 35 can be utilized to transport multiple envelope packages 30. The envelope dispenser 35 may also be configured to dispense envelopes directly to an envelope feeder during the manufacturing process. In particular, four (or more or less) envelope packages 30 could be located on the envelope dispenser 35. The bands 32 on the packages 30 could then be cut and removed. An operator could then invert the dispenser 35 on top of a conveyer belt to thereby deposit the envelopes in an aligned and orderly manner for easy processing. The use of the dispenser 35 in this manner reduces repetitious movements by the operator and increases efficiency.

Figure 5:
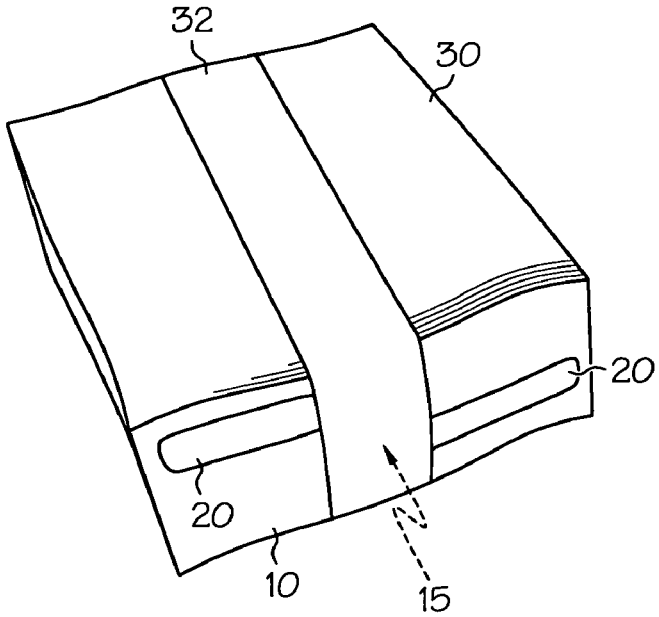
FIG. 5 is a front perspective view of another embodiment of the package of envelopes of the present invention.

As shown in FIG. 5, rather than providing a pair of straps 32 located adjacent to the outer edges of the envelope stack 30, a single strap 32 may be provided and located, for example, about the center 15 of the envelopes 10 of the envelope stack 30. The use of a center strap 32 may prevent over-compression of the stack of envelopes 30 due to the increased thickness at the center portion 15 of the envelopes 10, as discussed above. However, the center strap 32 may, in certain cases, not provide sufficient compression of the envelopes 30 due to the increased thickness at the center of the envelopes 10 which limits compression. Thus, the use of straps 32 which are not located at the center of the envelopes may be desired. The center strap 32 of FIG. 5 may be used in combination with one or both of the outer straps 32 of the arrangement of FIGS. 3A and 3B. Indeed, any of a variety and number of combinations of straps may be utilized without departing from the scope of the present invention.

FIGS. 7-25 (as well as FIG. 6) illustrate a series of steps which may be utilized to form the stack of banded envelopes 30 shown in, for example, FIGS. 3A and 3B. However, it should be understood that the method illustrated in FIGS. 7-25 is illustrative of only a single manner in which the banded envelopes 30 may be assembled, and various other assembly method or steps may be utilized to assemble or create the banded envelopes 30 of the present invention.

Figure 7:
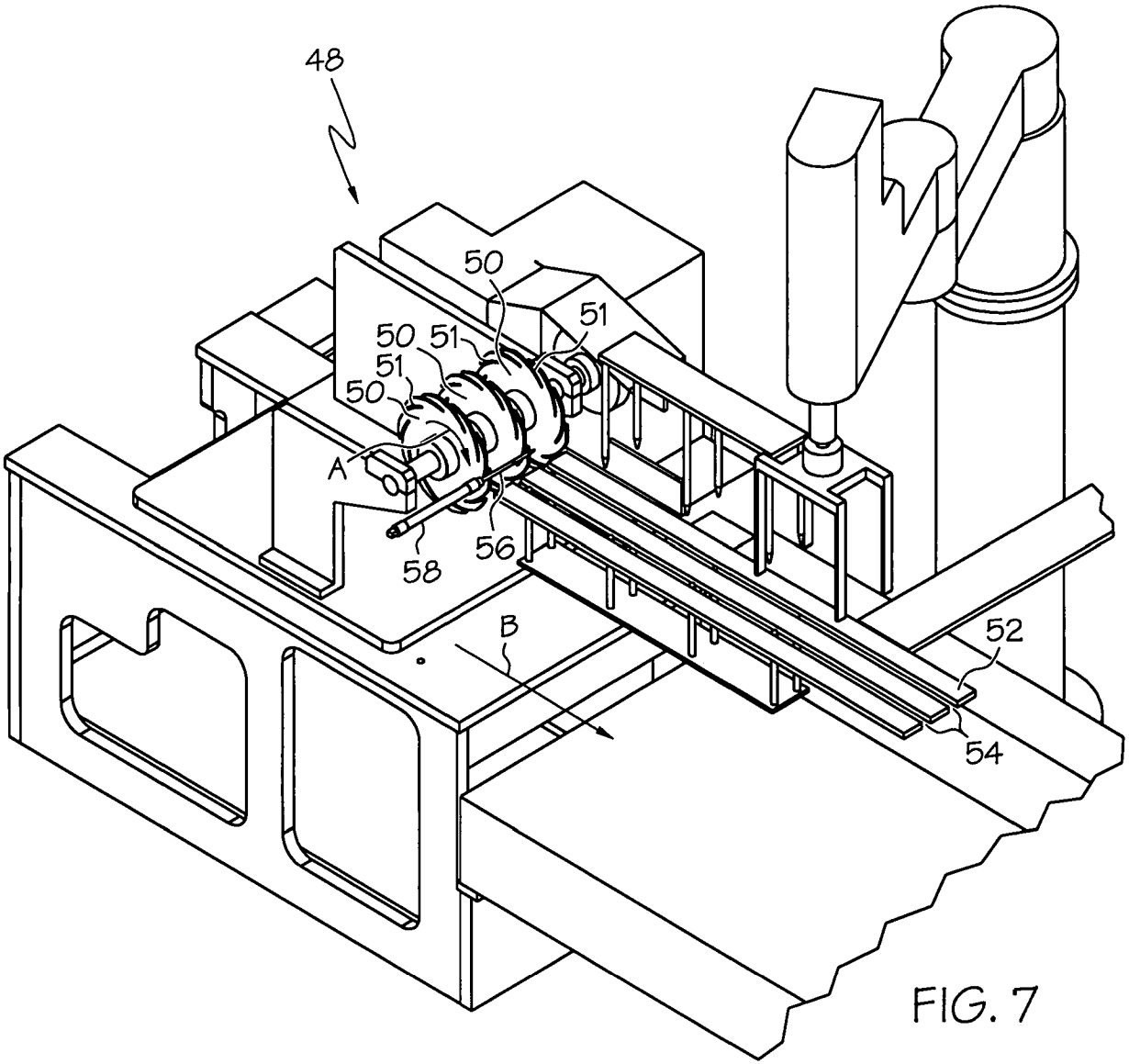
FIGS. 7-25 are a series of front perspective schematic views illustrating a method for forming a package of banded envelopes of the present invention.

As shown in FIG. 7, the banded envelopes may be compiled and banded using a mechanized assembly, apparatus or envelope stacking machine 48. In the illustrated embodiment, the envelope stacking machine 48 includes a set of three co-axial spiral wheels or discs or delivery spiders 50 located at the end of a support table or support surface 52. The table 52 has a pair of slots 54 formed therein and extending the length of the table 52. More or less slots 54 may be provided as desired to match the configuration of the particular machine 48. Each spiral wheel 50 includes a set of spiral slots 51 extending in a general circumferential direction. Each of the spiral slots 51 is shaped to receive an envelope therein by an envelope feeding device (not shown) as the spiral wheels 50 rotate about their central axes.

Figure 8:
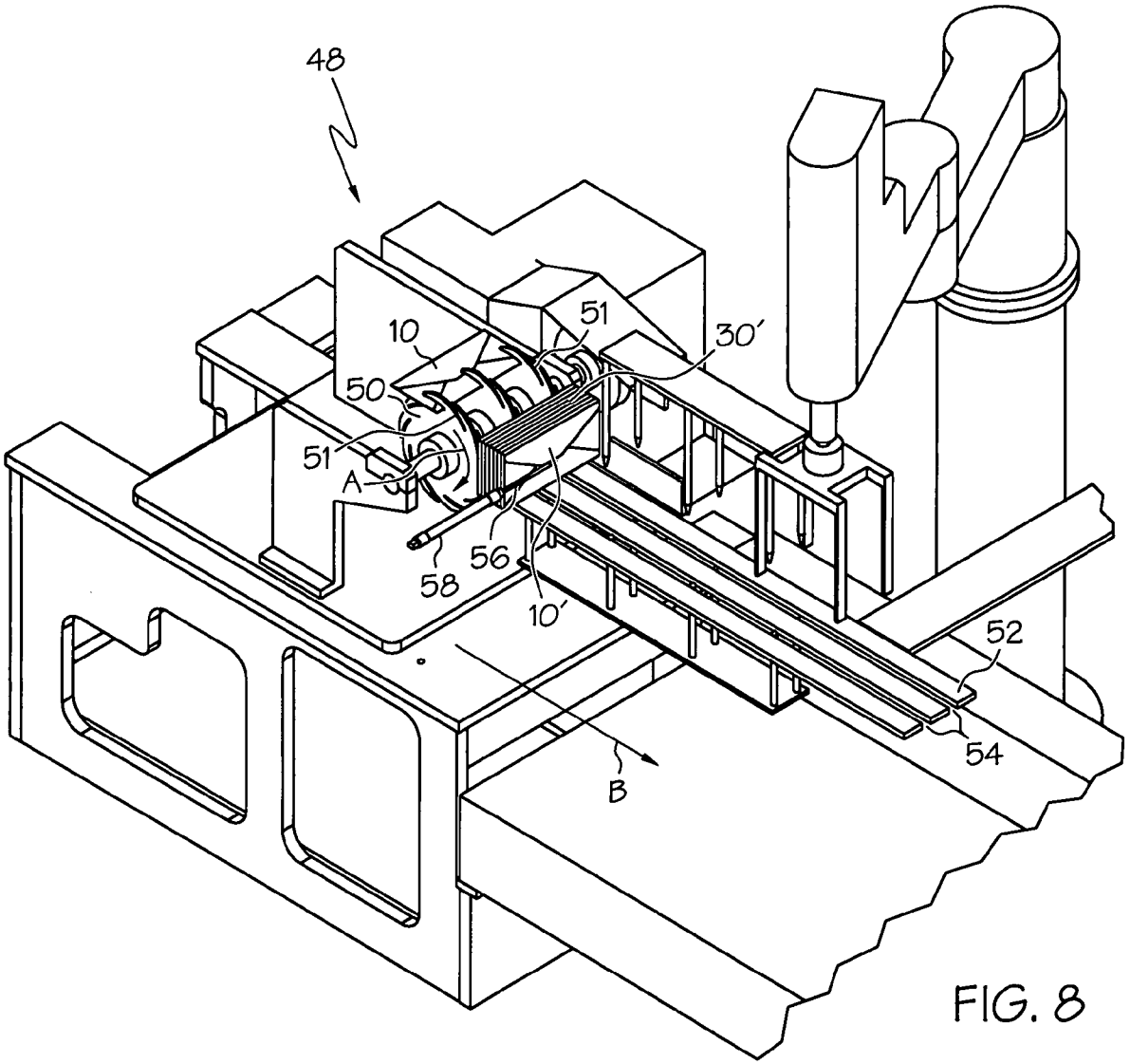

In order to commence the stacking operation, the spiral wheels 50 are rotated in the direction of arrow A as envelopes 10 (one of which is shown in FIG. 8) are fed into the spiral slots 51 of the spiral wheels 50. As the spiral wheels 50 pass through the slots 54 of the support table 52, the lower edge of each envelope 10 that is held in the spiral wheels 50 contacts the support table 52, thereby retracting the envelope 10 out of the spiral slots 51 upon continued rotation of the spiral wheels 50. In this manner, as envelopes 10 are fed into the spiral wheels 50 at the upstream location of the support table 52, the rotating spiral wheels 50 continuously deposit an upright stack of envelopes 10 on the support table 52.

As the spiral wheels 50 continue to rotate and deposit envelopes 10, a partial stack of envelopes 30' is created on the table 52 (FIG. 8). Thus, FIG. 8 illustrates the spiral wheels 50 as an envelope delivery mechanism. However, instead of the spiral wheels 50, various other methods of depositing the envelopes 10 onto the support table 52 may be utilized. For example, a vacuum wheel or other similar devices may be utilized as the envelope delivery mechanism to deposit the envelopes 10 on the support table 52.

The envelope stacking machine 48 includes a horizontally-extending backing bar 56 which is coupled to a backing bar support 58. The backing bar 56 engages the first envelope 10' deposited on the table 52 by the spiral wheels 50 to provide support to the first envelope 10' (and subsequent envelopes 10 deposited on the table 52). The backing bar 56 is movable in the downstream direction B (i.e., along the length of the support table 52) to accommodate the growing length of the partial stack of envelopes 30'. As will be discussed in greater detail below, the backing bar 56 can be retracted (i.e., moved along its central axis) into the backing bar support 58, and FIG. 8 illustrates the backing bar 56 in its extended position.

Figure 9:
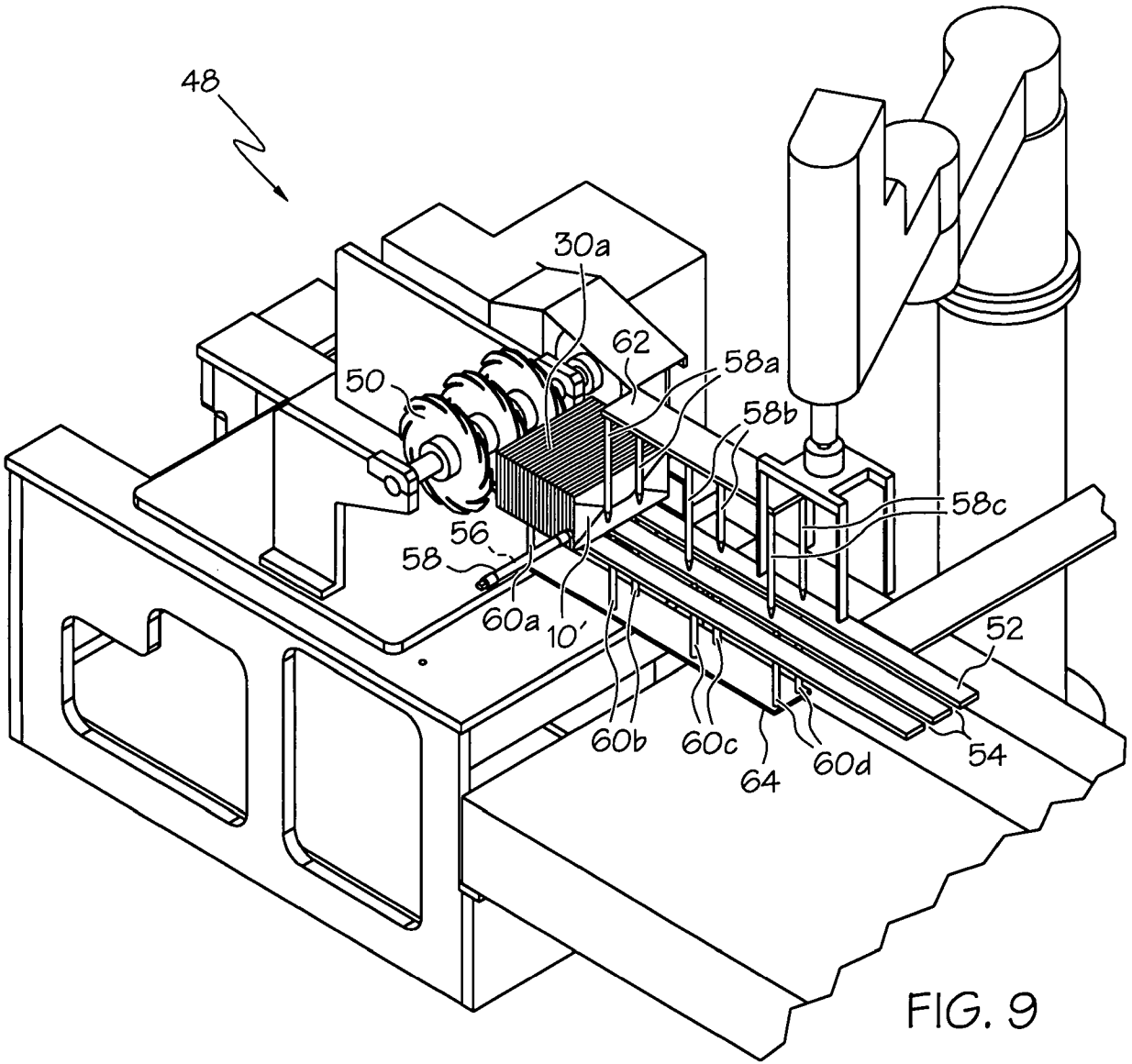

As the spiral wheels 50 continue to deposit envelopes 10 on the support table 52, the partial stack 30' continues to grow and the backing bar 56 moves downstream to accommodate the growing stack 30'. As can be seen in FIG. 9, eventually a full stack of envelopes 30*a* is created after a predetermined number of envelopes 10 are located on the support table 52.

As can be seen in FIG. 9, the machine 48 includes an upper set 58 (58*a*, 58*b*, 58*c*) of generally vertically oriented fingers and a lower set 60 (60*a*, 60*b*, 60*c*, 60*d*) of generally vertically oriented fingers. The upper set of fingers 58 includes an upstream pair of upper fingers 58*a*, a downstream pair of upper fingers 58*c*, and an intermediate set of upper fingers 58*b*. All of the upper fingers 58 are coupled to an upper finger plate 62, and are configured and located to fit between the slots 54 of the support table 52.

Similarly, the lower set of fingers 60 includes an upstream pair of lower fingers 60*a*, a downstream pair of lower fingers 60*d*, and two intermediate pairs of lower fingers 60*b*, 60*c*. All of the lower fingers 60 are coupled to a lower finger plate 64 and are configured to fit between the slots 54 of the support table 52. Both the upper fingers 58 and lower fingers 60 are movable in a vertical direction. In addition, as will be discussed in greater detail below, the lower fingers 60 are movable in the upstream and downstream directions.

Figure 10:
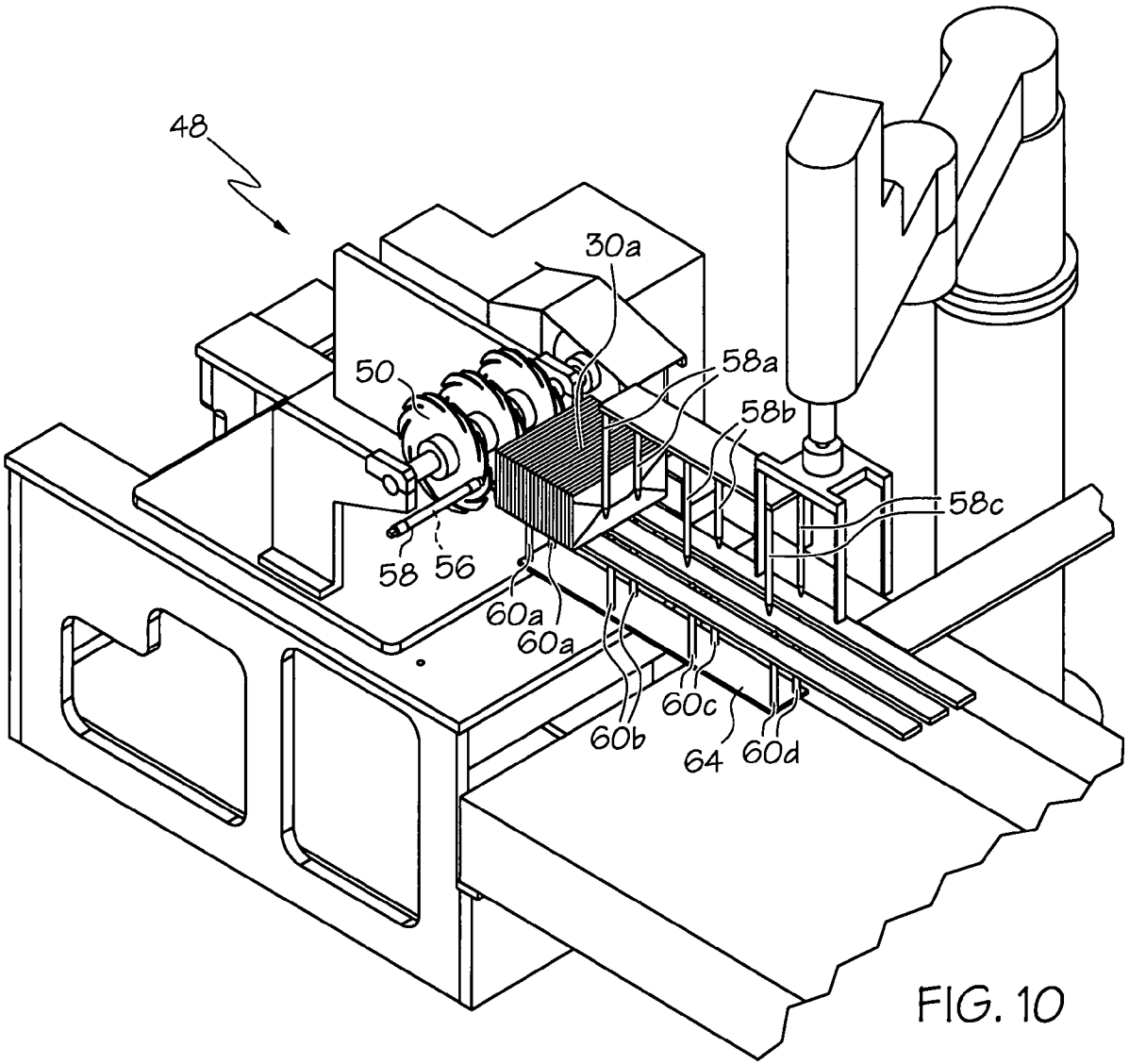

In the depiction of FIG. 9, the upper fingers 58 are located in their lower or extended position, and the lower fingers 60 are shown in their lower or retracted position. In this configuration, the upstream pair of upper fingers 58*a* engages the first envelope 10' of the stack of envelopes 30*a*. Once the stack of envelopes 30*a* engages the upstream pair of upper fingers 58*a*, the backing bar 56 can be retracted into the backing bar support 58, as shown in FIG. 9. The upstream pair of upper fingers 58*a* provides support to the stack 30*a*, thereby allowing retraction of the backing bar 56 without causing collapse of the stack 30*a*. Next, as can be seen in FIG. 10, the backing bar 56 and backing bar support 58 move upstream to their home position adjacent to the spiral wheels 50.

As shown in FIG. 1, the backing bar 56 is then moved to its extended position. In this manner, the backing bar 56 creates or defines a break between the stack of envelopes 30*a* and a new stack of envelopes 30*b* which will be created as the spiral wheels 50 continue to rotate and feed new envelopes 10 onto the table 52. Thus the upper fingers 58, lower fingers 60 and backing bar 56 together form a separating mechanism, although various other structures and devices may be utilized as the separating mechanism.

Figure 11:
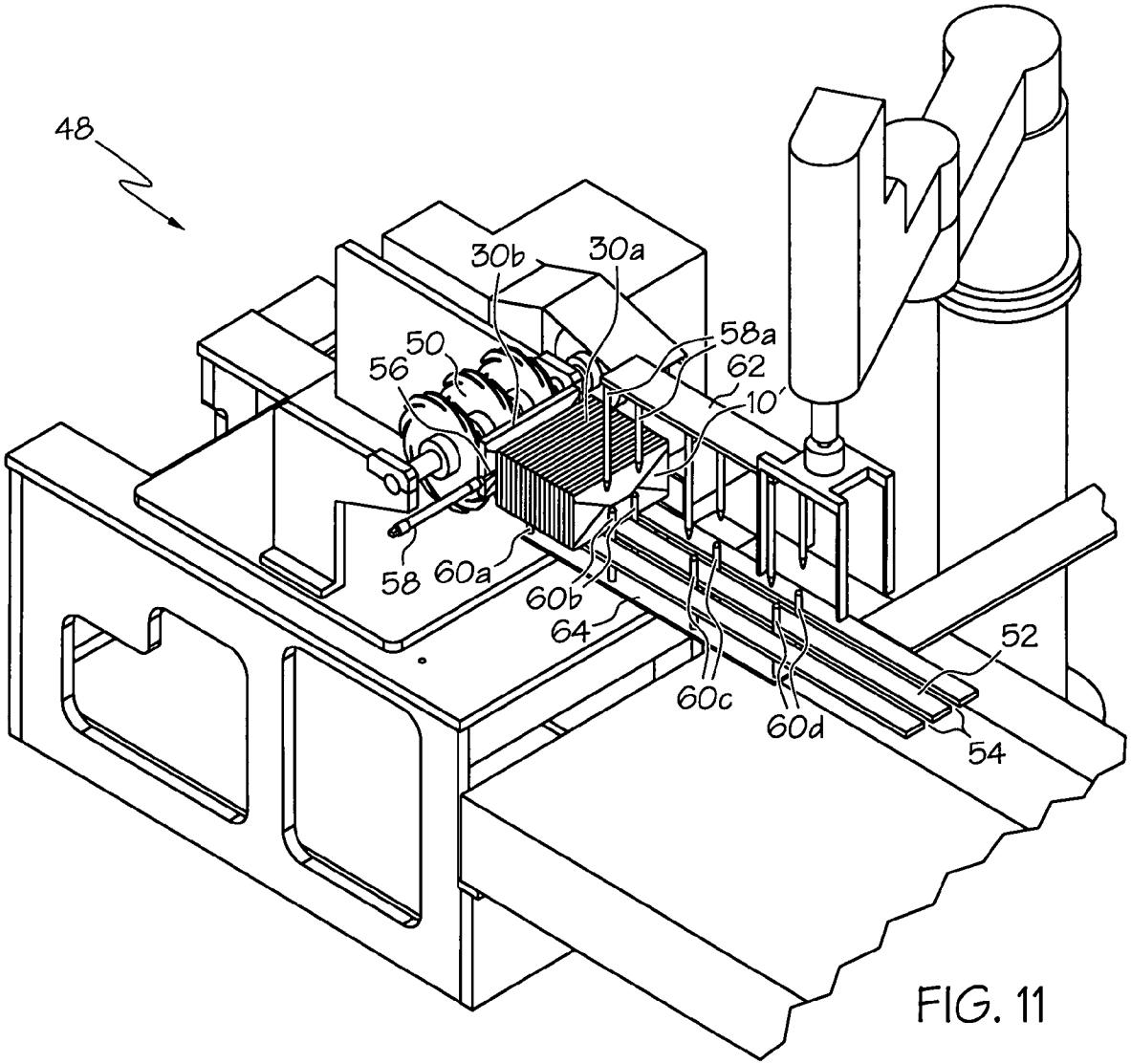

Immediately after the backing bar 56 is moved to its extended position, the lower set of fingers 60 is raised from its lower (or retracted) position to its upper (or extended) position such that the lower set of fingers 60 protrude upwardly through the slots 54 of the support table 52. At the same time, the upper set of fingers 58 is raised to its upper (or retracted) position until the upper set of fingers 58 are pulled out of contact with the stack of envelopes 30*a*. FIG. 11 illustrates the upper 58 and lower 60 set of fingers as they are in the process of being moved to their upper positions. As can be seen in FIG. 11, the upper 58 and lower 60 set of fingers are configured such that the intermediate pair of lower fingers 60*b* engage the front envelope 10' of the stack of envelopes 30*a* at the same time that the upstream upper pair of fingers 58*a* engage the front envelope 10'. This arrangement ensures that the envelope stack 30*a* is held in place as the upper 58 and lower 60 sets of fingers are raised.

Figure 12:
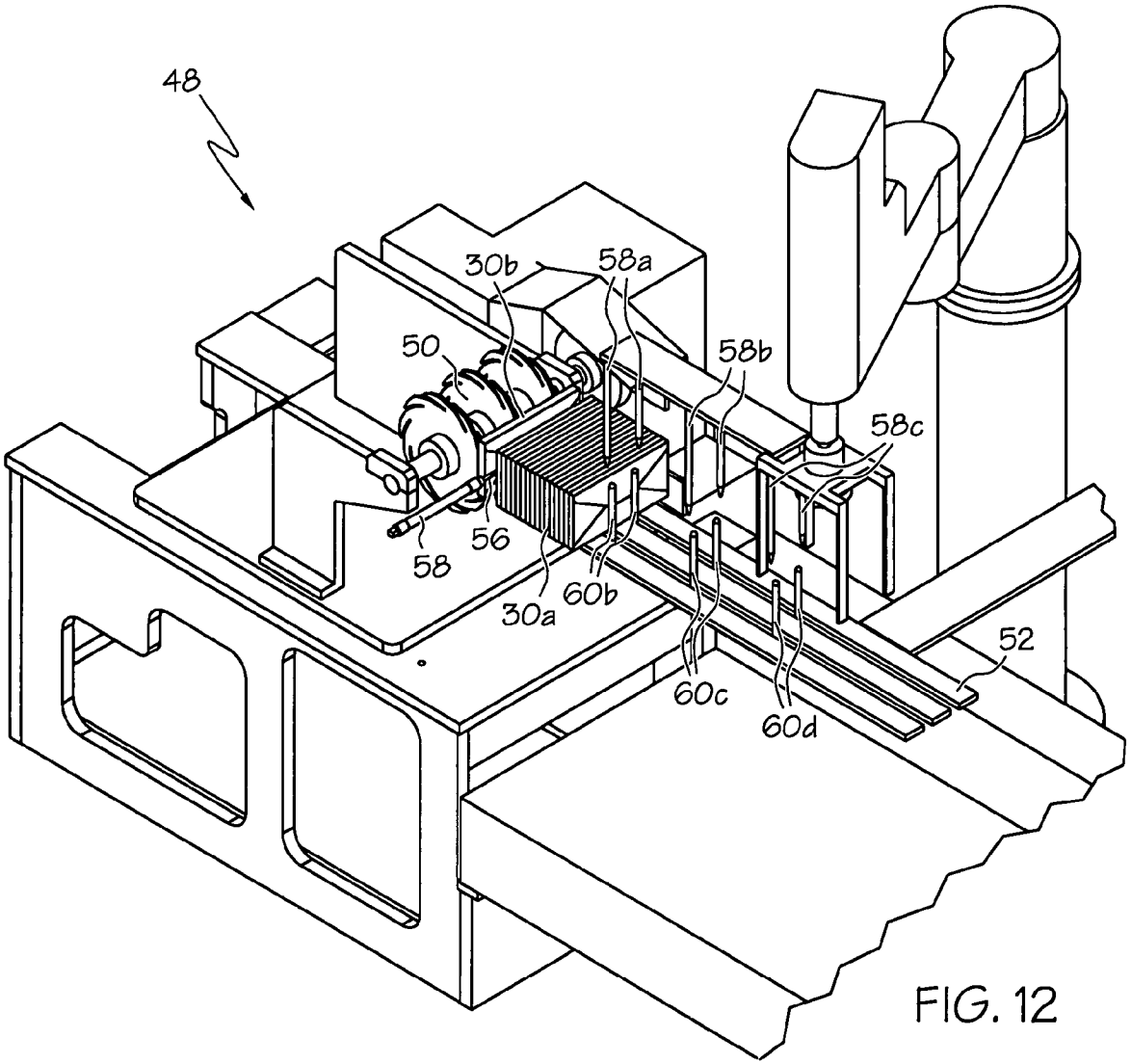

FIG. 12 illustrates the upper set of fingers 58 in their fully retracted position, and the lower set of fingers 60 in their fully extended position. In this state, the upstream pair of lower fingers 60*a* (not visible in FIG. 12) are located adjacent to the backing bar 56 (i.e., located between the stacks 30*a*, 30*b*). The intermediate pair of lower fingers 60*b* engages the leading envelope 10' of the stack of envelopes 30*a* to retain the stack of envelopes in place between the fingers 60*a*, 60*b*.

Figure 13:
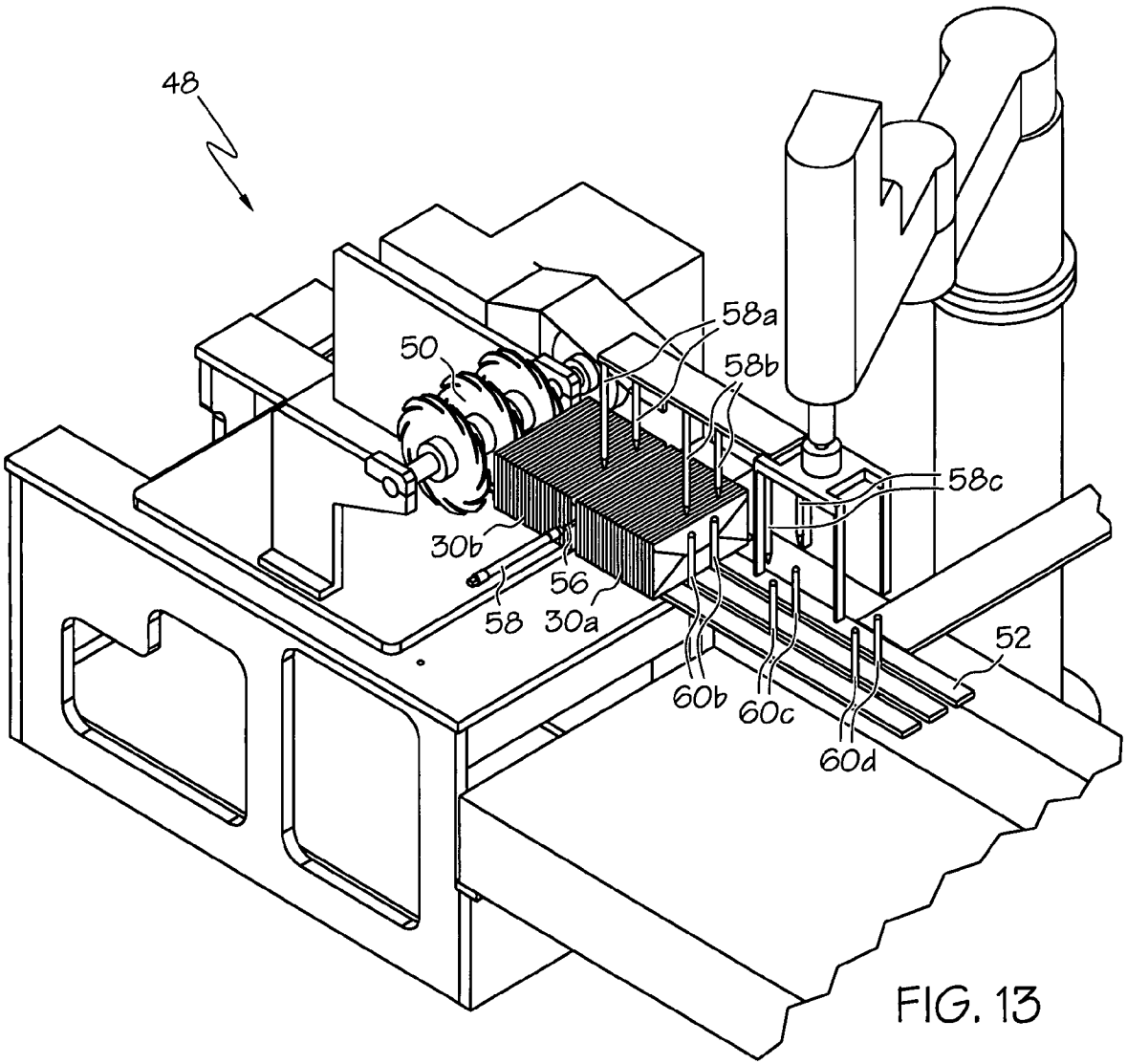

As the spiral wheels 50 continue to rotate and feed envelopes 10 onto the support table 52, the backing bar 56 and lower set of fingers 60 move downstream together to accommodate the newly-created stack of envelopes 30*b*. FIG. 13 illustrates a new stack of envelopes 30*b* created in this manner, with the backing bar 56 and lower set of fingers 60 moved downstream to accommodate this newly-created stack 30*b*. In addition, because the first created stack of envelopes 30*a* is trapped between the upstream lower pair of fingers 60*a* and the intermediate pair of lower fingers 60*b*, the first stack of envelopes 30*a* is simultaneously moved downstream along the support table 52.

Figure 14:
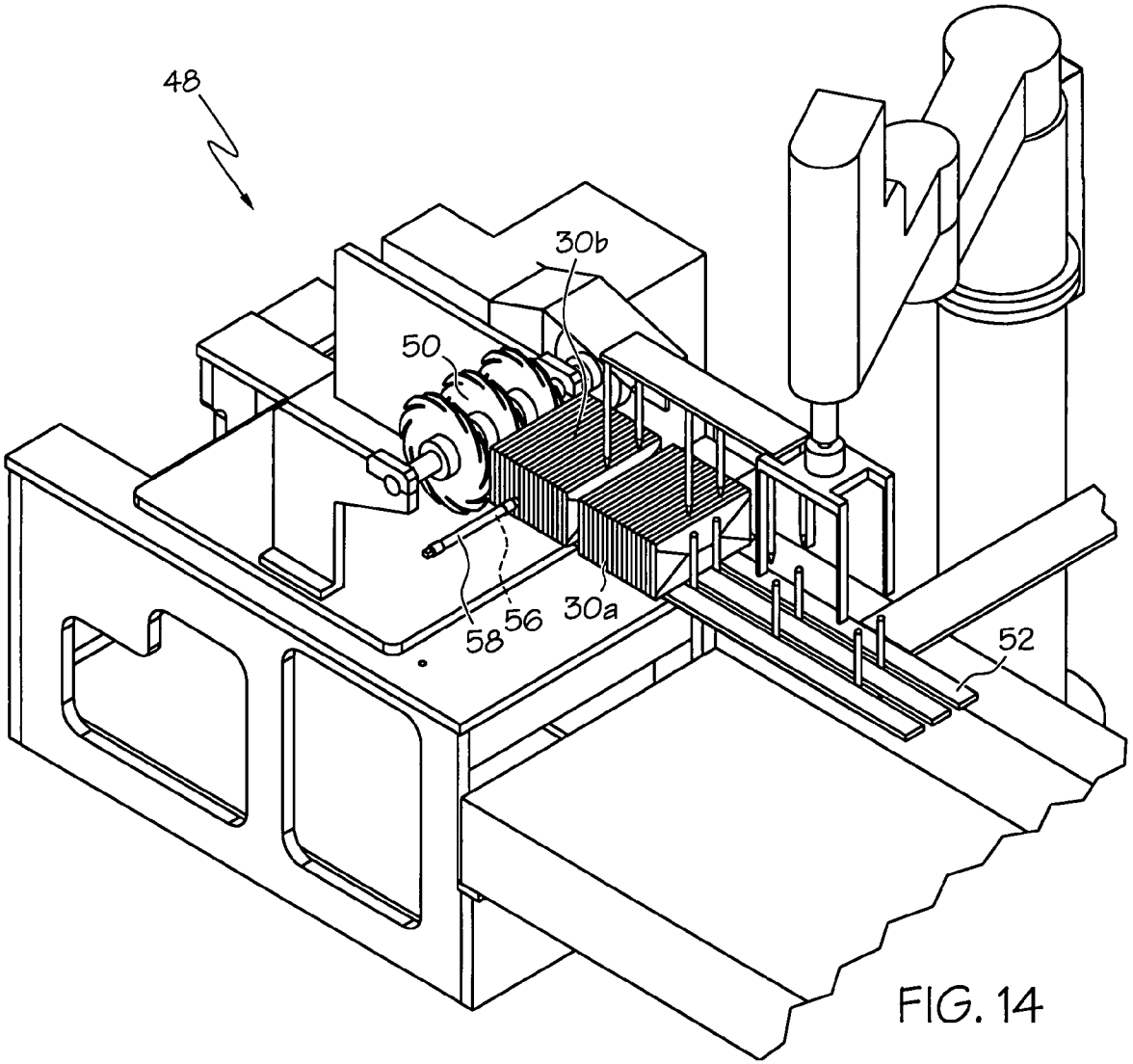

Next, as shown in FIG. 14, the backing bar 56 is retracted inside the backing bar support 58 and moved to its home position. FIG. 14 illustrates the backing bar 56 and backing support 58 en route to the home position.

Figure 15:
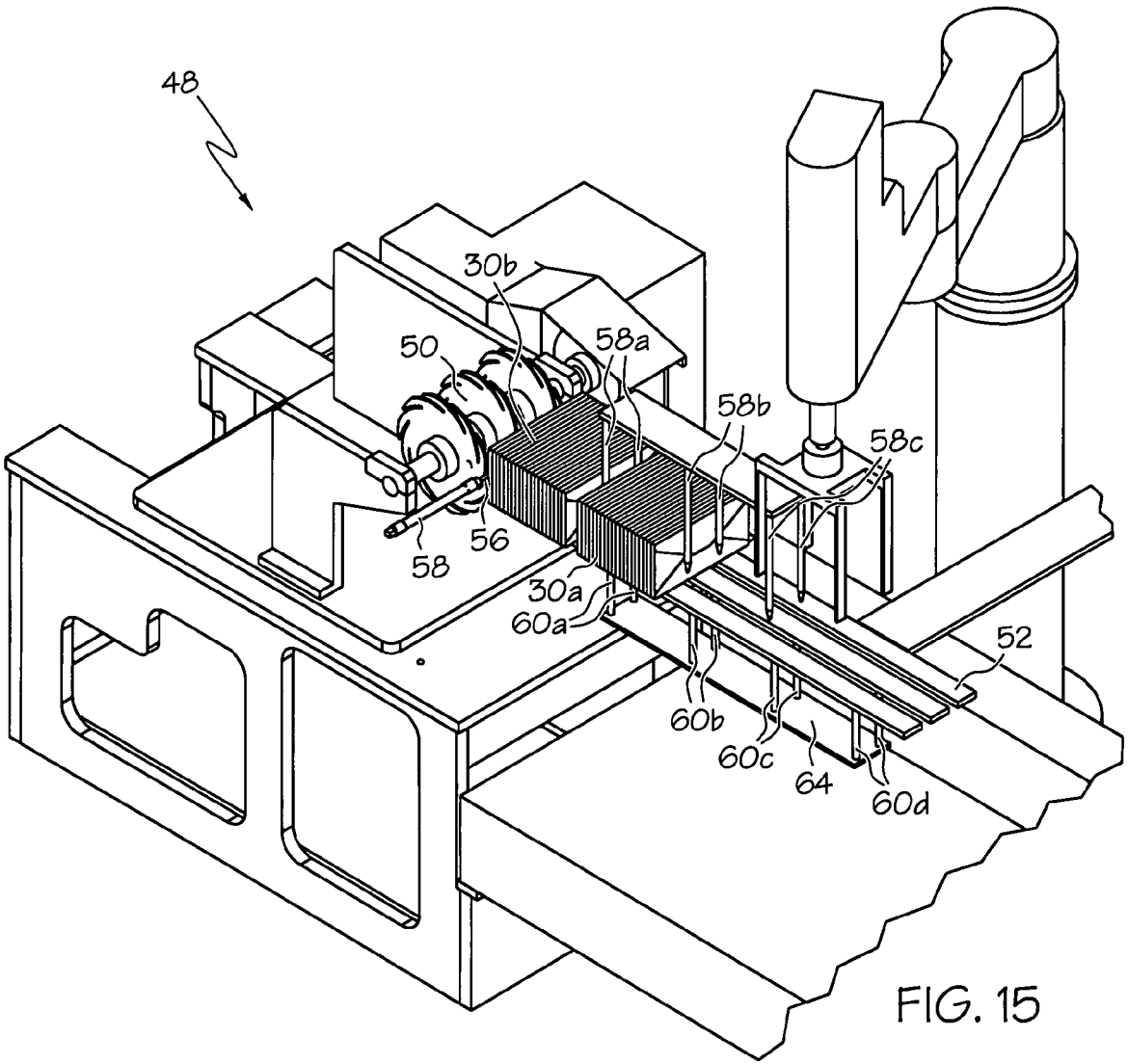
Figure 16:
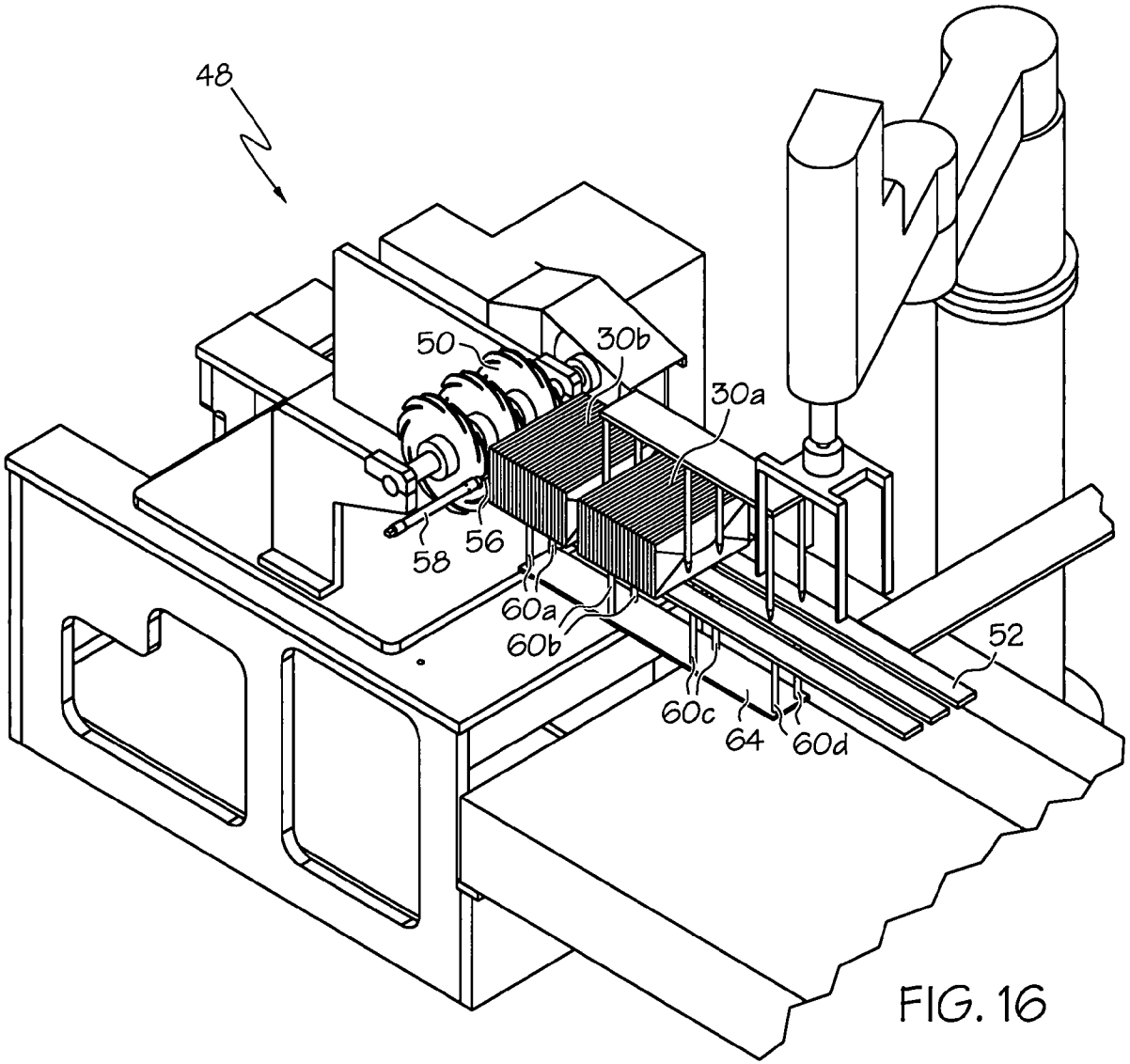

As shown in FIG. 15, once the backing bar 56 is returned to its home position, it is moved to its extended state such that the backing bar 56 defines the break between the stack of envelopes 30*b* and the next stack of envelopes 30*c* to be created. In addition, as can be seen in FIG. 15, the upper set of fingers 58 is lowered or moved to its extended position and the lower sets of fingers 60 is lowered or moved to its retracted positions. The stack of envelopes 30*a* is thereby held in place between the upstream pair of upper fingers 58*a* and the intermediate pair of upper fingers 58*b*, and the stack of envelopes 30*b* is held in place between the backing bar 56 and the upstream pair of upper fingers 58*a*. Next, the lower set of fingers 60 is moved upstream by a distance equal to the width of the stack of envelopes 30*a*, 30*b* (FIG. 16). Thus, the upper set of fingers 58 essentially act as a place holder while the lower set of fingers 60 are re-set.

Figure 17:
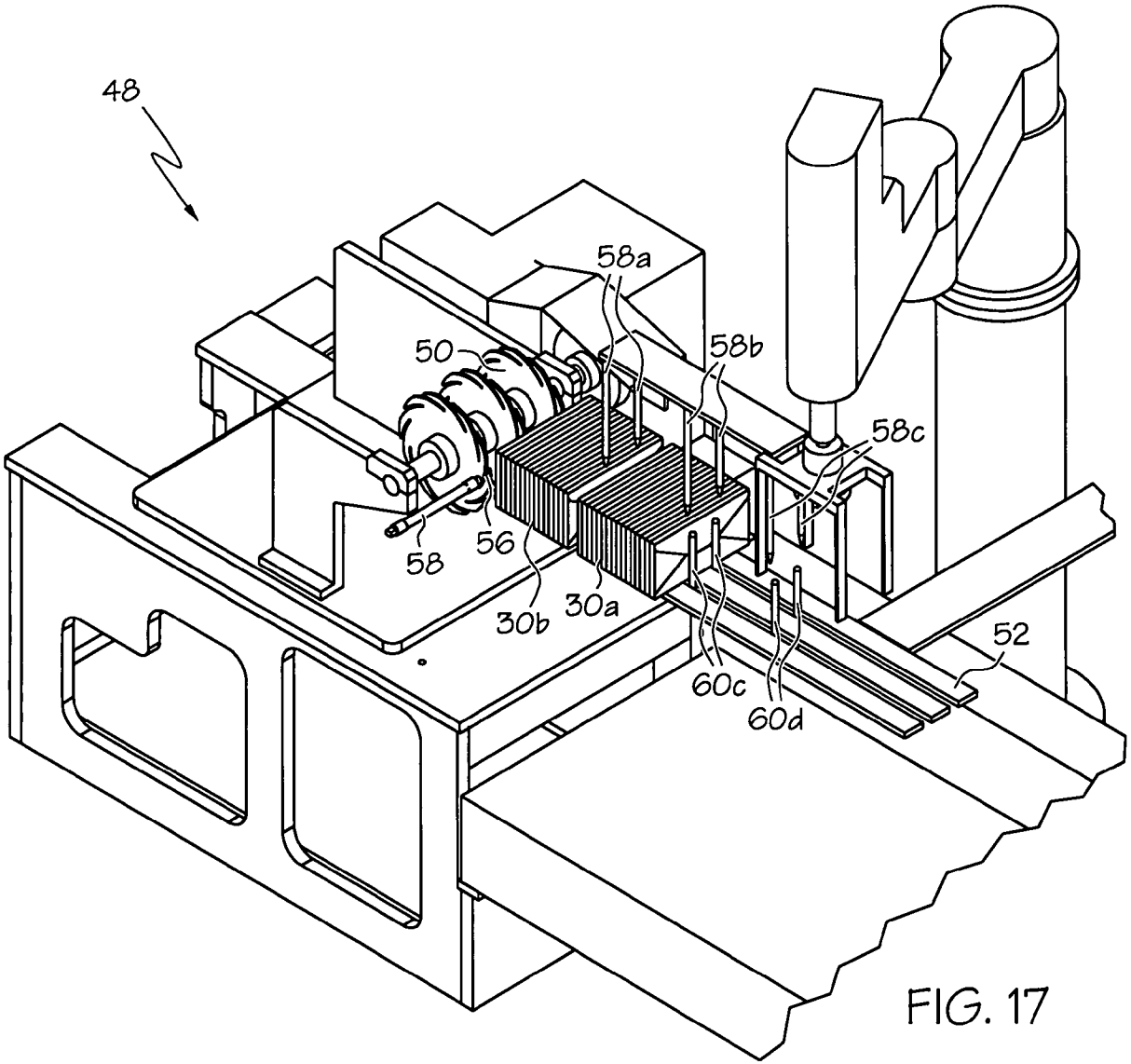

As shown in FIG. 17, the lower set of fingers 60 are then raised or moved to their extended positions while the upper set of fingers 58 are raised or moved to their retracted positions. The upstream pair of lower fingers 60*a* (not shown in FIG. 17) is located upstream of the stack of envelopes 30*b* and adjacent to the backing bar 56, and the stacks of envelopes 30*a*, 30*b* are retained in place between the various sets of lower fingers 60*a*, 60*b*, 60*c*.

Figure 18:
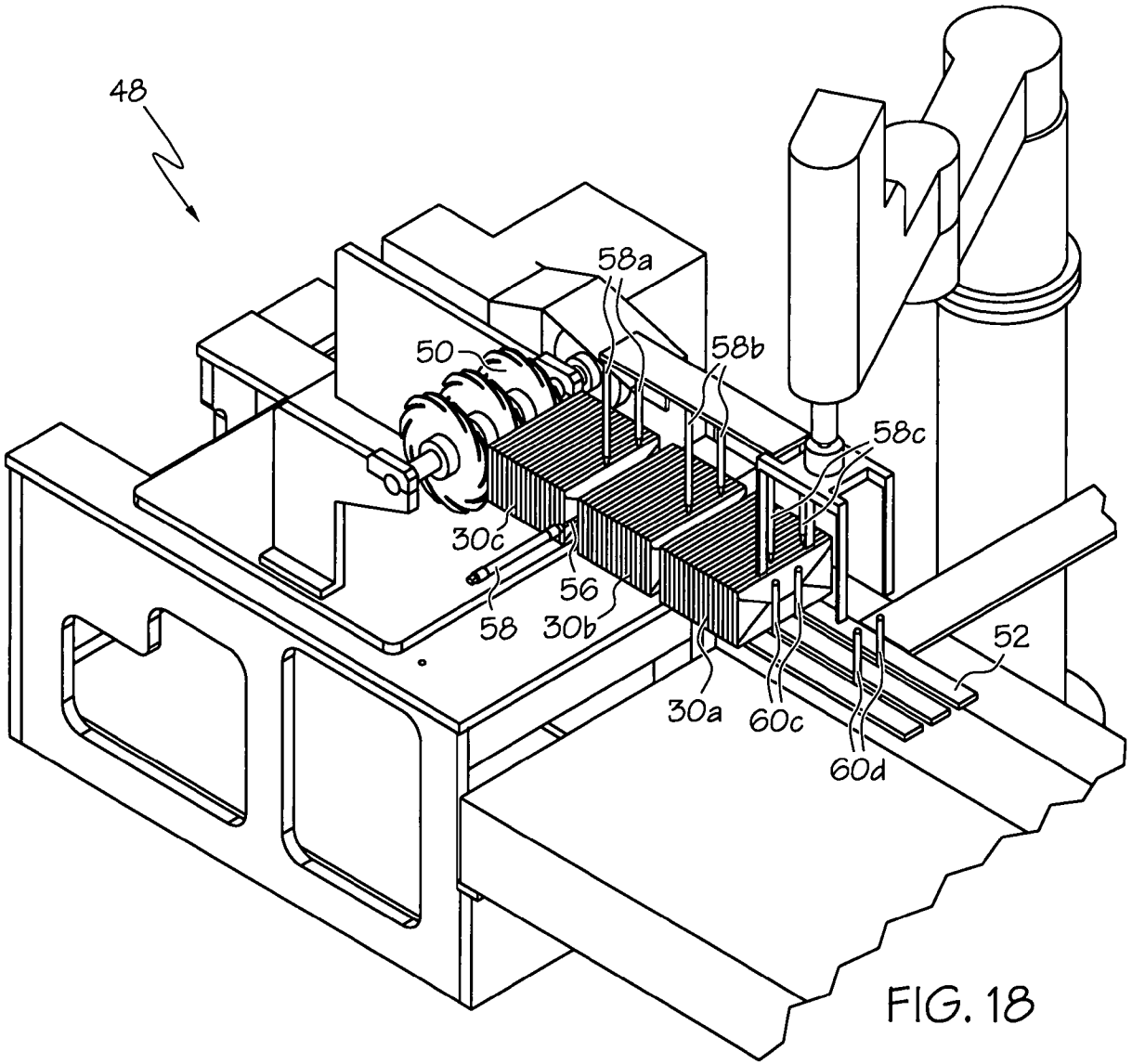

Next, as shown in FIG. 18, as the spiral wheels 50 continue to rotate the backing bar 56 and lower set of fingers 60 move downstream to accommodate the creation of the stack of envelopes 30*c*. This pattern of retraction and movement of the backing bar 56, lowering the upper 58 and lower 60 sets of fingers, moving the lower set of fingers 60 upstream, raising the upper 58 and lower 60 set of fingers, and moving the backing bar 56 and lower fingers 60 downstream to accommodate the newest stack of envelopes 30*d* is repeated until another stack of envelopes 30*d* is created as shown in FIG. 19.

Figure 19:
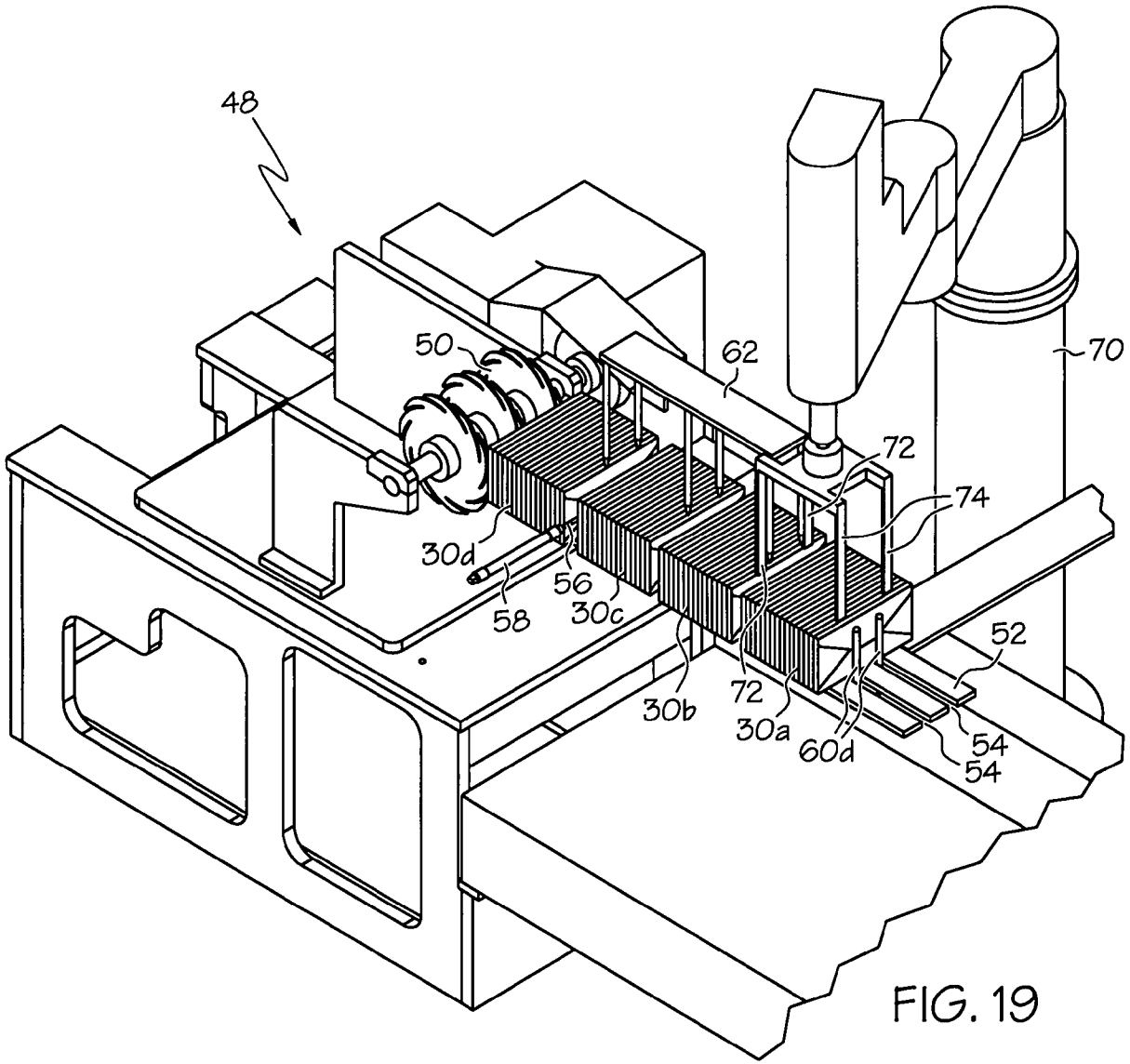

The embodiment of FIG. 19 illustrates four stacks of envelopes 30*a*, 30*b*, 30*c*, 30*d* located on the support table 52. However, of course, any number of stacks of envelopes 30 may be created on the support table 52 in the desired manner, with simple adjustments in the fingers 58, 60 and table 52 being made to accommodate the varying number of stacks 30.

Figure 6:
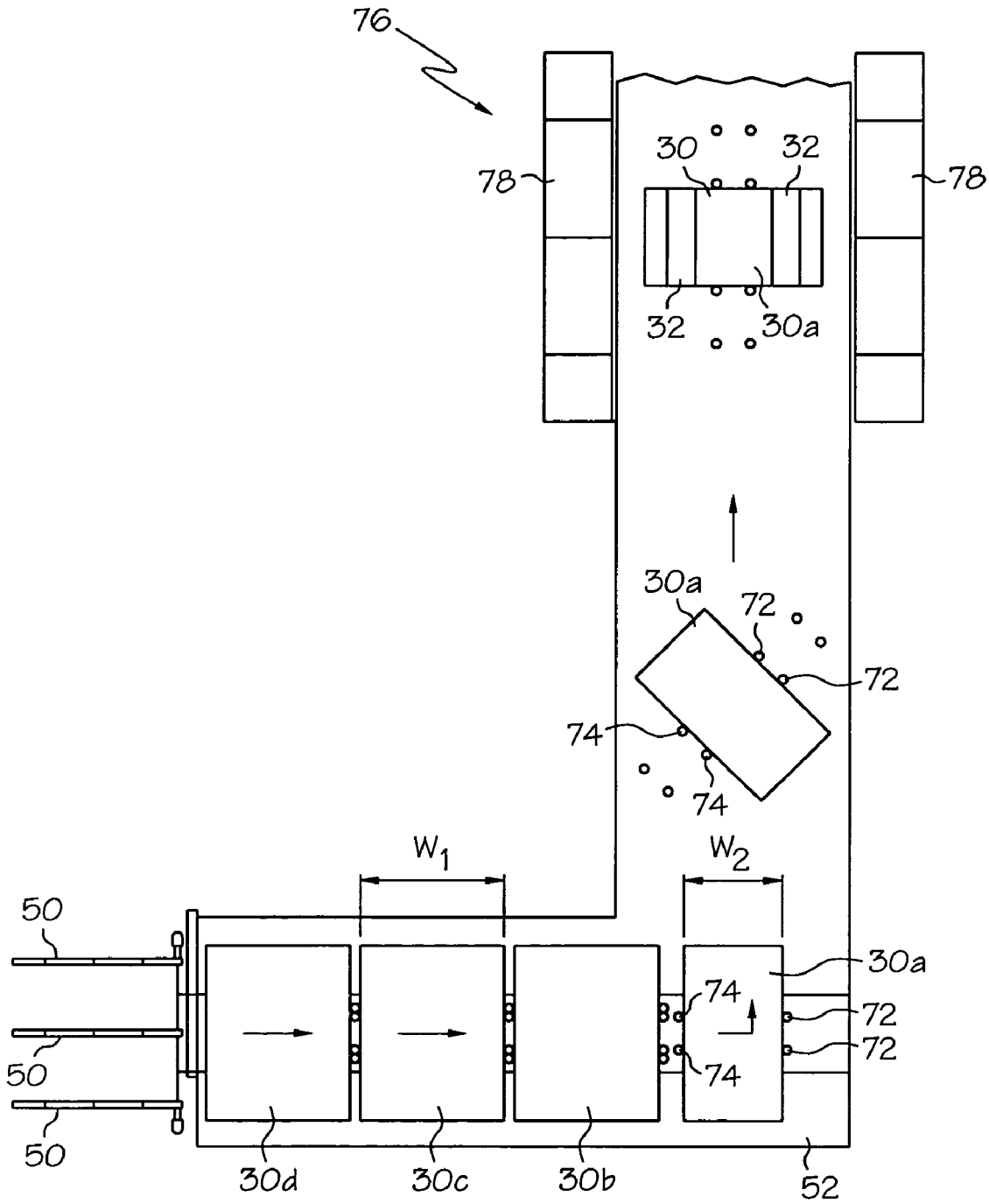
FIG. 6 is a top schematic view of a packaging method of the present invention.
Figure 20:
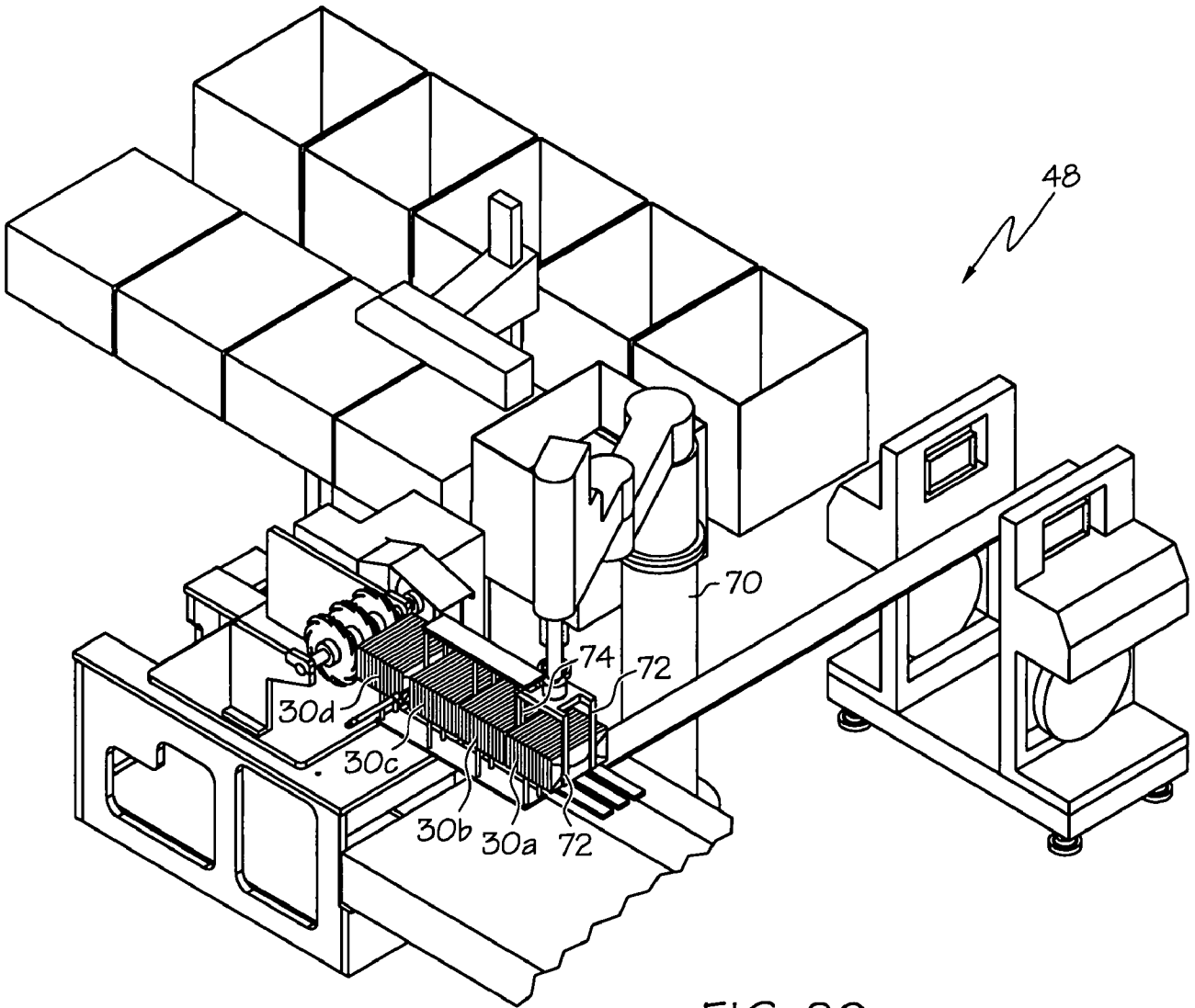

The machine 48 may include a robot arm 70 having a pair of left gripping paddles 72 and a pair of right gripping paddles 74 to form an envelope stack moving mechanism. The robot arm 70 is lowered until the left 72 and right 74 pairs of paddles are located at either side of the downstream-most envelope stack 30*a* (FIG. 20). The left 72 and right 74 paddles are then moved towards each other to compress the stack of envelopes 30*a* therebetween. For example, as shown in FIG. 6, the paddles 72, 74 may compress the stack 30*a* from a width $W_1$ to a width $W_2$. The squeezing motion of the left 72 and right 74 paddles may apply the desired compression to the stack of envelopes 30*a*, and simultaneously allows the robot arm 70 to grip the stack of envelopes 30*a* for movement and subsequent handling. The paddles 72, 74 and robot arm 70 may be movable or controllable by various air cylinders, motor and slide combinations, linear motors and the like as is well known in the art.

Figure 21:
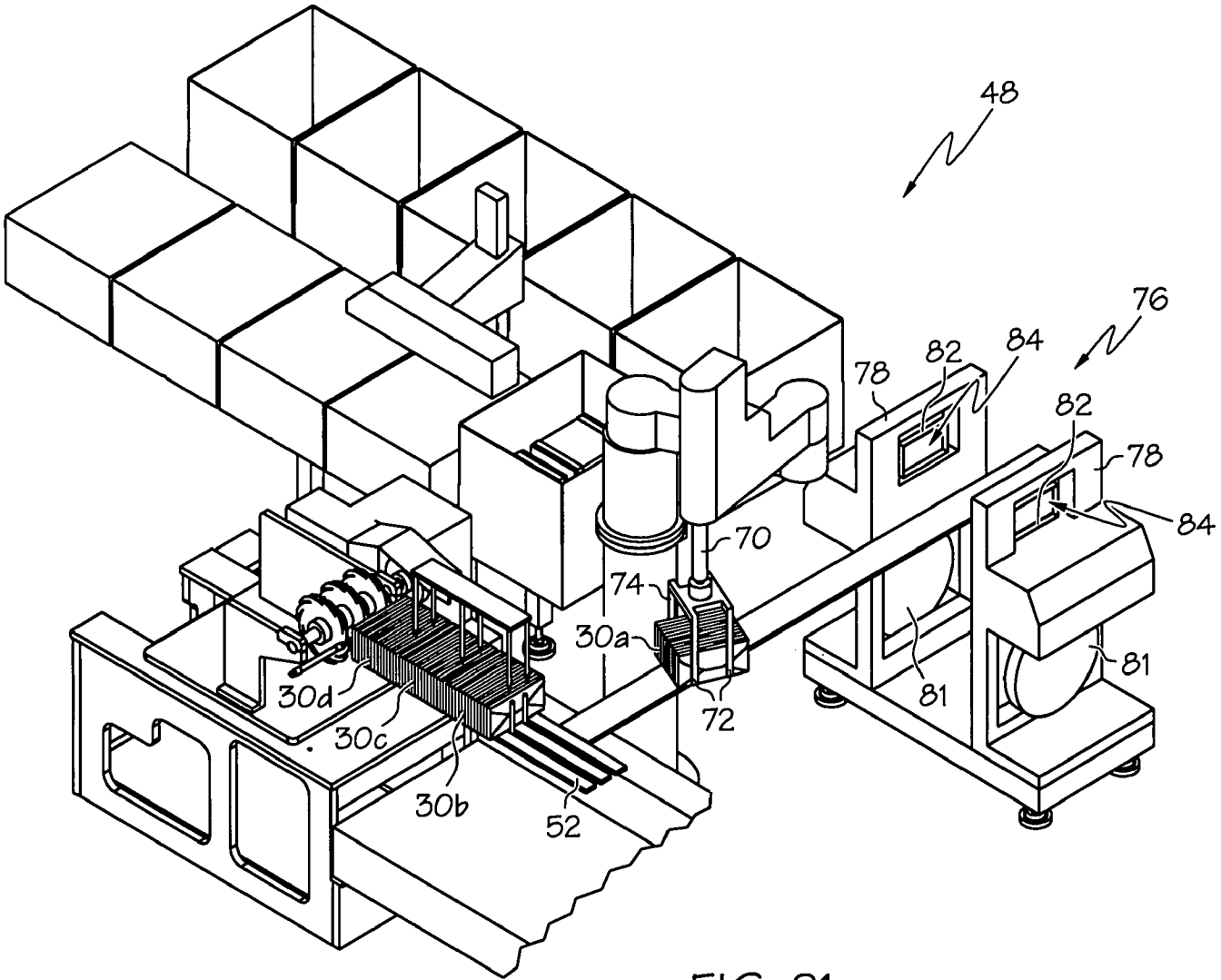
Figure 22:
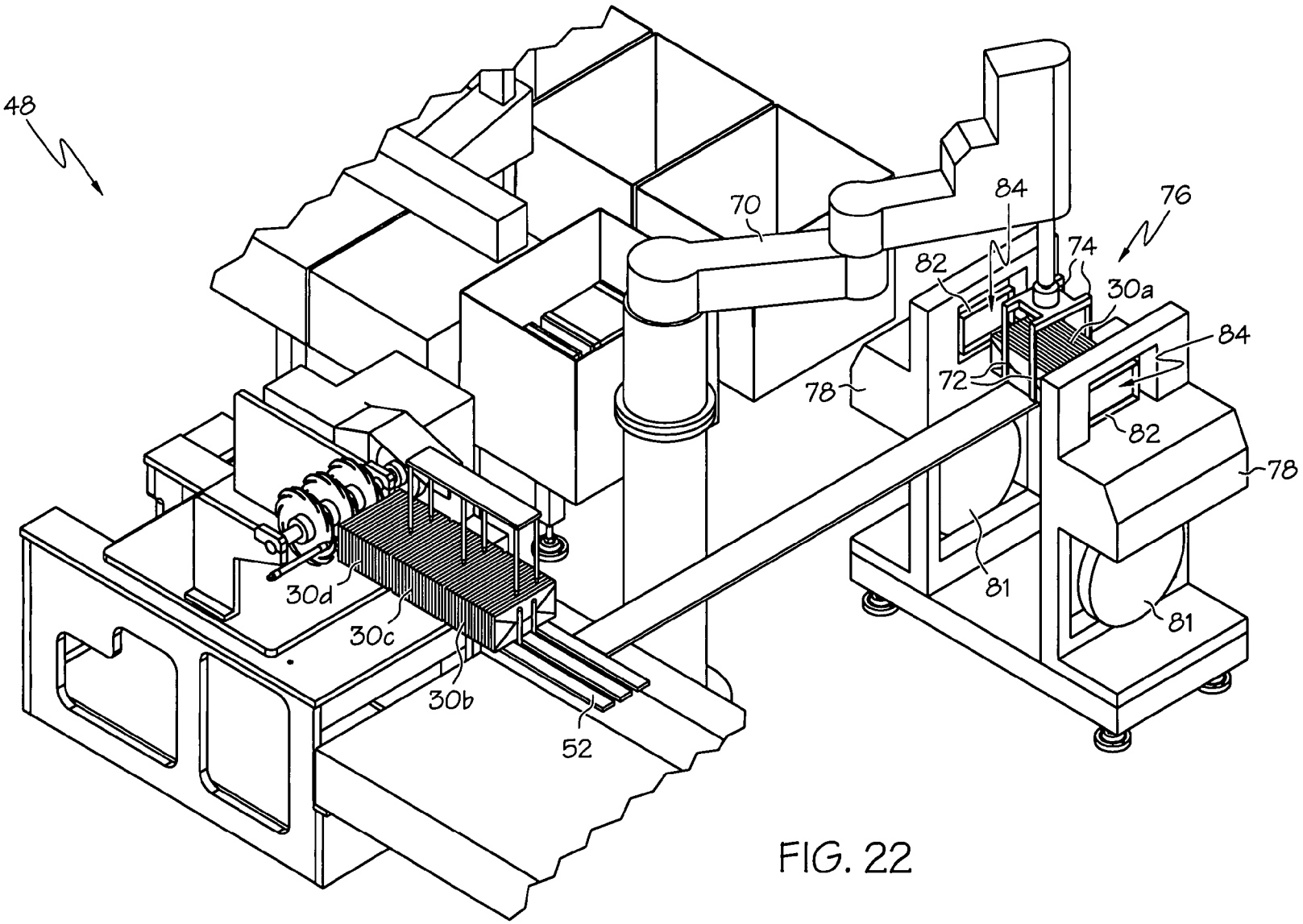

Next, as shown in FIG. 21, the stack of envelopes 30*a* is lifted by the robot arm 70 and moved in a direction perpendicular to the movement of the envelopes along the support table 52. Alternately, the stack of envelopes 30*a* could be slid along a table surface, and could also be moved in a direction parallel to the movement of envelopes along the support table 52 (not shown in FIG. 21). The compressed envelope stack 30*a* is then positioned on or in a banding device or bander 76 for application of the bands. For example, as shown in FIG. 22, the banding device 76 may include a pair of banding portions 78 having a spool of banding material located in an associated banding spool storage compartment 81. The spool of band material 82 is fed around the outer perimeter of a banding opening 84 of each banding portion 78.

Figure 23:
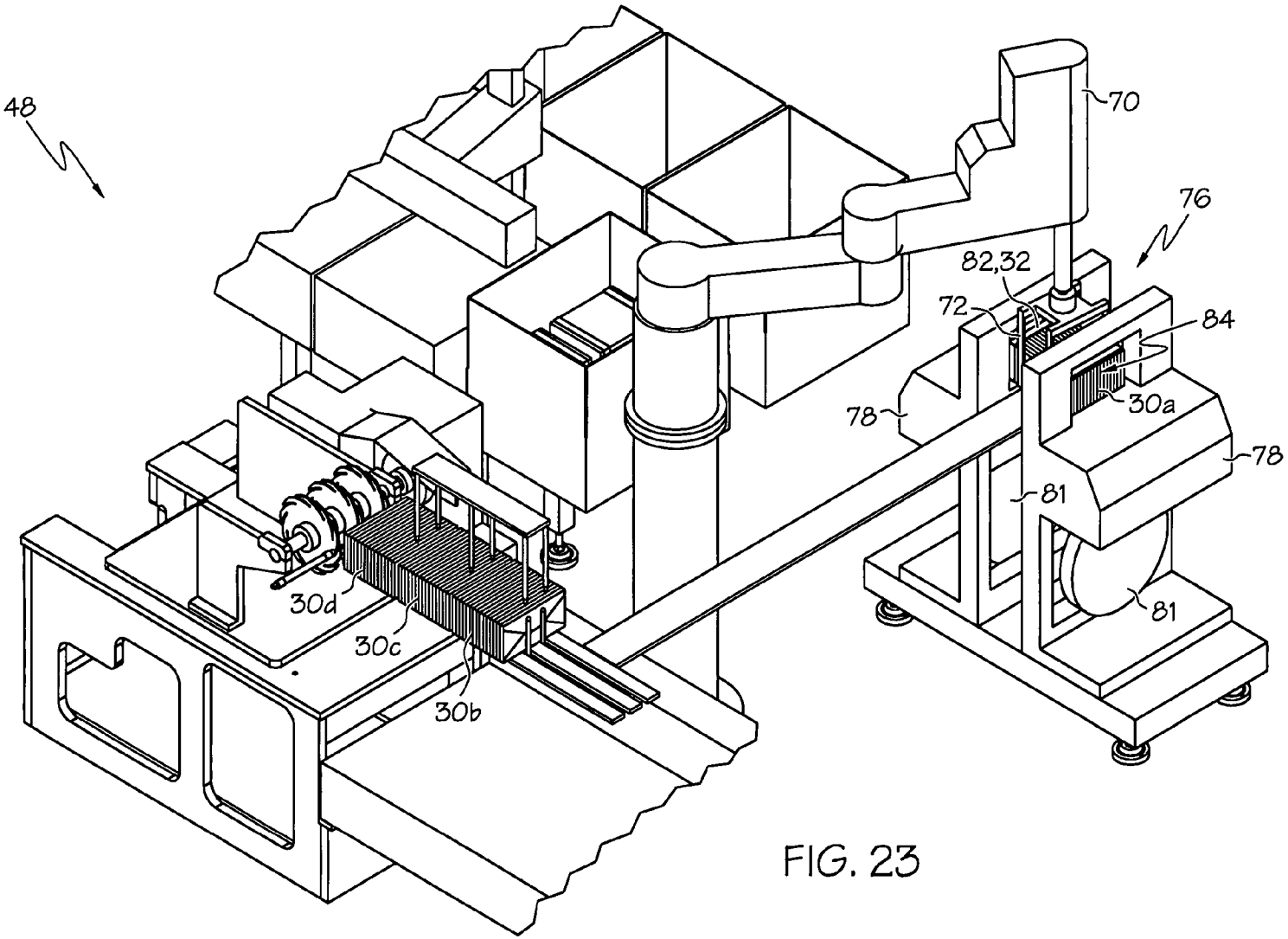

As shown in FIG. 23, the banding portions 78 are then moved towards each other until the outer edges of the stack of envelopes 30*a* are located in the banding opening 84 of each banding portion 78. The bands of banding material 82 are then tightened down or wrapped around the outer edges of the stack of envelopes 30*a*. The bands 82 are then cut and adhered to themselves to form the bands 32 around the stack of envelopes 30*a* to retain the envelopes 10 in the desired state of compression.

Thus, the banding device 76 wraps the bands 32 around the envelope stack 30*a*, cuts the bands 32 to the proper length, grips each end of the band 32 and adheres, bonds or otherwise couples the ends of the bands together. The banding device 76 thereby mechanically or automatically forms the band 32 around the compressed stack, as opposed to manual application of the band 32. The banding device 76 may be a Zeta 144-01 bander sold by Palamides GMBH of Renningen, Germany, or a B40 bander sold by Band-All Vekamo V.D. of Holland, or a US-2000 bander sold by Automatic Taping Systems AG of Zug, Switzerland, or any of a variety of other banding machines. The band ends 32 can be coupled together in various manners, such as heat, ultrasonic welding, gluing or adhesive, or the like. If the banding material 82 has markings 31 located thereon, the markings may be printed during or immediately prior to the banding process. Alternately, the banding material 82 may be preprinted with the desired markings.

As indicated above, the left 72 and right 74 paddles may be utilized to compress and grip the envelope stack 30*a*. However, if desired, other methods may be utilized to compress the envelope stack 30*a*, for example simply compressing the envelope stack 30*a* between a set of plates, or routing the envelope stack 30*a* between a pair of converging walls. In addition, the banding device 76 may be able to compress the stack of envelopes 30*a* while applying the bands 32.

The banding device 76 may not necessarily apply both bands 32 simultaneously. For example, a banding device 76 having only a single banding portion 78 may be utilized, in which case the stack of envelopes 30*a* or the banding device 76 can be rotated to apply a band 32 to both ends of the envelope stack 30*a*. Of course, if only a single band 32 is applied to the stack of envelopes 30*a* (i.e. as shown in the embodiment of FIG. 5) then a banding device 76 with only a single banding portion 78 need be utilized.

Figure 24:
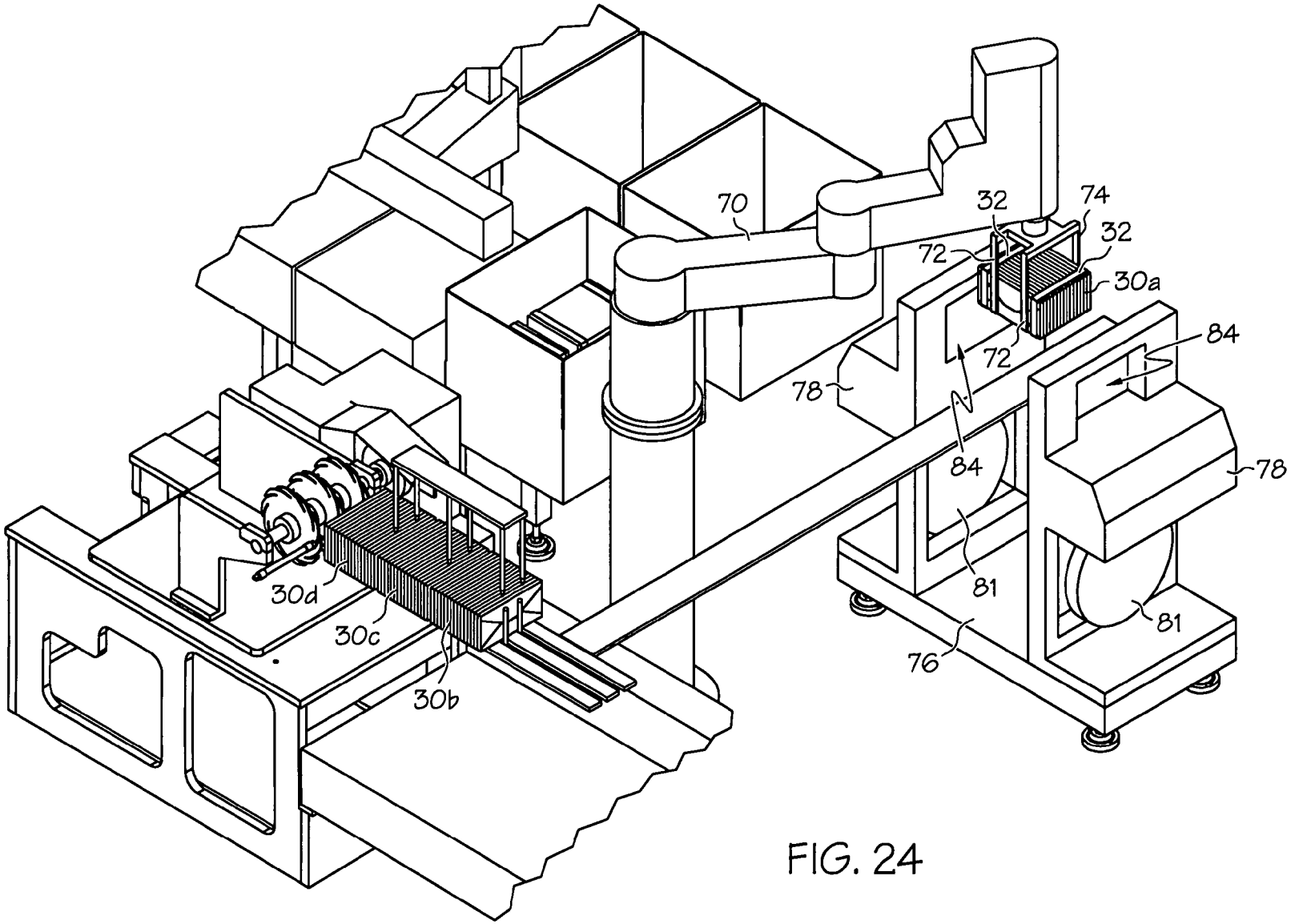
Figure 25:
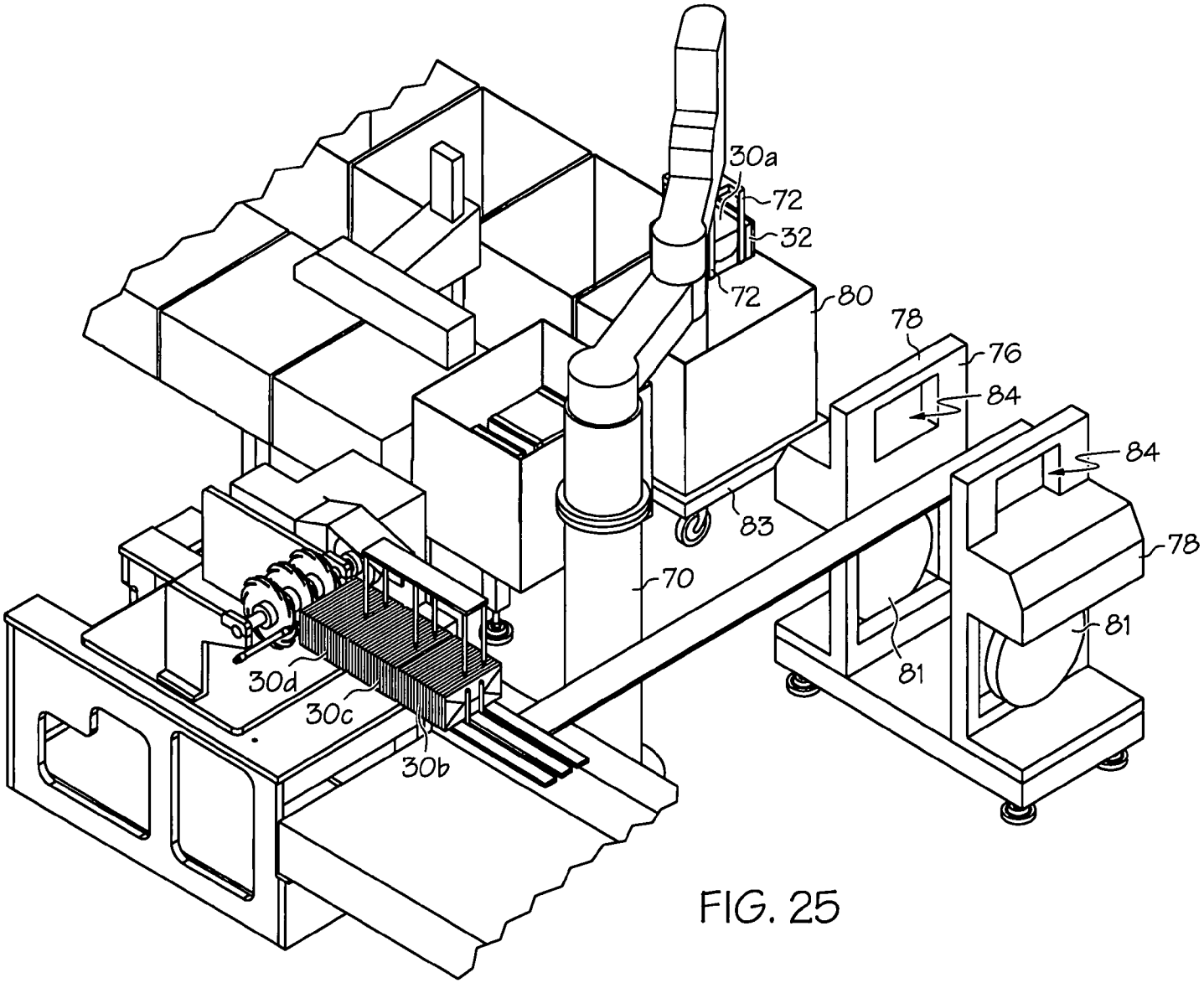

After the bands 32 are securely applied to the envelope stack 30*a*, the banding portions 78 of the banding device 76 move away from each other, as shown in FIG. 24, and the robot arm 70 lifts the banded stack of envelopes 30*a* out of and away from the banding device 76. The robot arm 70 can then place the banded stack of envelopes 30*a* in a shipping container, storage container, conveyor belt, or other machine or device for further processing. In the embodiment shown in FIG. 25, the stack of banded envelopes 30*a* is located in a box 80 for subsequent shipping. The box 80 can be quite large, and may have a footprint that is about 3'×3' or about 4'×4' to provide for a large storage volume. This footprint is about sixteen times larger than the boxes 22 of FIG. 2A, and about eight times larger than the footprint of the boxes 26 of FIG. 2B.

Although not necessarily shown in FIGS. 20-25, as the stack of envelopes 30*a* is banded and placed for packaging by the robot arm 70, the support table 52 may continue to fill with new stacks of envelopes 30 and the stacks of envelopes 30 on the table 52 can be moved downstream for subsequent gripping and banding. The robot arm 70 then lifts the newly-created stacks 30 away from the support table 52 for banding. By lifting and moving the stacks of envelopes 30 away from the support table 52, a time buffer between the continuous flow of envelopes 10/envelope packages 30 on the support table 52 and the banding process (which is an intermittent motion) is created. For example, FIG. 6 schematically illustrates the package formation, compression and banding step. However, if desired, the banding process may be an in-line process in which bands are applied to the sets of envelopes 30 as they are fed onto the support table 52.

In addition, FIGS. 7-25 illustrate a system wherein a single robot arm 70 carries the stacks of envelopes 30 to the banding device 76, and then places the banded stacks 30 into a box 80. However, if desired two robot arms may be utilized. In particular, a first robot arm may lift the newly-created stacks 30 off of the support table 52, and transport them to the banding device 76 where they are banded. The first robot arm may then place the banded envelope stacks in a temporary storage location. A second robot arm or other loading device may then transport the banded envelope stacks from the temporary storage location into a box 80 or other storage location. This method of loading and banding (i.e. in two discreet steps) provides an addition time buffer and may allow for quicker processing.

Besides placing the banded envelope stacks 30 in the boxes 80, the banded envelope stacks 30 may be placed into chipboard containers, corrugated cardboard containers, plastic shipping containers or stacking trays. When the banded envelopes 30 are placed into large, collapsible/recyclable stacking trays, the stacking trays can then be shipped to the customers for use. Once the envelopes 10 are consumed, the stacking trays can be folded and returned to the envelope manufacturer for reuse. In this case, the only waste (i.e., packaging) product from the customer's viewpoint is the bands 32 around each envelope stack 30. This provides a significant decrease in waste compared to various boxes or other wrapping materials in which prior art envelopes may be packaged. If desired, the boxes 80 or other storage containers may be located on a wheeled dolly 83 (see FIG. 25). The wheeled dolly 83 allows the box 80 to be easily moved about the floor of the manufacturing or assembly plant. The boxes 80 can also be loaded in the manner shown in FIGS. 65 and 66 and described in detail below.

Figure 26:
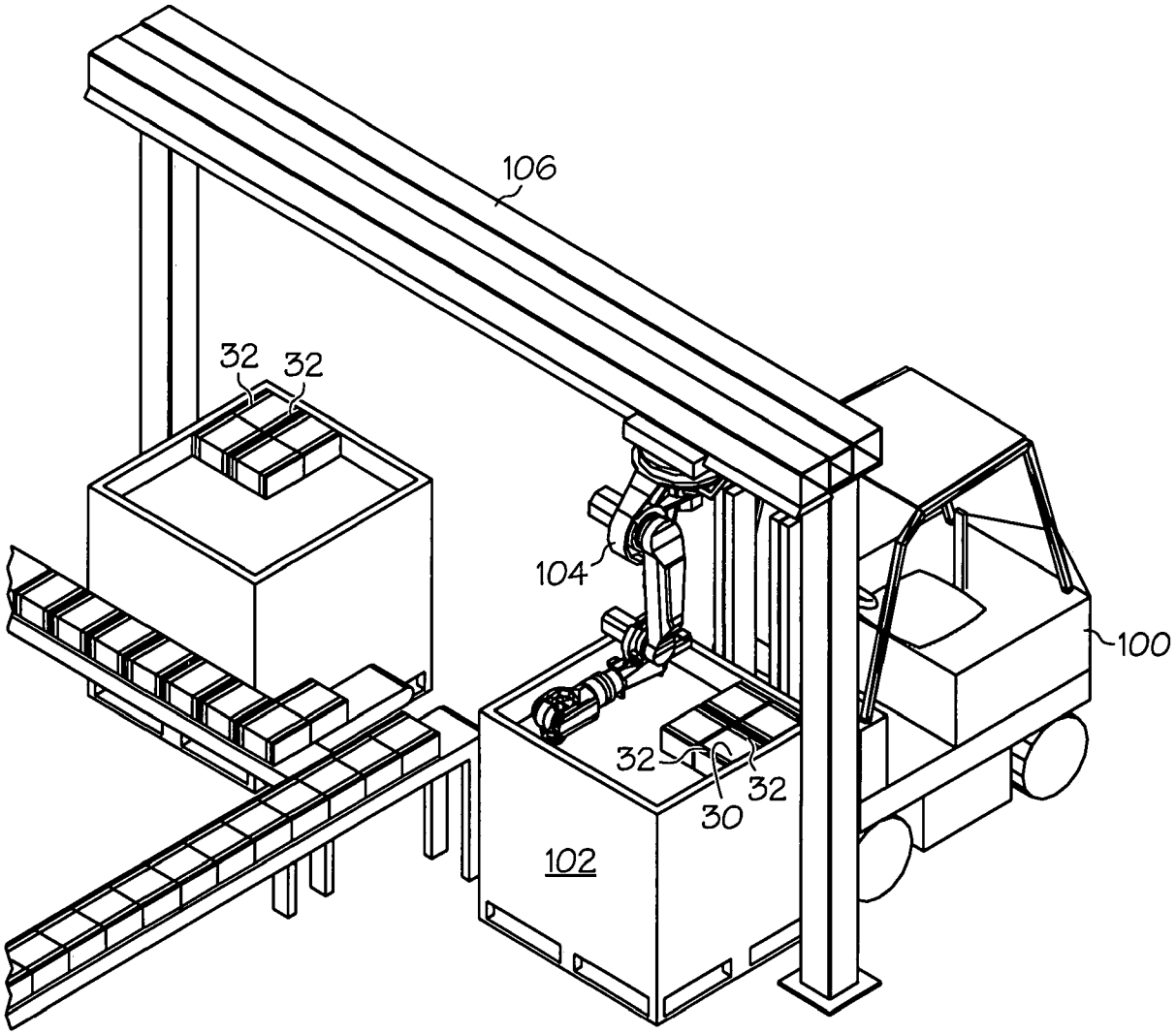
FIGS. 26-33 are a series of front perspective schematic views illustrating a method for loading packaged envelopes into an envelope inserting machine.

FIGS. 26-33 illustrate a series of steps showing one manner in which the banded envelope stacks 30 may be processed by a customer of the envelope stacks 30, such as a commercial envelope processor, and how the banded stacks 30 can be utilized with envelope inserting machinery. As shown in FIG. 26, a forklift or other vehicle 100 carries a container or tray 102 with a stack of banded envelopes 30 located therein. This tray 102 could have been loaded with envelope packages 30 in the manner shown in FIGS. 24 and 25 (and/or FIGS. 65 and 66), and then shipped to the end user who will process/stuff the envelopes. The forklift 100 positions the container 102 under a robot arm 104. The robot arm 104 is movable into various configurations, and is slidable or translatable along an overhead beam 106.

Figure 27:
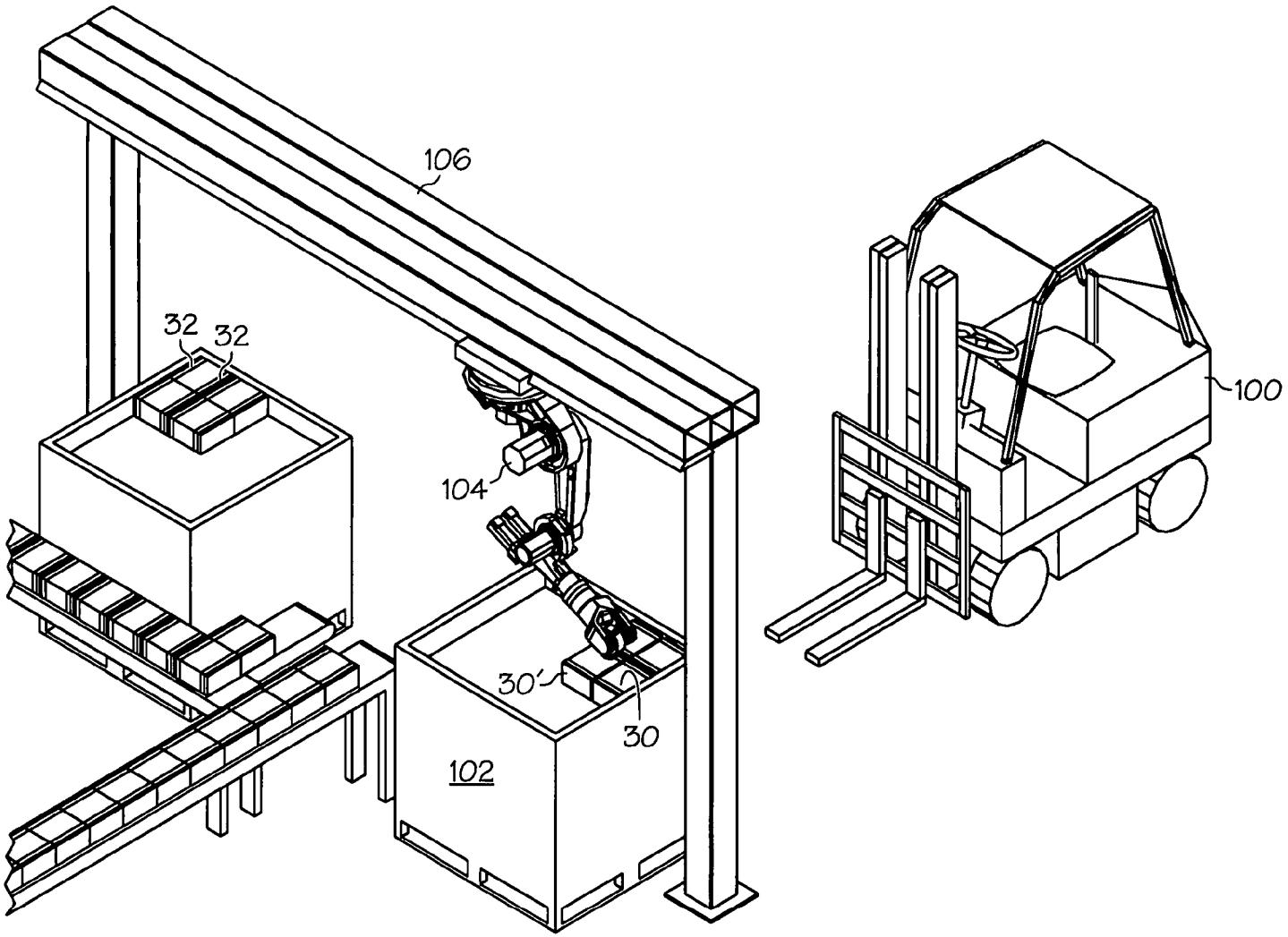
Figure 28:
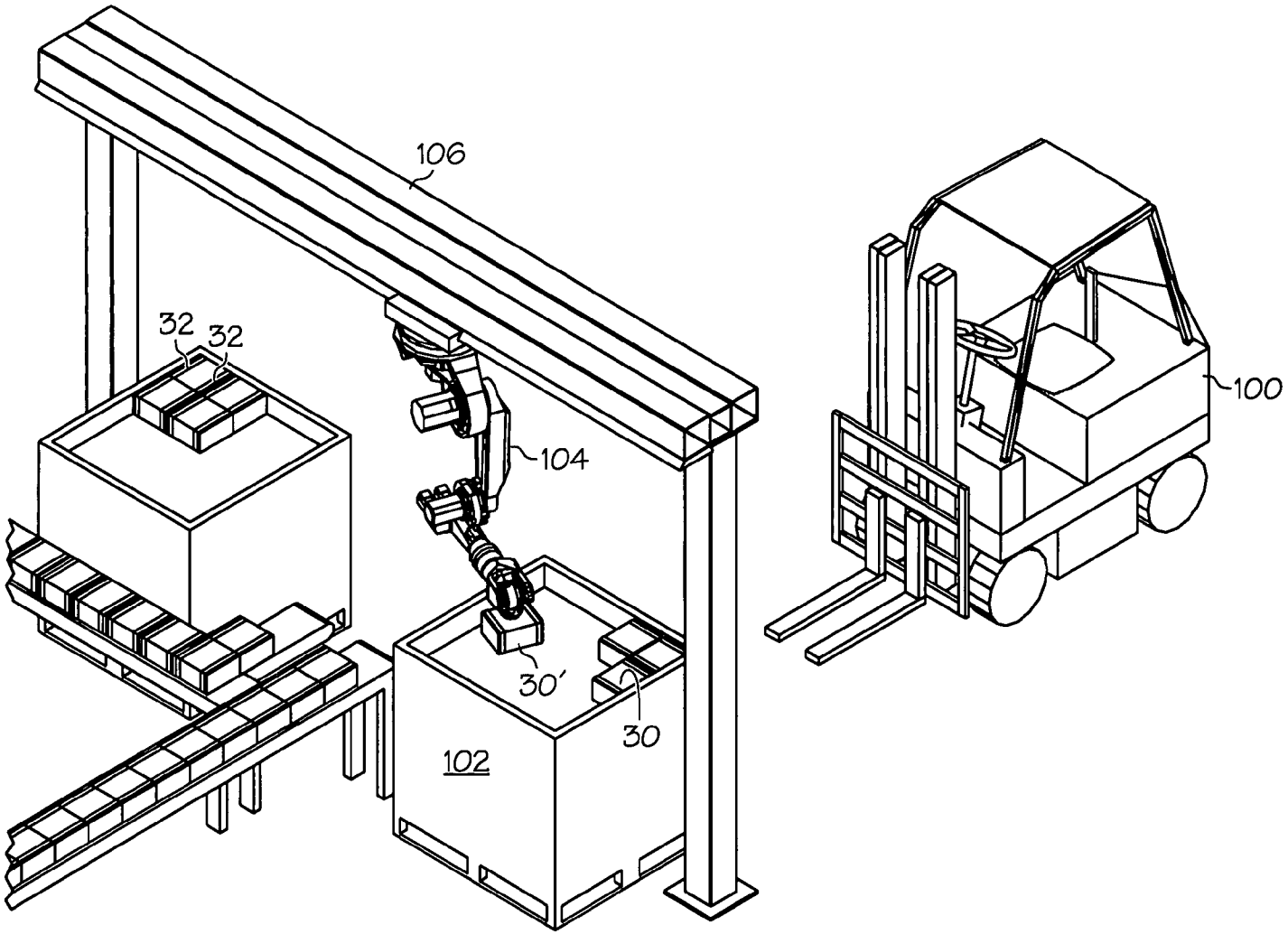

As shown in FIG. 27, once the forklift 100 has loaded the container 102 in the appropriate location, the forklift 100 is backed away from the container 102 and the robot arm 104. The robot arm 104 is then activated and moved until it is located above an envelope stack 30' to be lifted. Next, as shown in FIG. 28, the robot arm 104 grips and lifts the envelope stack 30'. The robot arm 104 may have various gripping/lifting means for gripping and lifting the envelope stack 30'. However, in one embodiment, the robot arm 104 includes a plurality of vacuum suction cups located thereon (not shown) which engage the band 32 or bands 32 of the stack of envelopes 30' to allow the robot arm 104 to grip and lift the stack of envelopes 30'.

Figure 29:
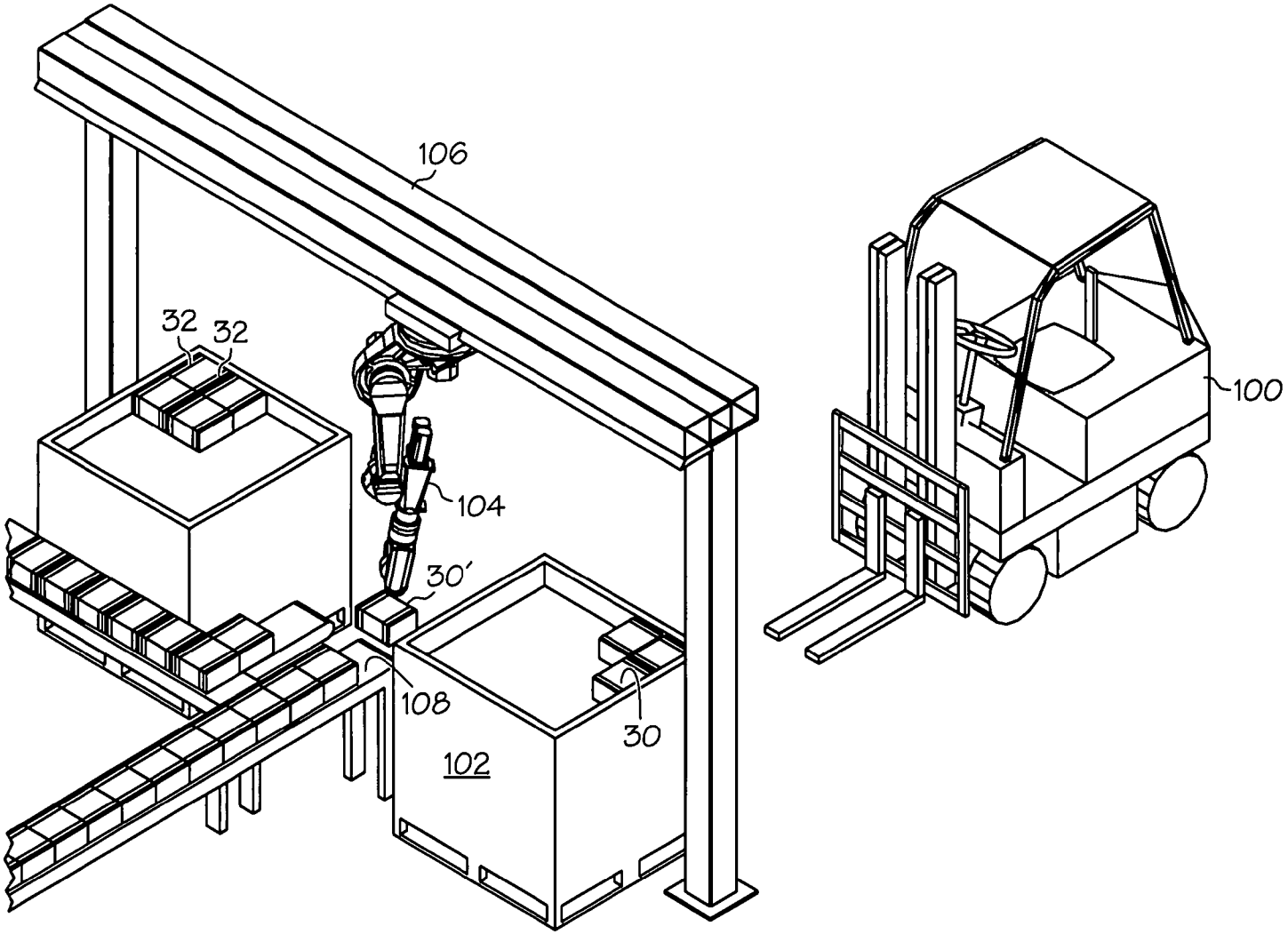
Figure 30:
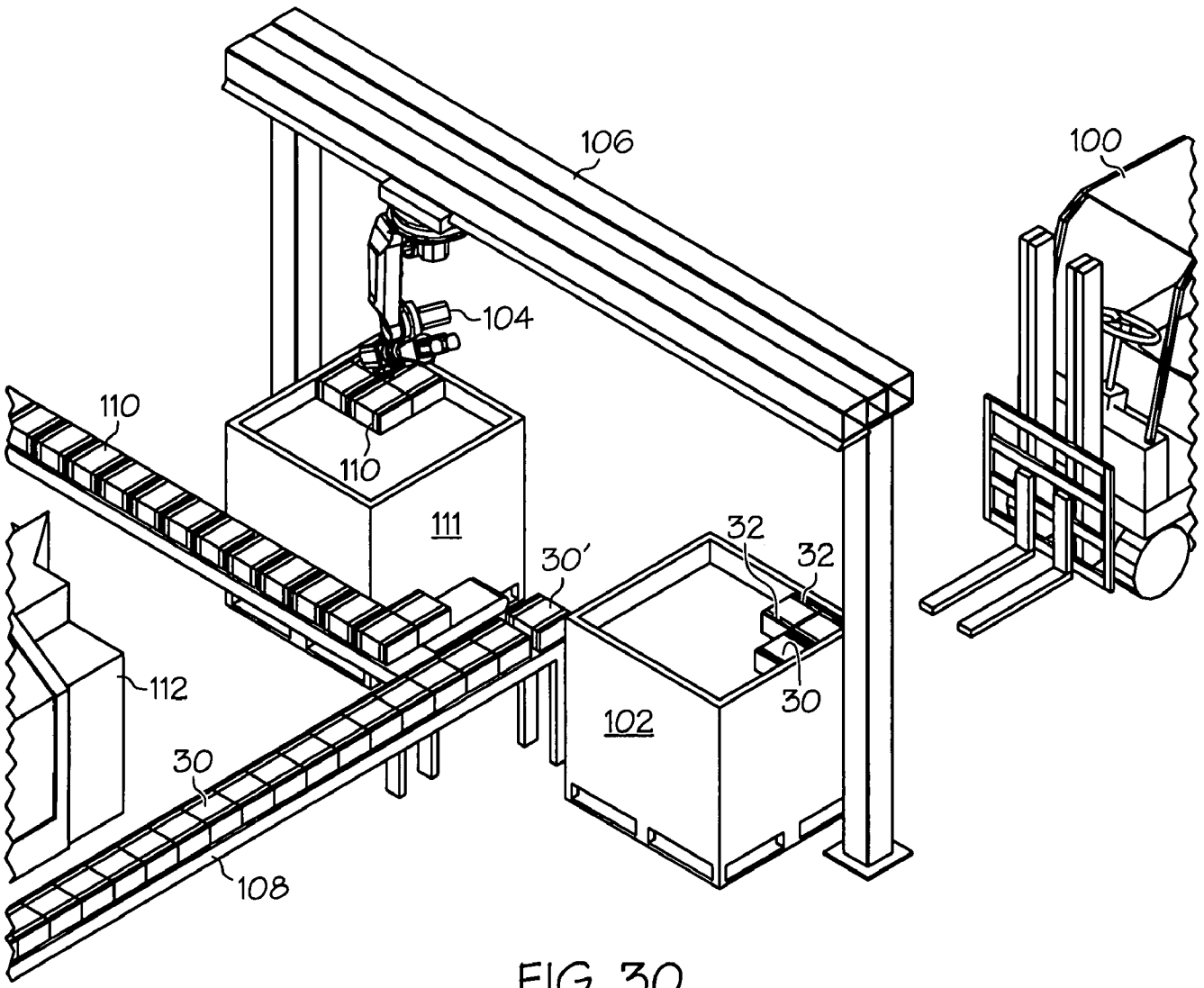
Figure 31:
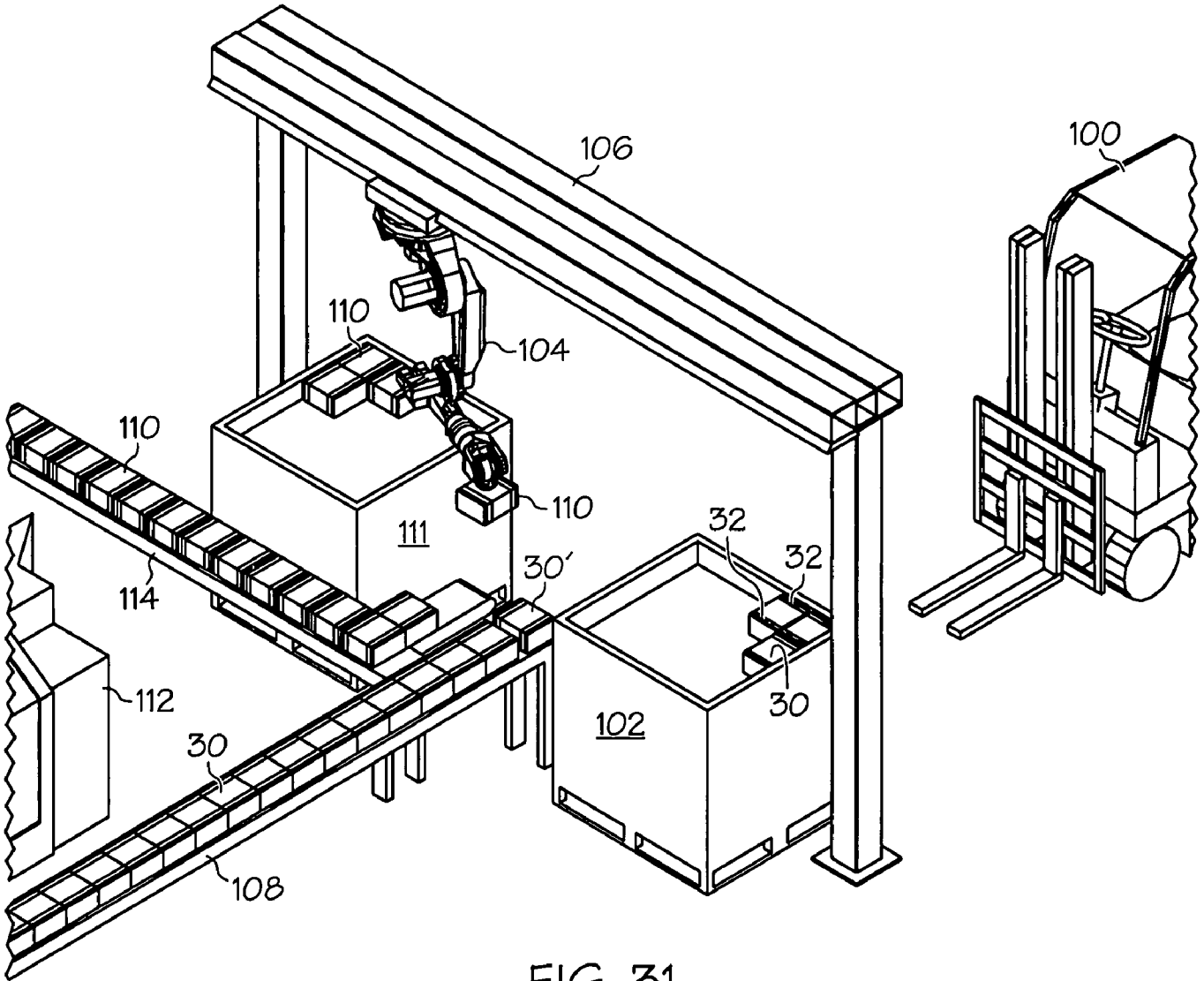

Next, as shown in FIG. 29 the stack of envelopes 30' is positioned above a conveyor table 108. The arm 104 then positions the stack of envelopes 30' on the conveyor table 108 and releases the stack of envelopes 30' at the end of the conveyor table 108, as shown in FIG. 30. The conveyor table 108 feeds the stack of envelopes 30 located thereon in a downstream direction for processing by the envelope inserting machine 112. Alternately, the robot arm 104 can place envelope stacks 30 onto a tray (not shown) which can hold multiple stacks 30 (i.e. three-five stacks). This tray can then be transported, via conveyer or chain-belt systems, to an inserting machine. The robot arm 104 may then return to the container 102 to continue loading envelopes stacks 30 onto the conveyor table 108/tray as desired.

In many envelope inserting machines, an outer or carrier envelope receives an inner or return envelope therein. In one embodiment of the present invention, the outer and inner envelopes are both packaged in (separate) banded packages. Accordingly, in FIG. 30 the outer banded envelopes are shown as envelope stacks 30 and the inner banded envelopes are shown as envelope stacks 110 stored within a container or tray 111.

Figure 32:
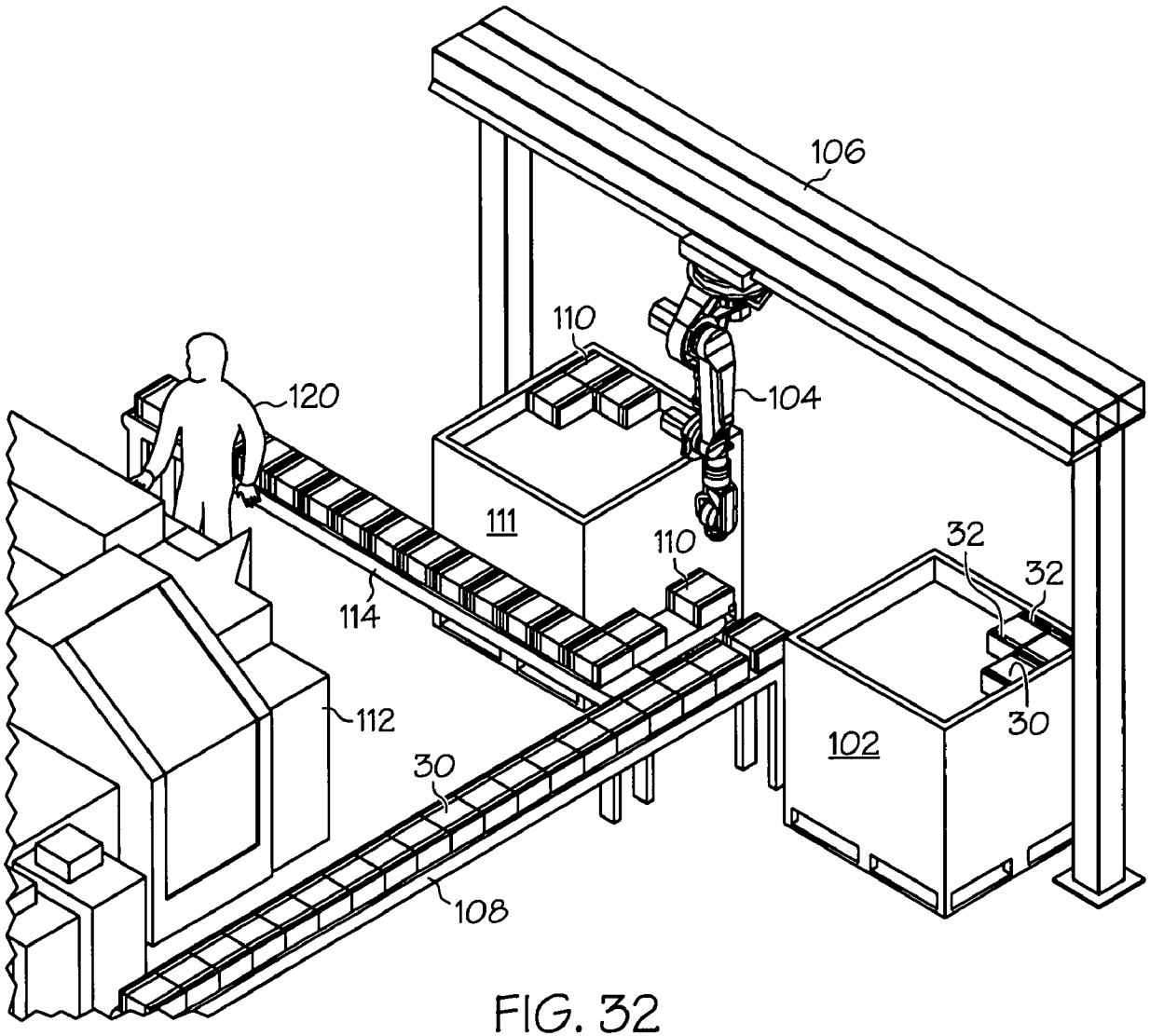
Figure 33:
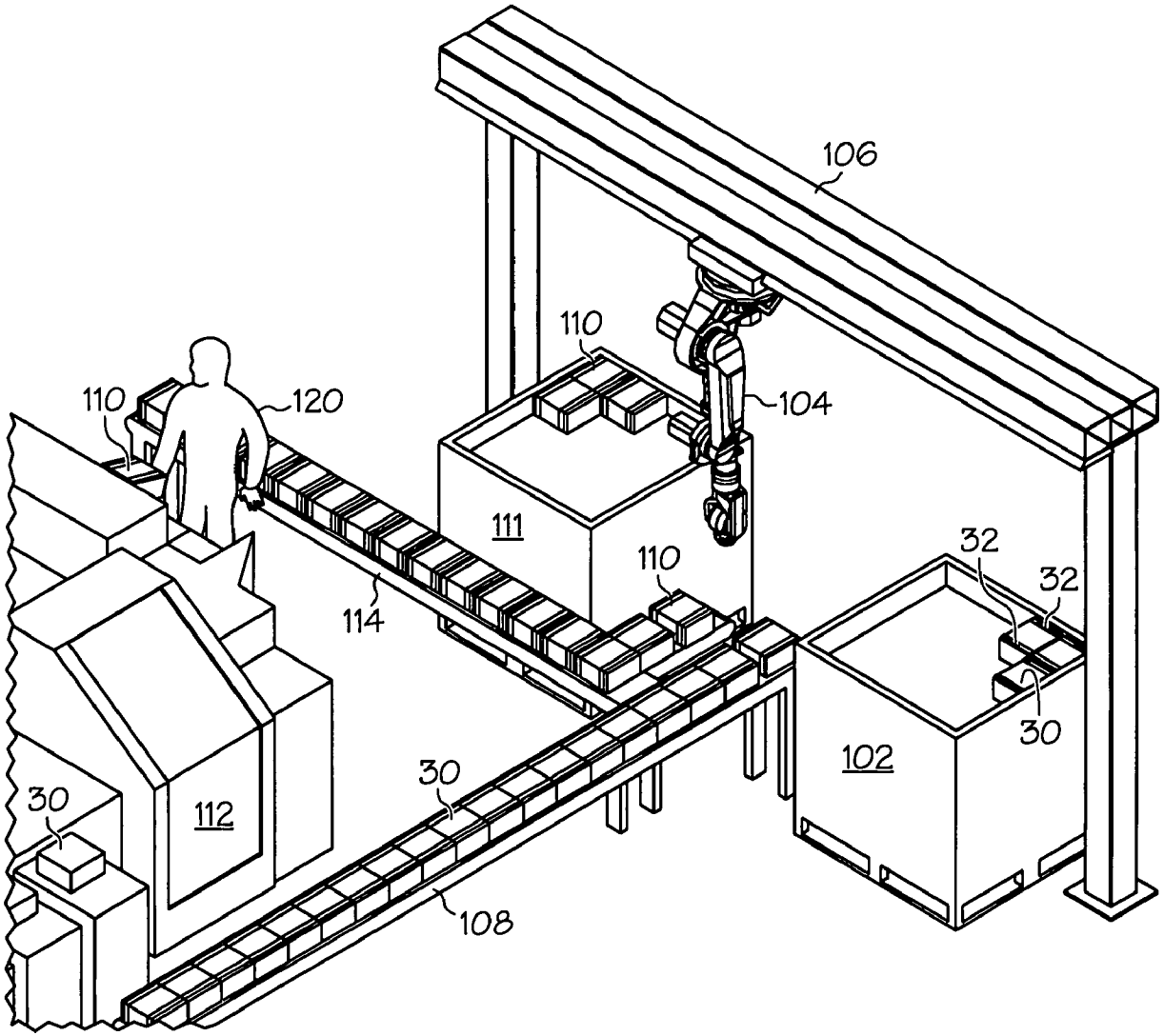

Accordingly, the robot arm 104 may be utilized to lift a banded stack of inner envelopes 110 (FIG. 31) out of the container 111 and to place the lifted stack of envelopes 110 on the inner envelope conveyor table 114 (FIG. 32). Next, as shown in FIG. 33, an operator 120 can lift a stack of envelopes 110 off the end of the inner envelope conveyor table 114, remove the bands 32 and place the stack of envelopes 110 in or on the envelope inserting machine 112 for further processing. The inner envelope conveyor table 114 can then be activated to move or index the stacks of inner envelopes 110 downstream to replace the removed stack of envelopes 110.

The operator 120 may also move to the downstream end of the envelope conveyor table 108 and remove envelope stacks 30 therefrom, remove the bands 32 and insert the envelope stacks 30 in or on the envelope inserting machinery 112. The envelope conveyor table 108 can then be activated to move the stack of envelopes 30 downstream or alternately the conveyor tables 108, 114 may move constantly to replenish the removed envelope stacks. In this manner, the robot arm 104 can automatically lift stacks of envelopes 30, 110 out of the associated containers 102, 111 to constantly replenish the stack of envelopes on the conveyor tables 108, 114.

The system of FIGS. 26-33 may be considered to be semi-automated in that an operator removes the bands 32 and actually places the envelopes on or into the envelope inserting machine 112. Alternately, the system of FIGS. 26-33 may be fully automated and may not require the use of an operator 120. In this case the conveyer tables 108, 114 may feed their envelope stacks directly into the envelope inserting machinery. However in this scenario the bands 32 will need to be removed. Thus the bands 32 could be removed by the robot arm 104, or by some other mechanism while the envelope stacks 30 are located on the conveyer tables 108, 114, or by the envelope inserting machine 112. Further alternately, the envelope inserting machine 112 may include or be coupled to an envelope input feeding unit. The envelope input feeding unit separates and integrates individual envelopes that were previously banded together into the envelope inserting machine 112.

If desired, the output of the envelope inserting machine 112 (i.e. the processed or inserted envelopes) may also be able to be automatically processed by the robot arm 104, or by another robot arm. For example, the robot arm 104 may be able to lift the stacks of processed or outputted envelopes and insert the processed envelopes into a shipping or storage container.

Figure 34:
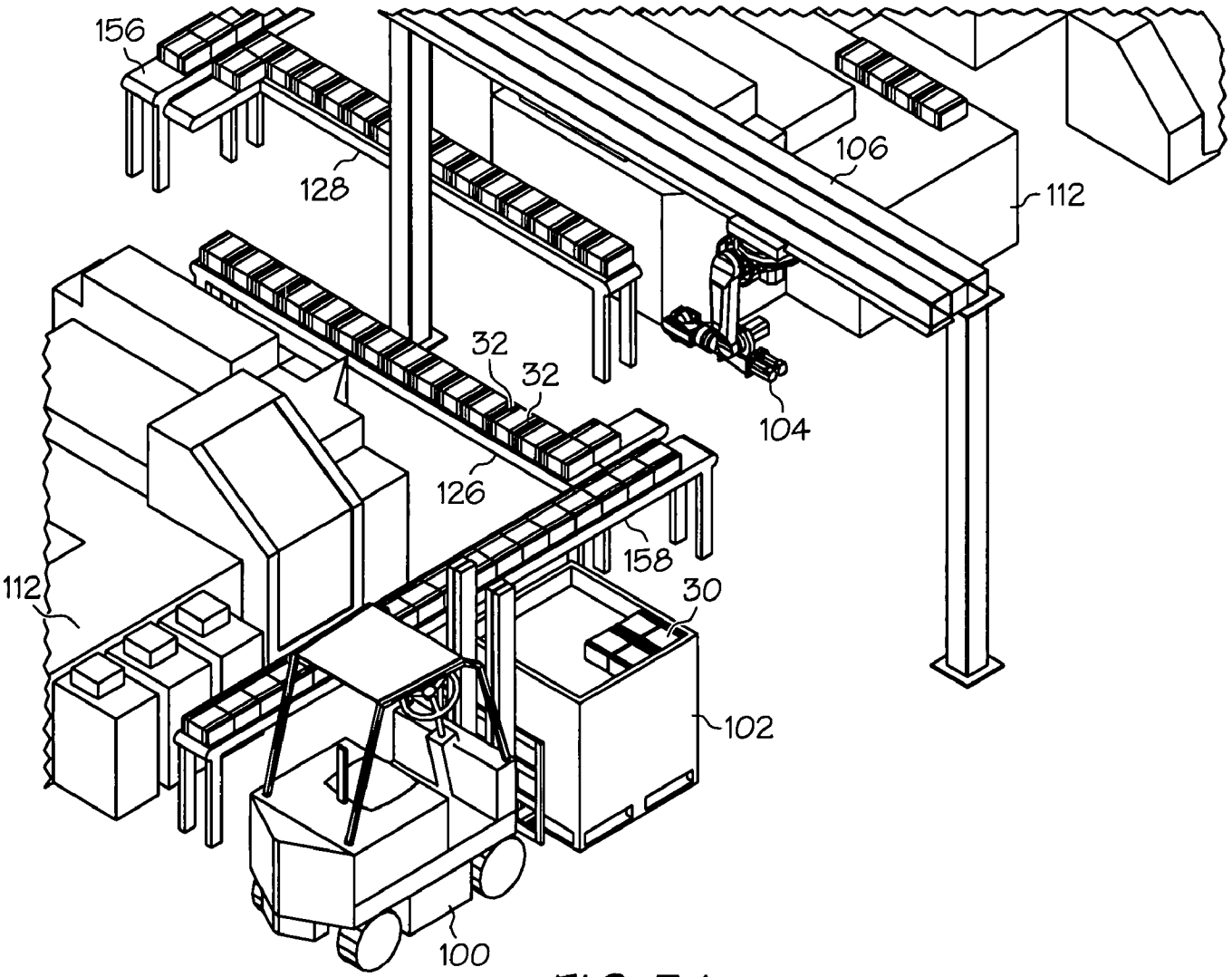
FIGS. 34-48 are a series of front perspective schematic views illustrating a partially automated method for loading packaged envelopes into a plurality of envelope inserting machines.
Figure 35:
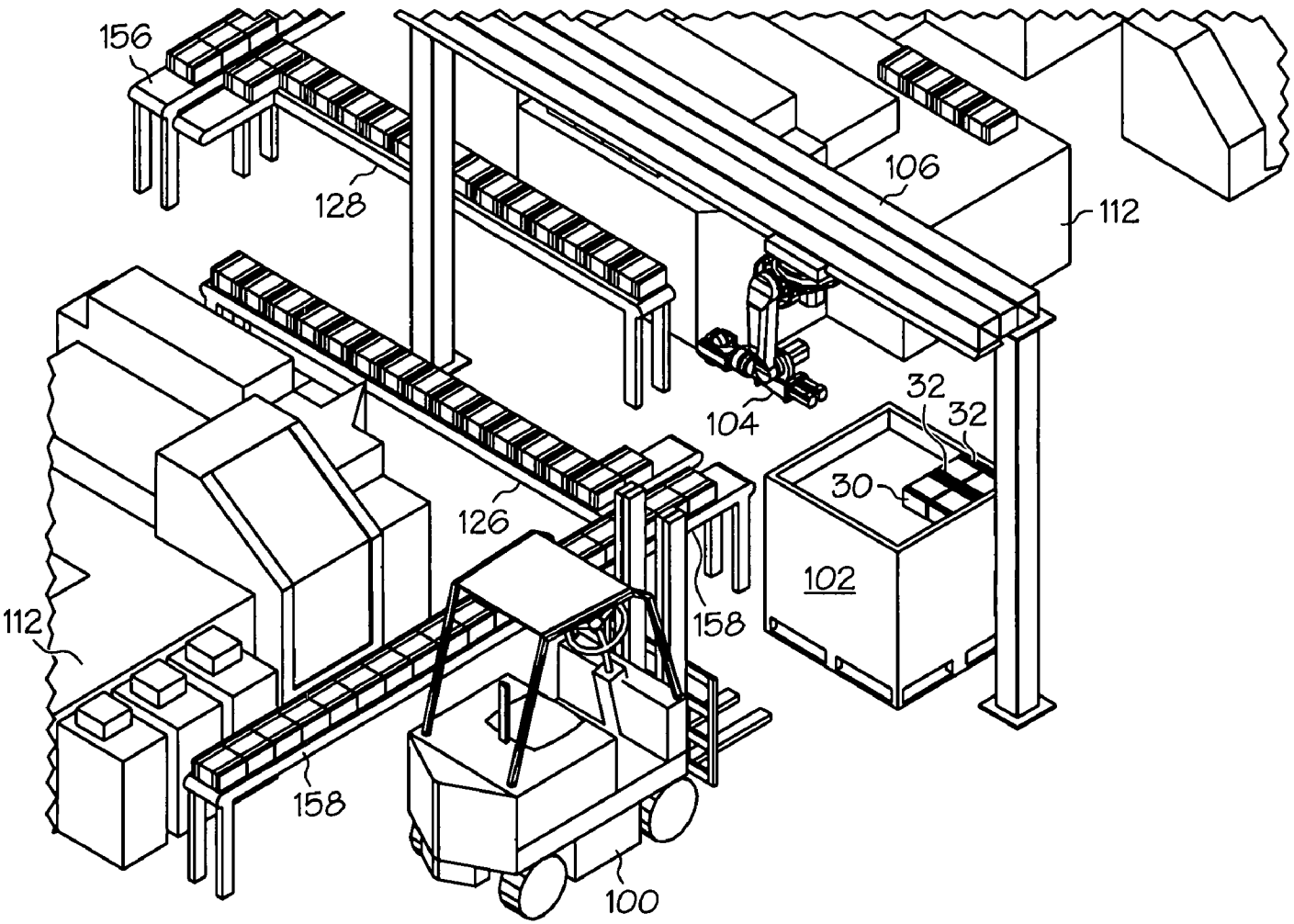

FIGS. 34-48 illustrate an automated loading process utilizing a robot arm 104 that is movable along an overhead beam 106, similar to the system of FIGS. 26-33. In contrast to the system of FIGS. 26-33 (which includes only a single envelope inserting machine 112), the system of FIGS. 34-48 includes four envelope inserting machines 112 (see FIG. 48, although for illustrative purposes FIG. 48 does not illustrate the bands on the envelope stacks). Each envelope inserting machine 112 has two conveyor tables that feed envelopes to be processed into the envelope inserting machines 112. For example, one of the conveyor tables 158 may feed outer envelopes to an envelope inserting machine, and the other conveyor table 126 may feed inner envelopes to be inserted into the outer envelopes (of course various other inserts, besides the inner envelopes, can be stuffed or inserted into the outer envelopes). As shown in FIG. 34, a forklift 100 carries a container 102 full of stacks of envelopes 30 and positions the container 102 (FIG. 35) adjacent to the support beam 106/robot arm 104.

Figure 36:
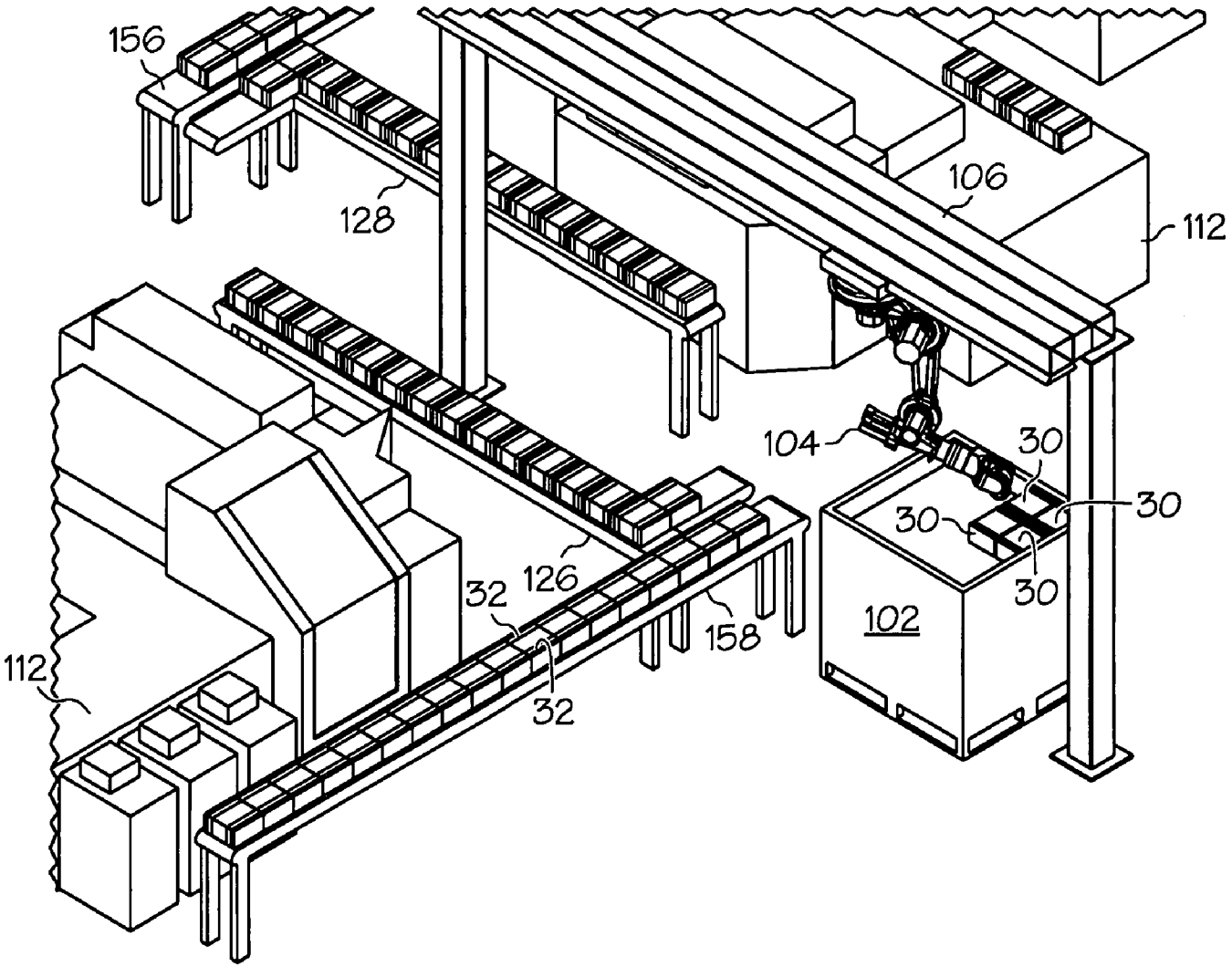
Figure 37:
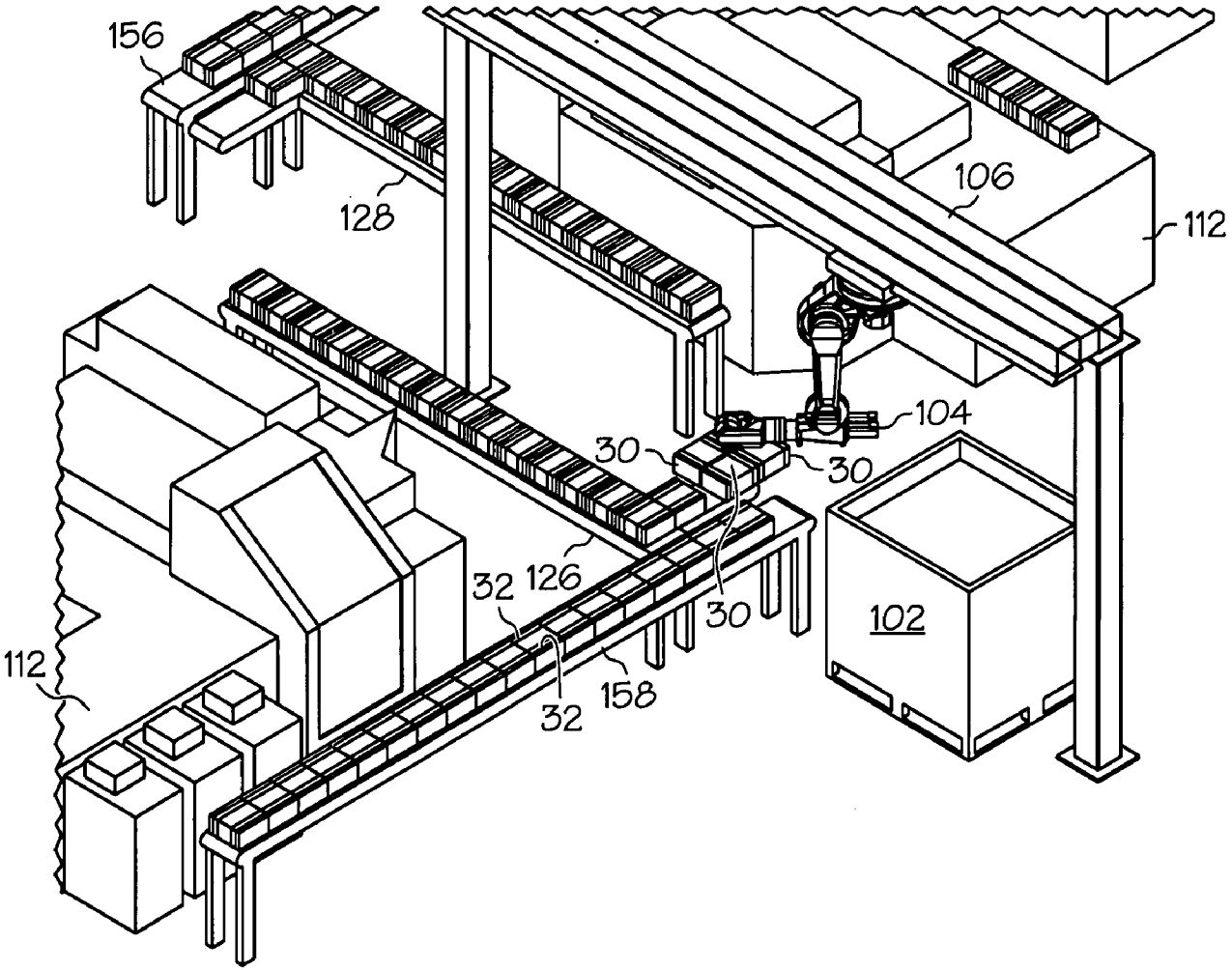

As shown in FIG. 36, the robot arm 104 then positions itself over the stacks of envelopes 30. As shown in FIG. 37, the robot arm 104 then lifts four packages of envelopes 30. The robot arm 104 includes various suction cup devices (not shown) to lift any desired number of envelope packages 30. Accordingly, in the embodiment illustrated in FIG. 37, the robot arm 104 includes a relatively high number of suction cups to grip and lift the four envelope packages 30.

Figure 38:
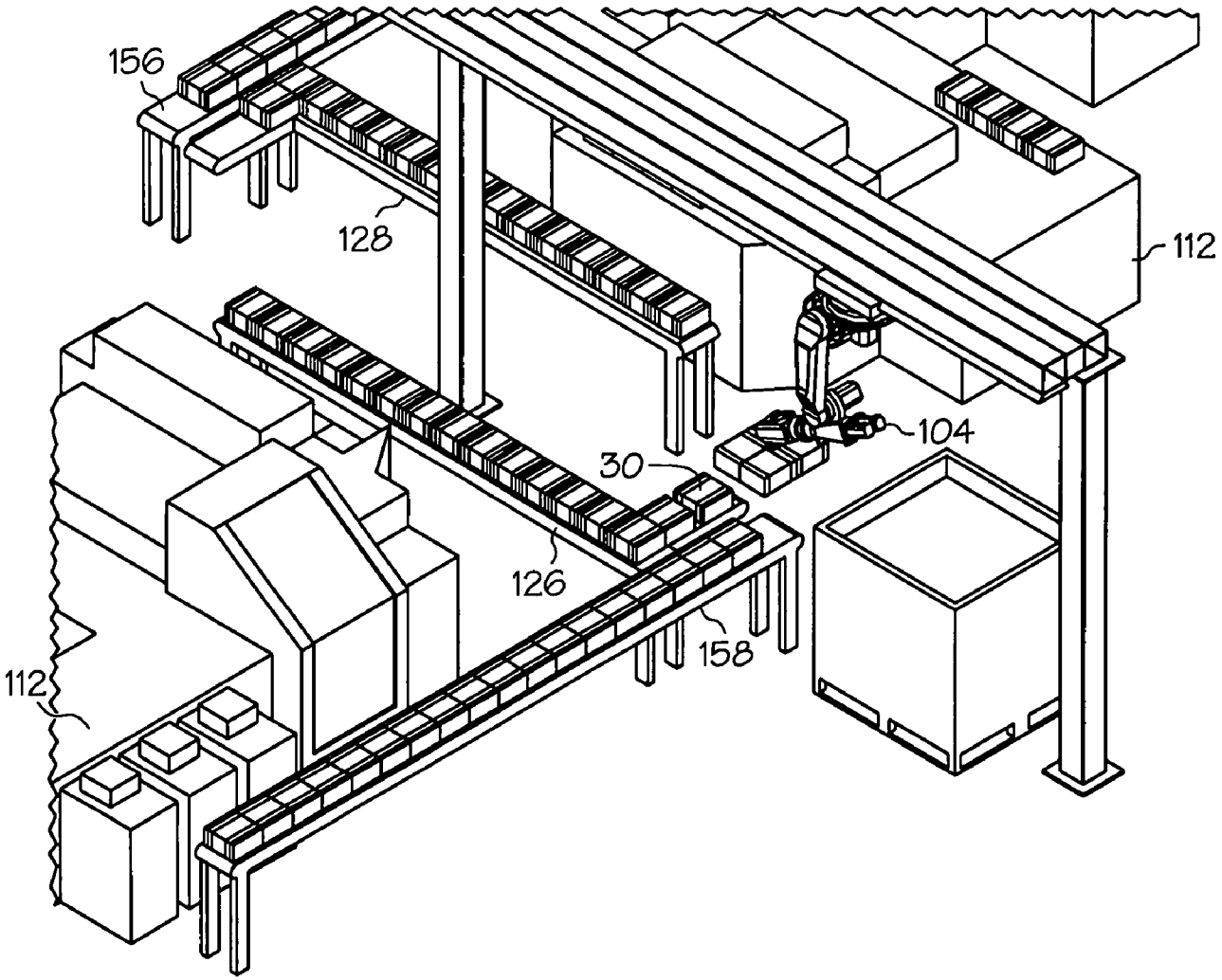
Figure 39:
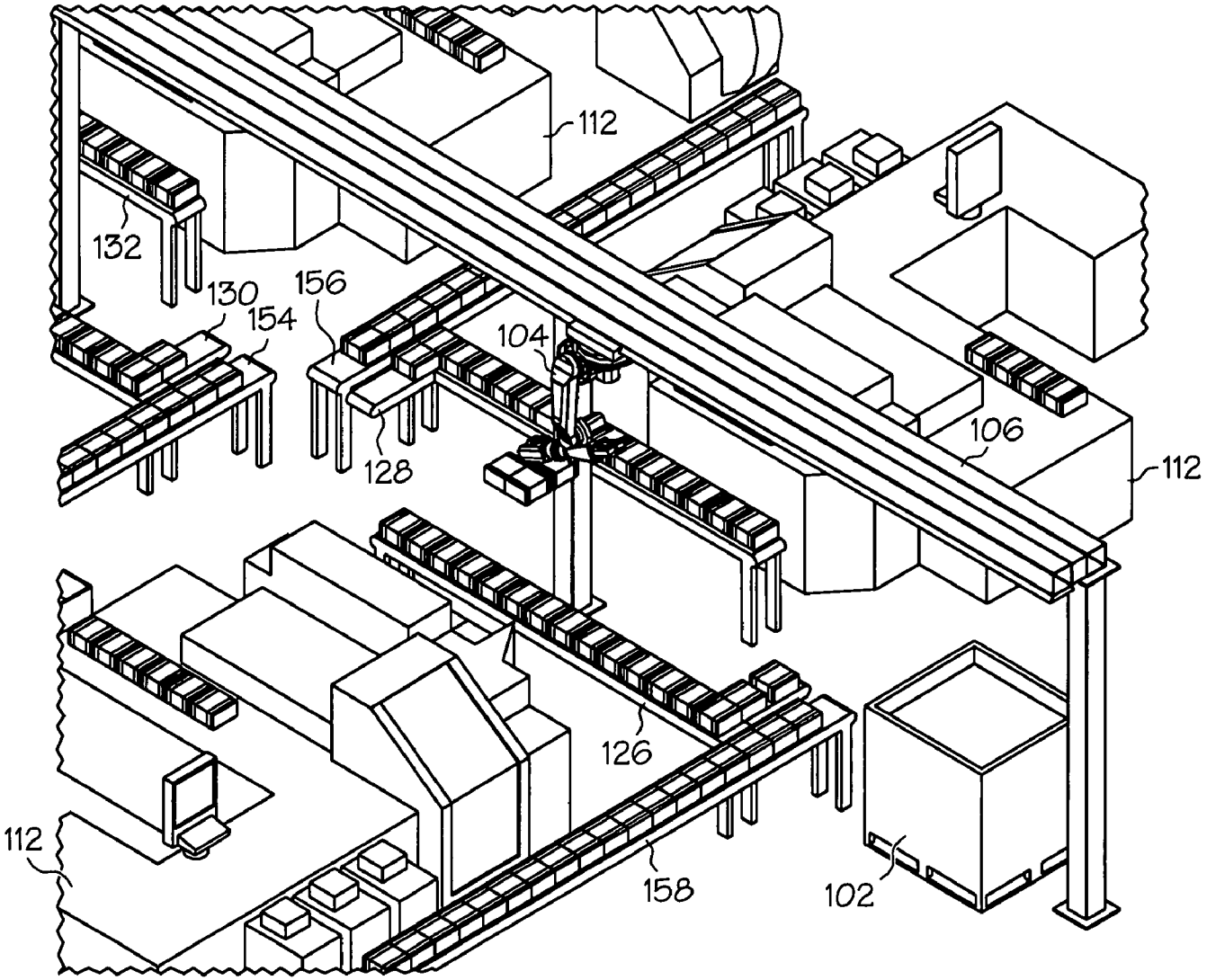
Figure 40:
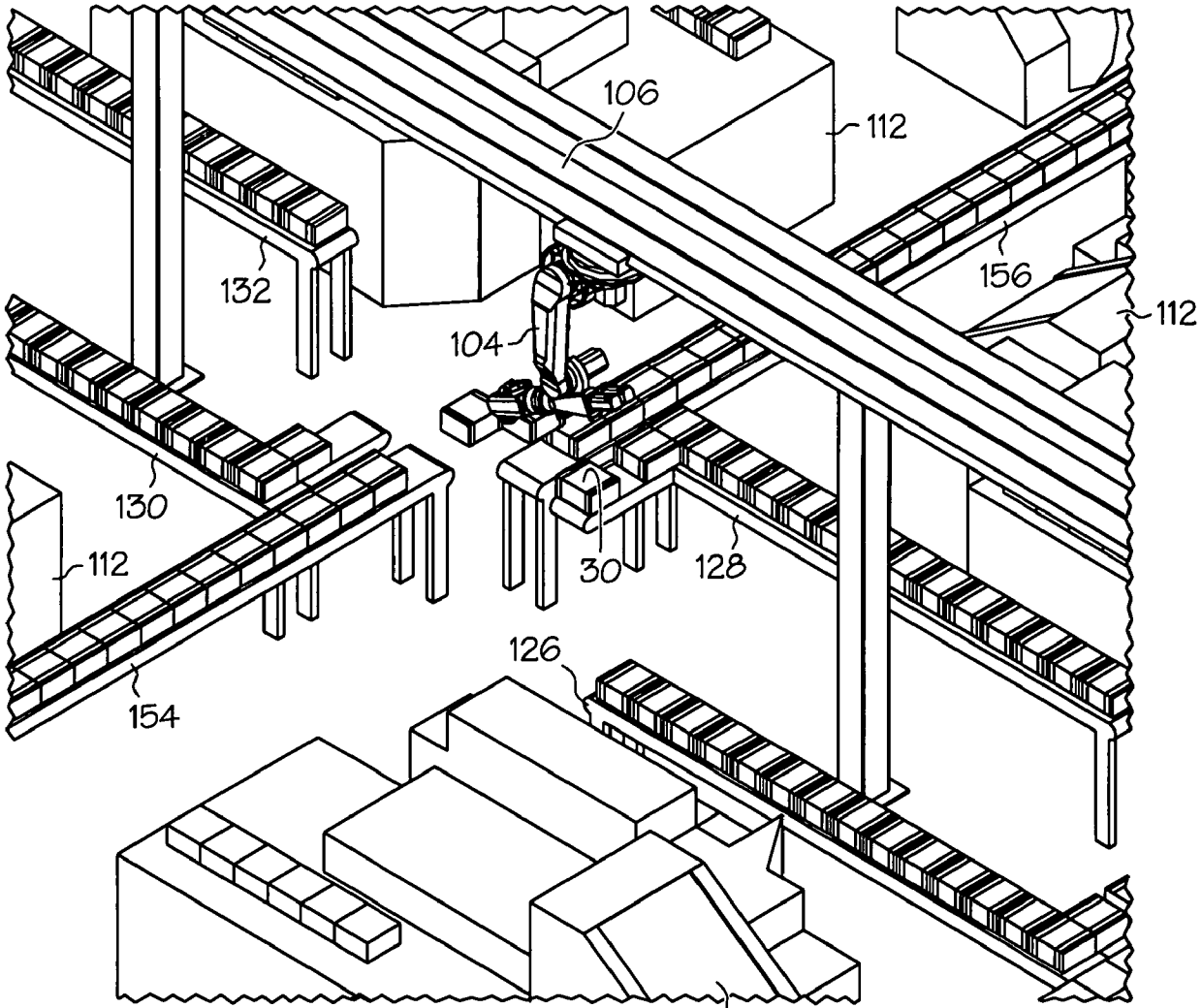
Figure 41:
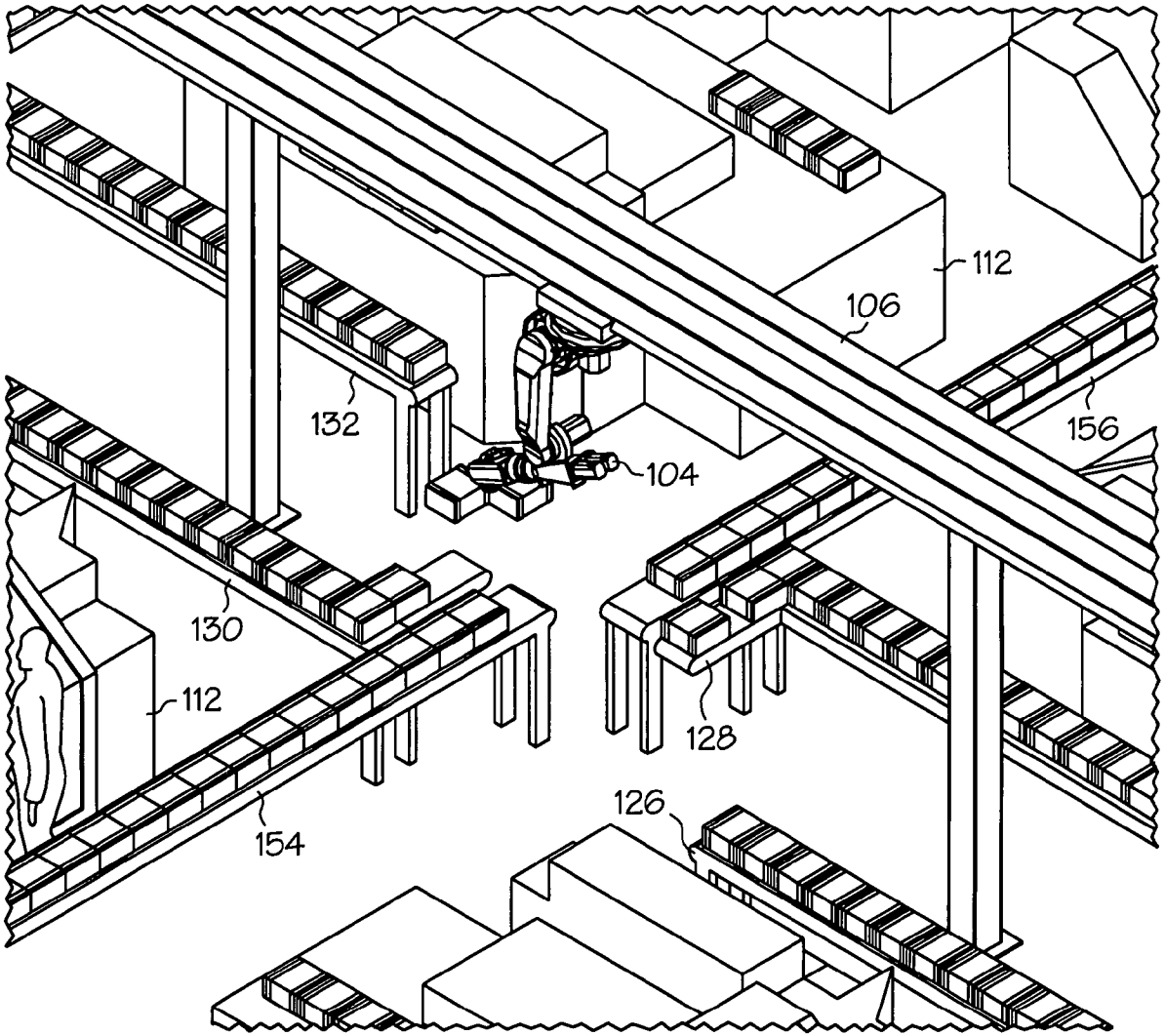
Figure 42:
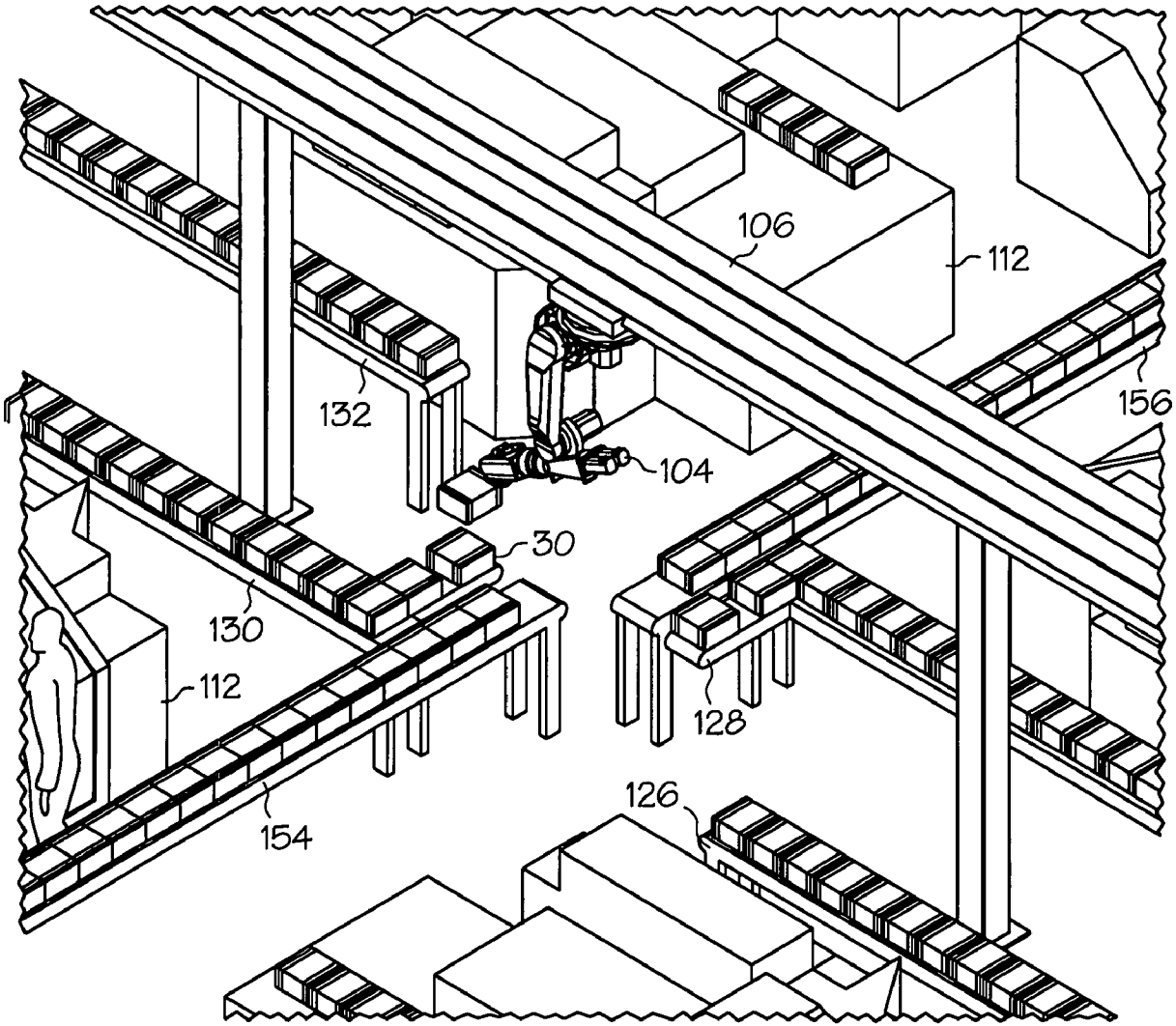
Figure 43:
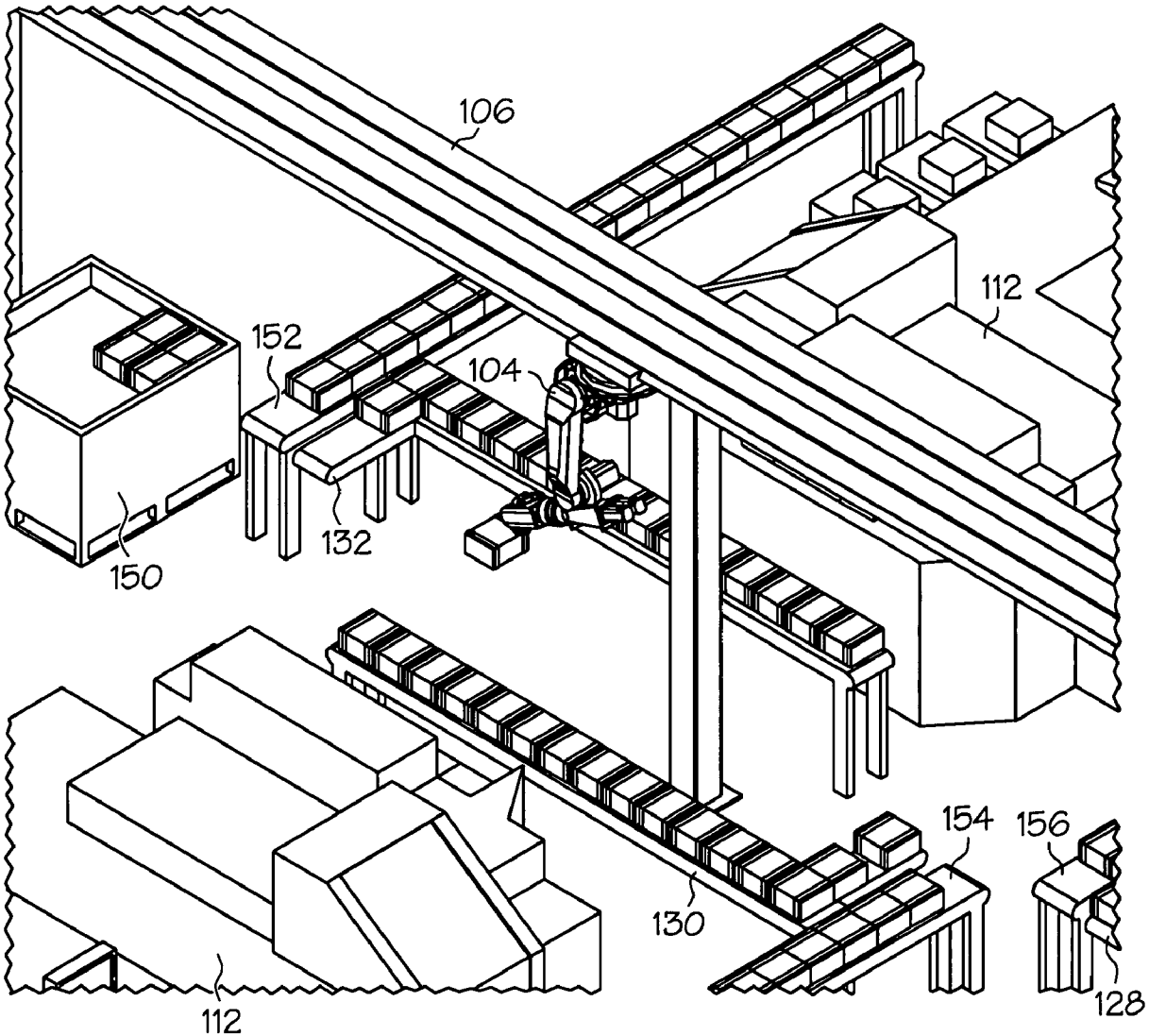
Figure 44:
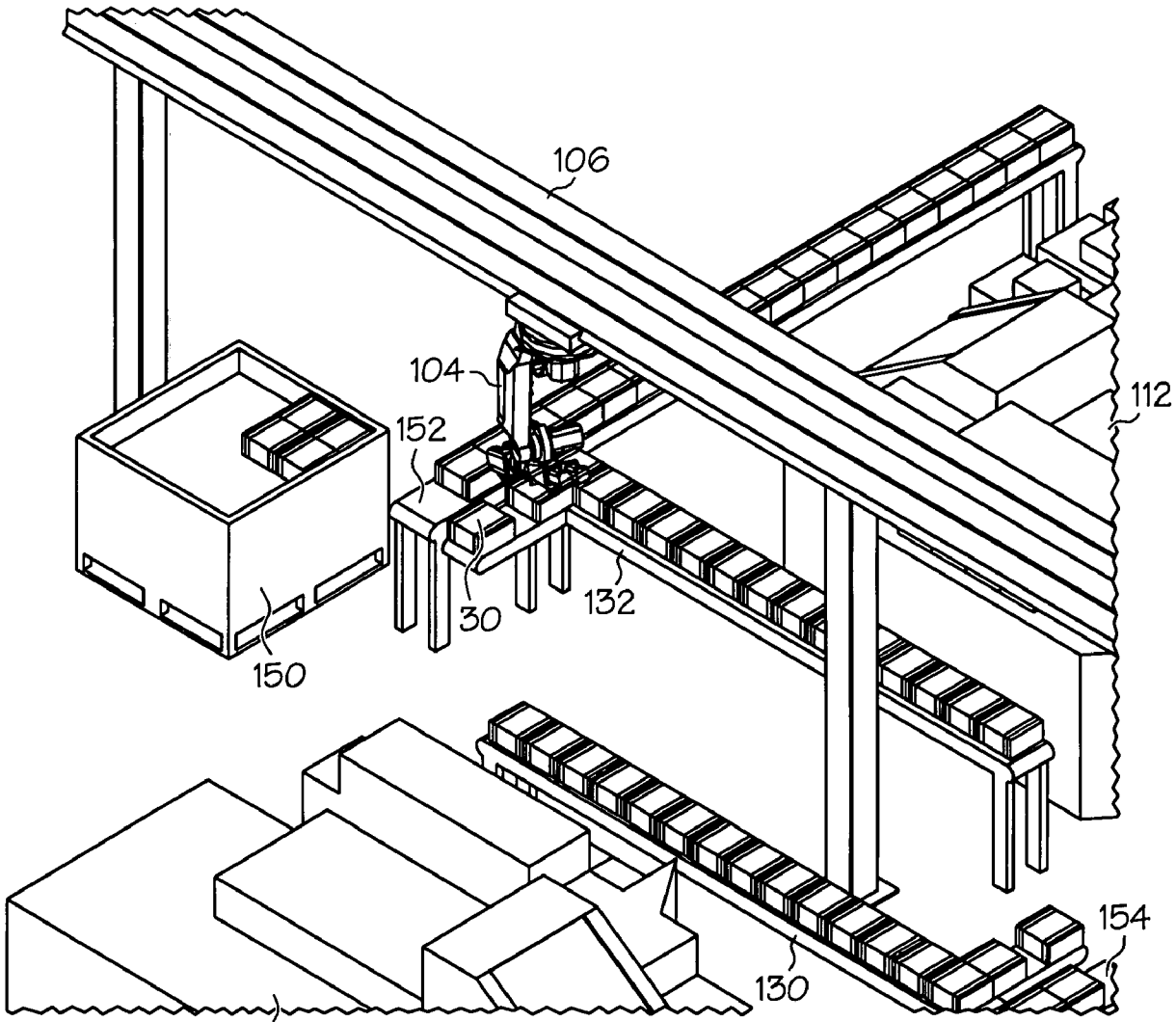
Figure 45:
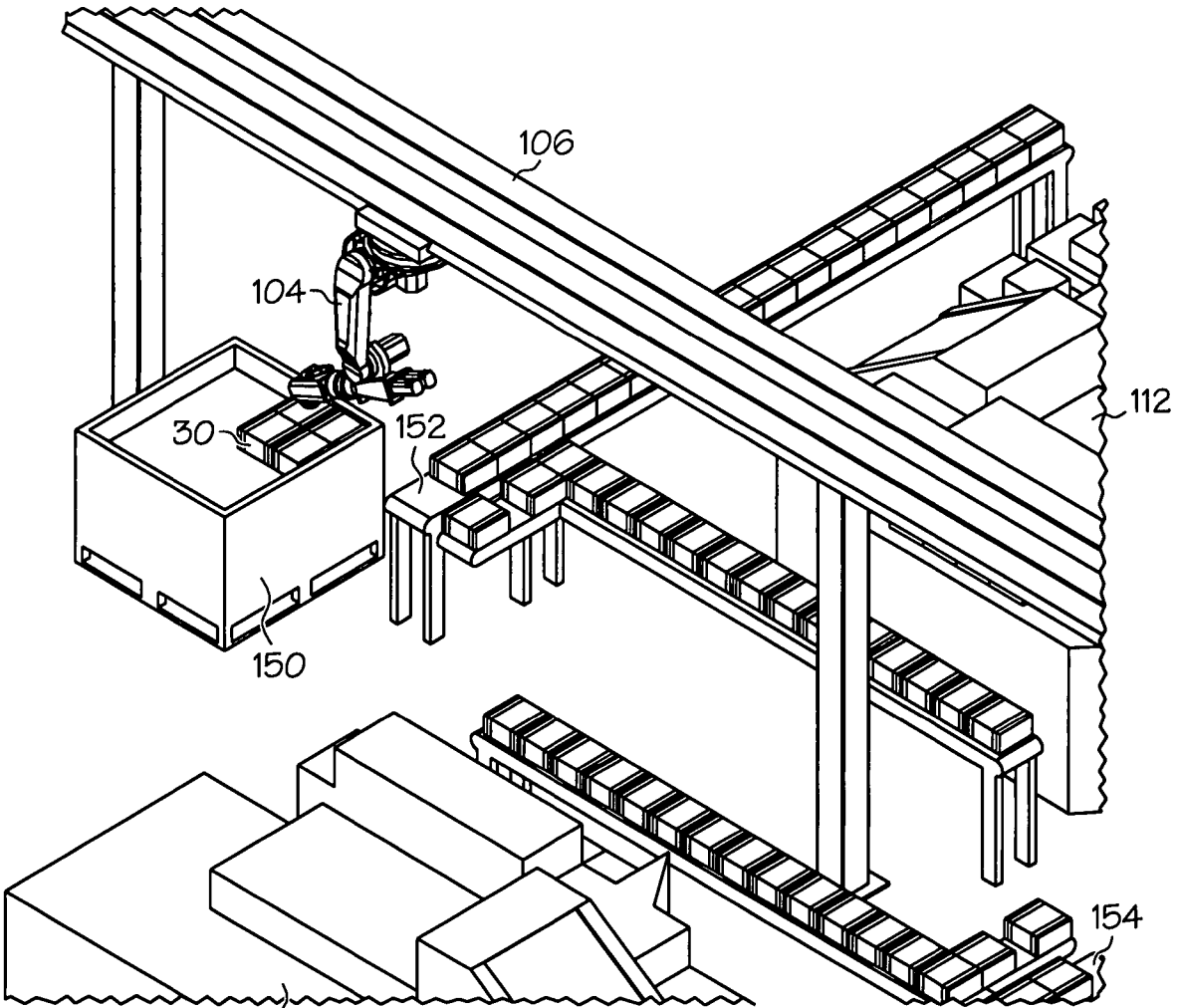

As shown in FIG. 38, the robot arm 104 deposits one of the envelope packages 30 on a first envelope conveyor table 126. As shown in FIG. 39, the robot arm 104 then moves along the length of the overhead beam 106 towards the second conveyor table 128. The robot arm 104 then deposits a stack of envelopes 30 on the second conveyor table 128 (FIG. 40). The robot arm 104 then moves further along the overhead beam 106 until the robot arm 104 is positioned above a third conveyor table 130 (FIG. 41). As shown in FIG. 42, the robot arm 104 then deposits a stack of envelopes 30 onto the third conveyor table 130. As shown in FIG. 43, the robot arm 104 then moves further along the overhead beam 106 towards a fourth conveyor table 132, and deposits the last held stack of envelopes 30 onto the fourth conveyor table 132 (FIG. 44).

Figure 46:
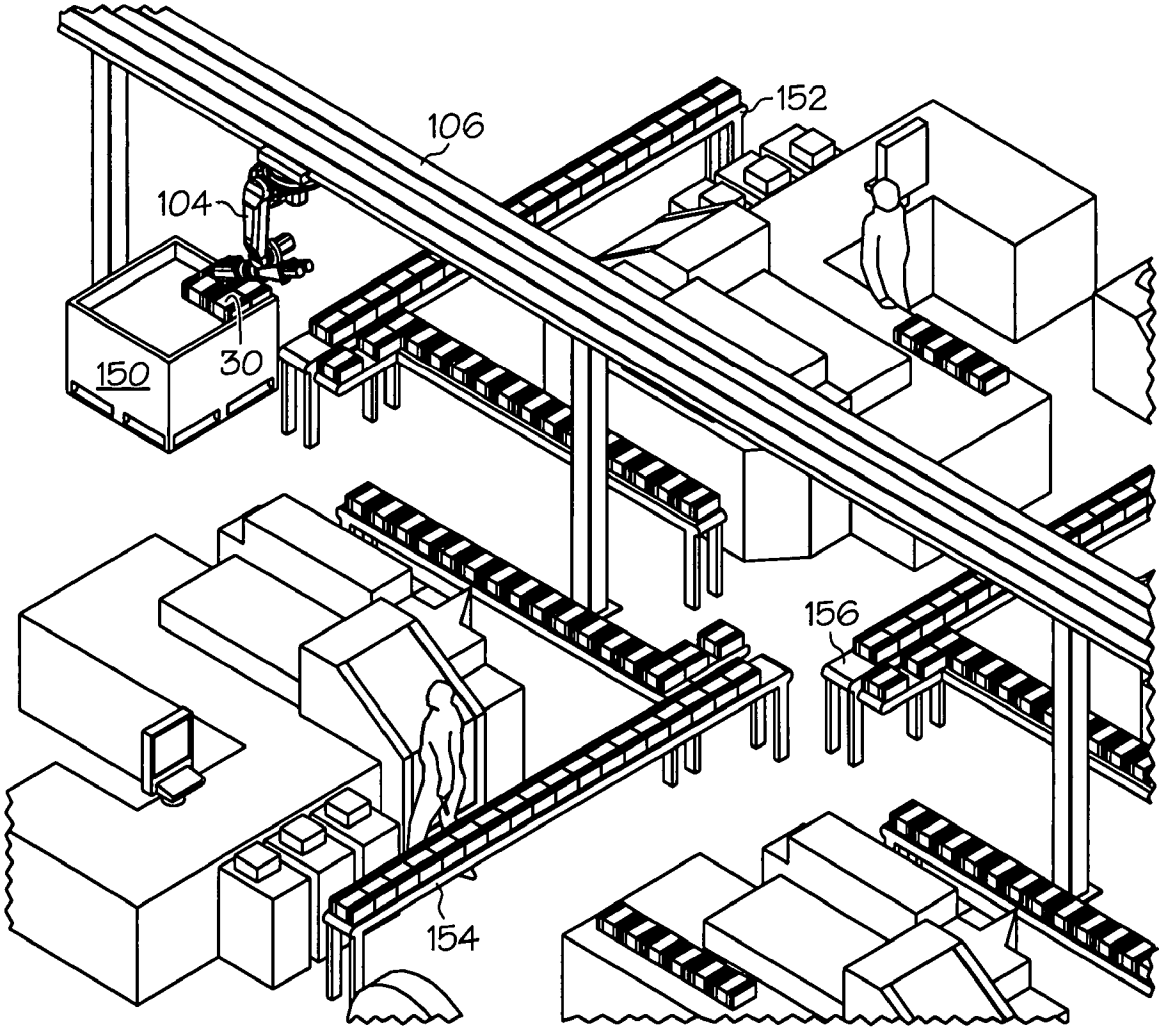
Figure 47:
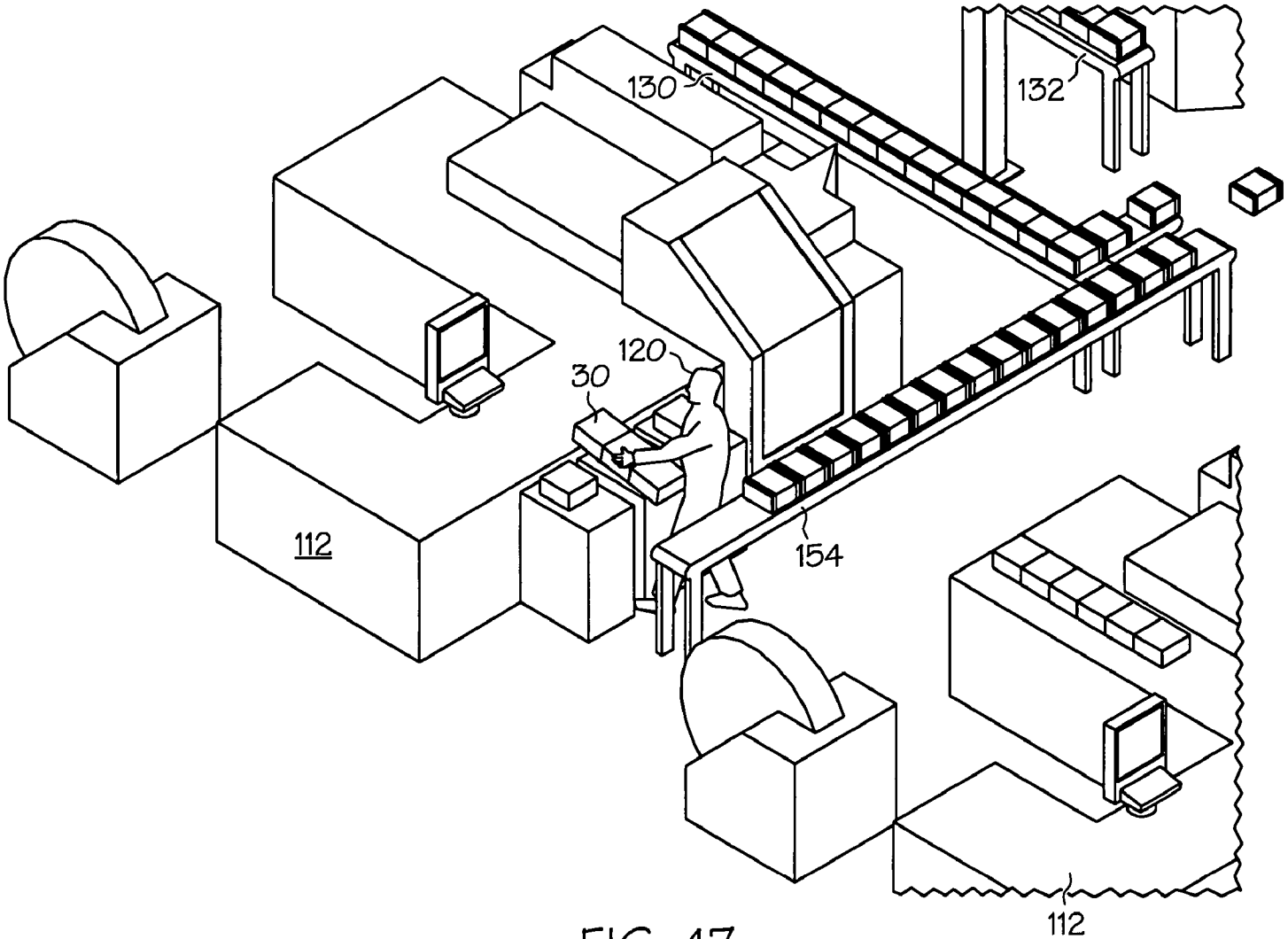
Figure 48:
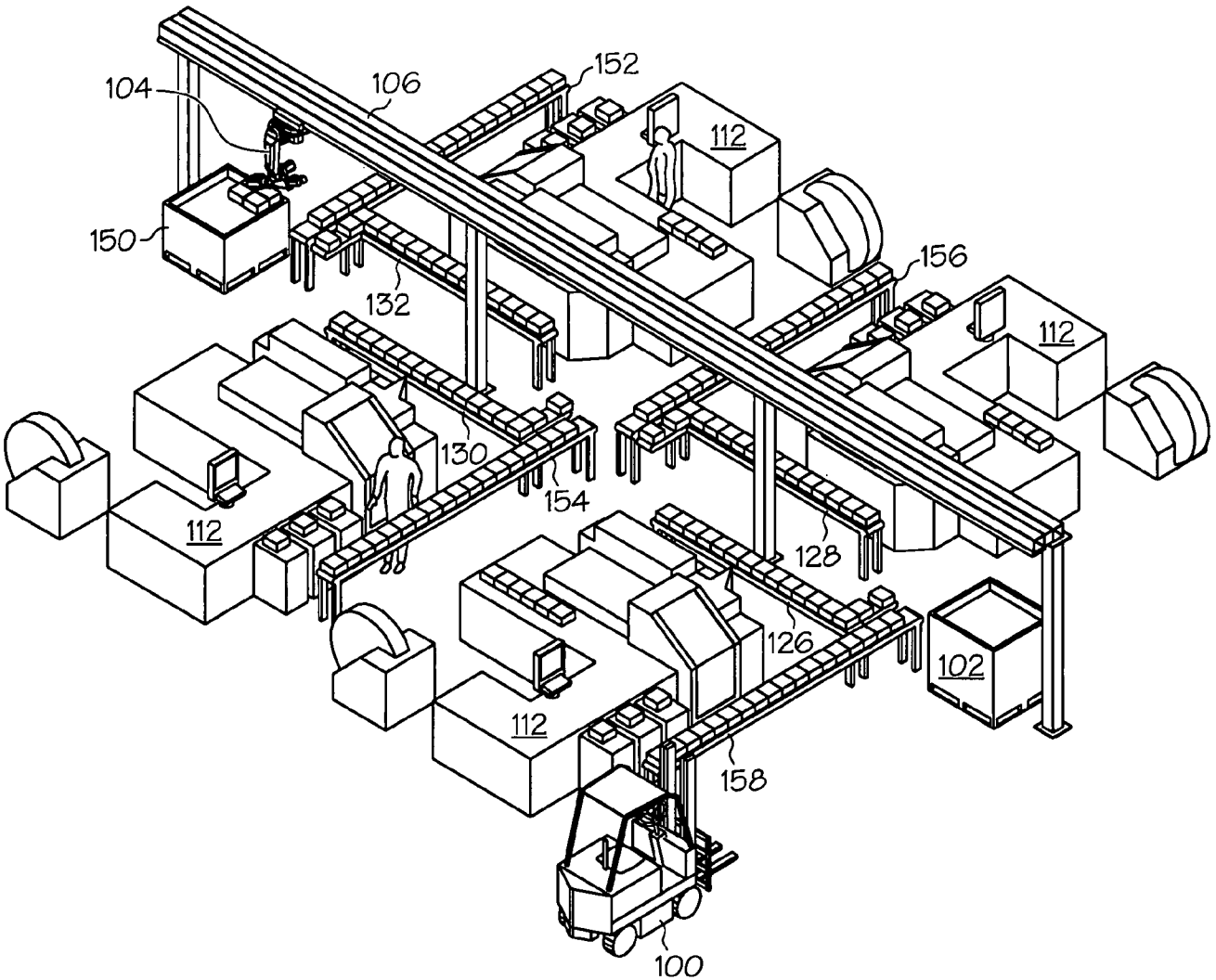

If desired the robot arm 104 may then move along the overhead beam 106 to container 150 which includes additional stacks of envelopes 30 located therein. The stacks of envelopes 30 in the container 150 may be, for example, inner envelopes and stacks of envelopes in the container 102 may be, for example, outer envelopes. As shown in FIG. 46, the robot arm 104 can then lift the desired number of envelope stacks 30 out of the container 150 so that the lifted envelopes 130 may be placed in the various conveyor tables 152, 154, 156, 158 which receive and process the inner envelopes. As shown in FIG. 47, an operator 120 may then lift various stacks of envelopes 30 off of the conveyor table (i.e., conveyor table 154 in the illustrated embodiment) and load the stack of envelopes 30 into or on the envelope inserting machinery 112. Of course, the operator 120 can also load stacks of envelopes from any of the conveyor tables 126, 128, 130, 132, 152, 154, 156, 158 on or into the associated envelope inserting machine 112. In this manner, as shown in FIG. 48, a single robot arm 104, fed by two containers 102, 150 can constantly replenish the various conveyor tables 126, 128, 130, 132, 152, 154, 156, 158 and the containers 102, 150 are replenished as needed by forklift. The banded nature of the envelopes 30 allows the improved processing and handling by the robot arm 104.

The system of FIGS. 34-48, as illustrated, is a semi-automated process. However, as described above in the context of the system of FIGS. 26-33, the system of FIGS. 34-48 may be fully automated such that the conveyer tables may feed their envelope stacks directly into the envelope inserting machinery, the bands can be automatically removed, and the output of the envelope inserting machines can be automatically processed.

Figure 49:
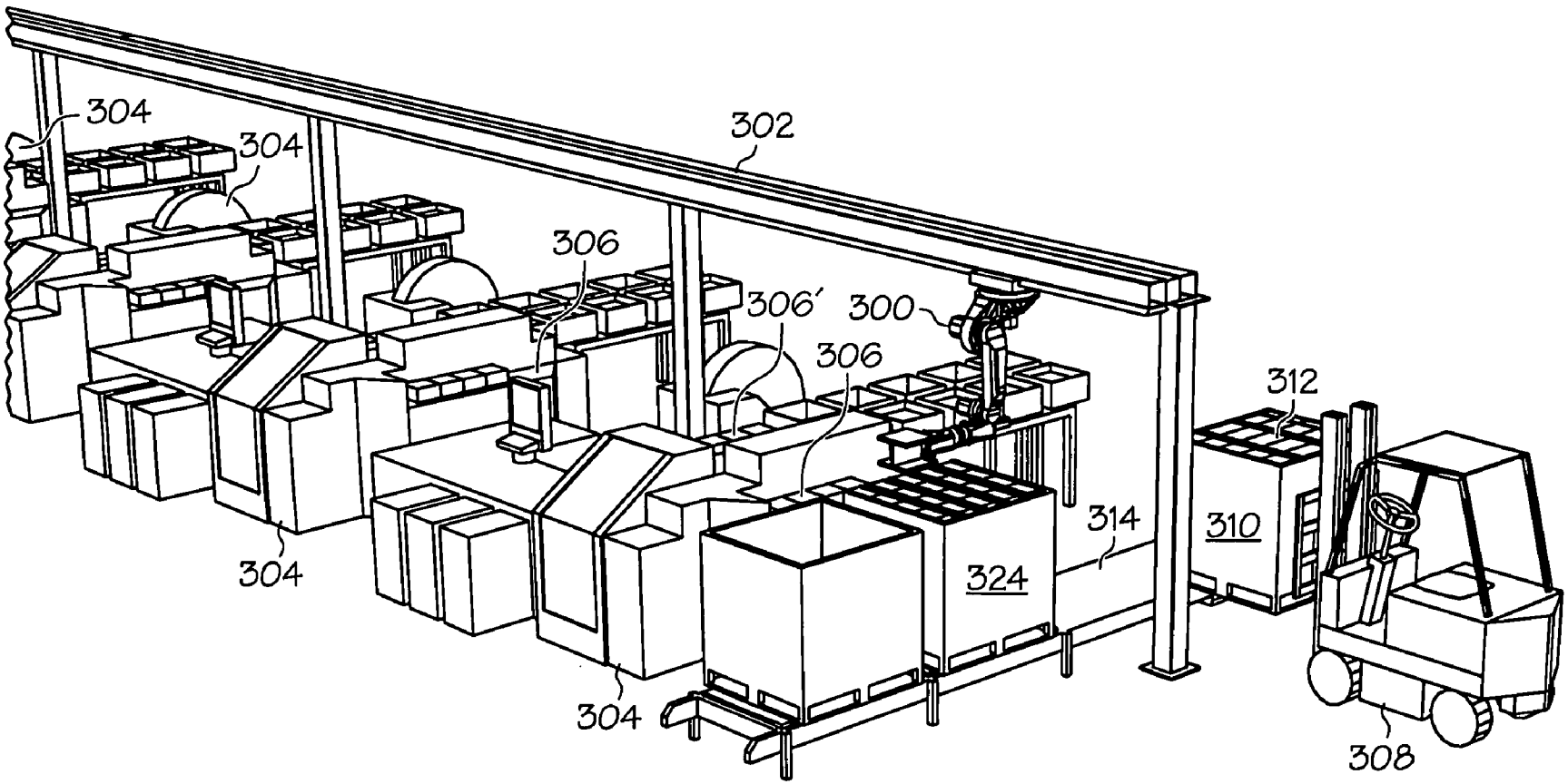
FIGS. 49-64 are a series of front perspective schematic views illustrating a fully automated method for loading packaged envelopes into a plurality of envelope inserting machines.

FIGS. 49-64 illustrate a fully automated envelope processing or envelope inserting operation in which no human intervention is required during normal operation. For example, as shown in FIG. 49 the automated loading process utilizes a robot arm 300 that is movable along an overhead beam 302, similar to the system of FIGS. 26-33 and the system of FIGS. 34-48. The system of FIGS. 34-48 includes four envelope inserting machines 304, with each envelope inserting machine 304 having two conveyor tables 306, 306' that feed envelopes to be processed into the envelope inserting machines 304 and/or receive an output (i.e., processed envelopes) from the envelope inserting machines 304. In particular, each envelope inserting machine 304 includes an input conveyor table 306 upon which unprocessed (i.e., unstuffed) envelopes are stored, and an output conveyor table 306' upon which processed (i.e., stuffed) envelopes outputted by the envelope inserting machine 304 are stored. However, if desired each envelope inserting machine 304 may have two input tables in the manner described and shown in FIGS. 26-48.

Figure 50:
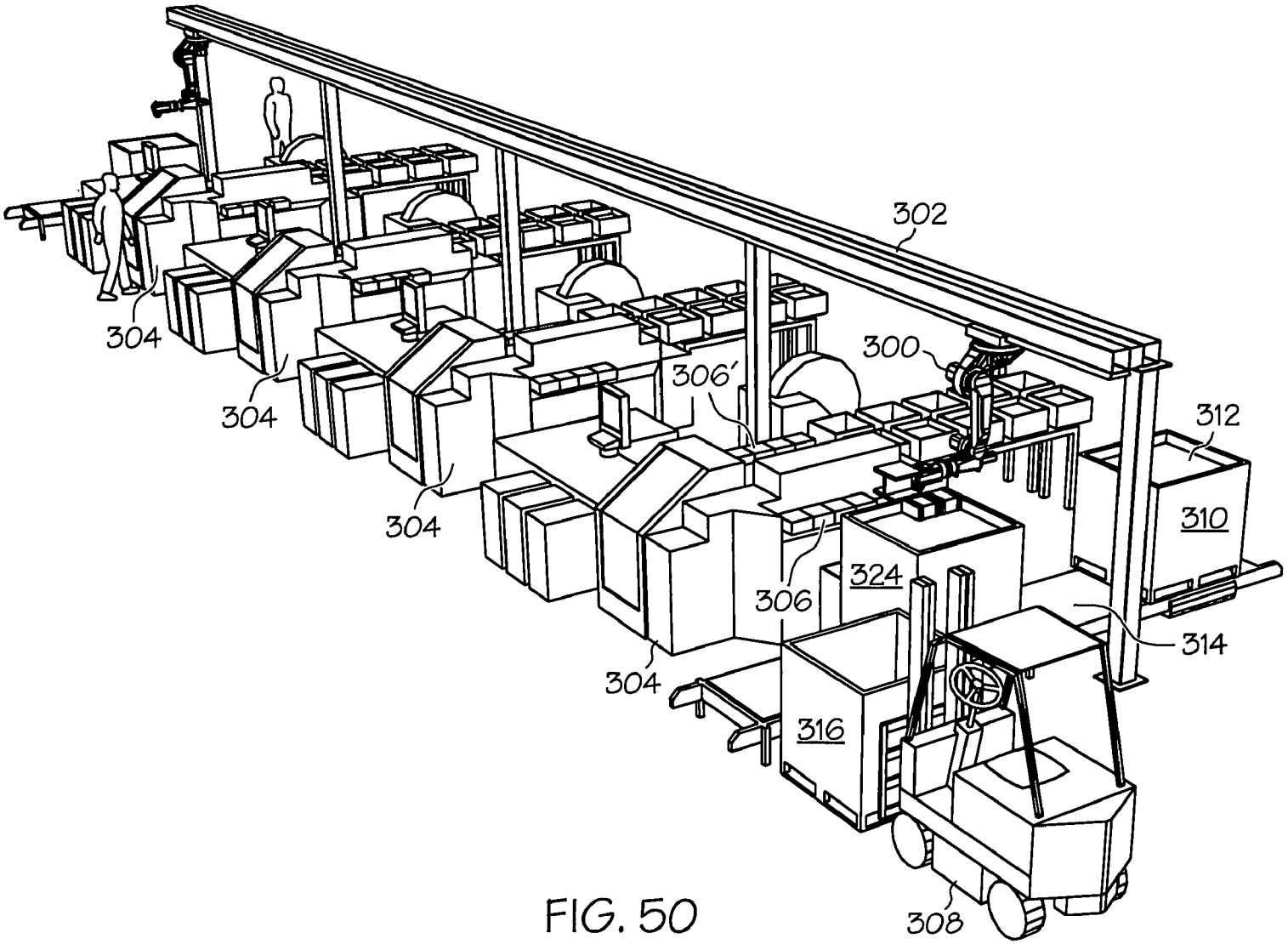
Figure 51:
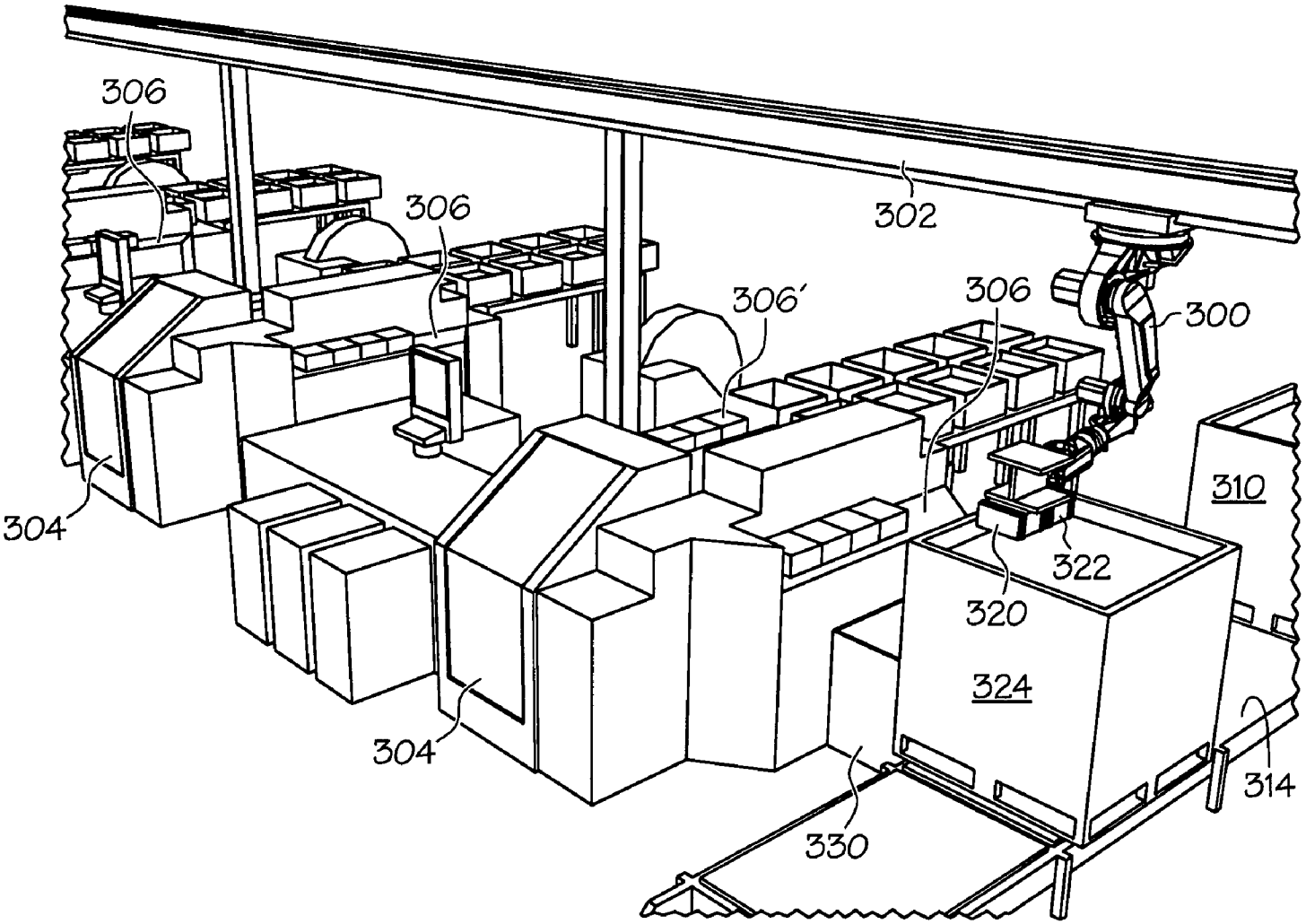

As shown in FIG. 49, a forklift 308 carries a container 310 full of banded stacks of envelopes 312 and positions the container 310 on a conveyer belt 314 located adjacent to or under the support beam 302/robot arm 300. As shown in FIG. 50, the forklift 308 may then lift and remove an empty container 316 located at the opposite end of the conveyor belt 314. Next, as shown in FIG. 51, the robot arm 300 positions itself over the packages of envelopes 320, 322 to be lifted, and lifts the envelope packages 320, 322 out of the associated container 324. In the embodiment shown in FIG. 51, the robot arm 300 lifts two packages of envelopes 320, 322, and may include various suction cup devices to lift any number of desired envelope packages. For example, the robot arm 300 may be able to lift and manipulate four or more (or less) envelope packages.

Figure 52:
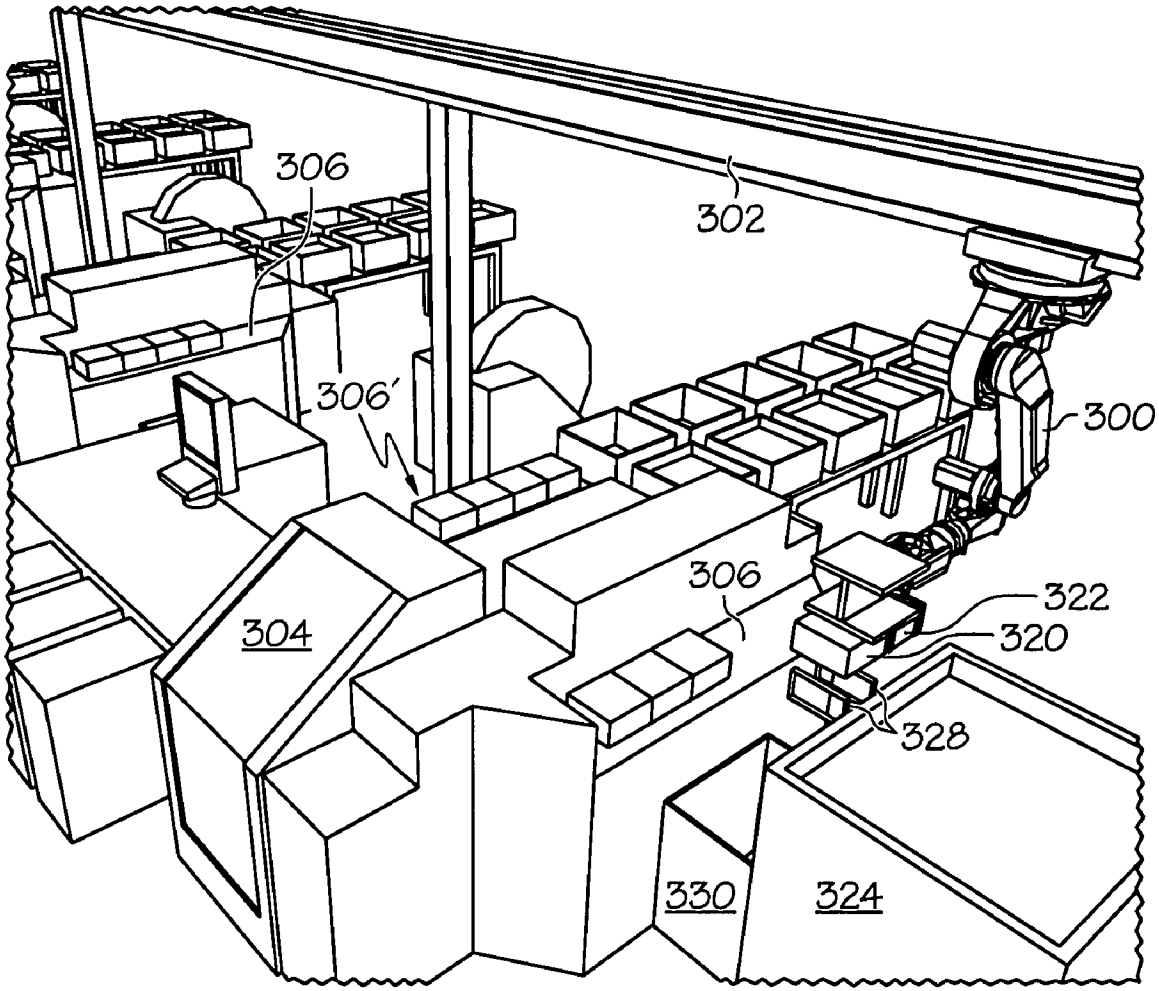

As shown in FIG. 52, the bands 328 are then cut away from the envelope package 320, and drop down into a waste receptacle 330. The bands 328 can be cut or removed by any of a variety of methods or means. For example, the robot arm 300 may include cutting or tearing means which can cut, rip, tear, sever, shear or otherwise separate the bands 328 from the associated envelope package 320. Alternately, the robot arm 300 may carry the gripped envelope package 320 to a separation mechanism (i.e., a blade, tearing mechanism, or the like) which can cut or otherwise remove the bands 328. Further alternately, the bands 328 may be removed after the envelope packages 320 are deposited onto a conveyor table 306, for example, by the envelope inserting machine 304.

Figure 53:
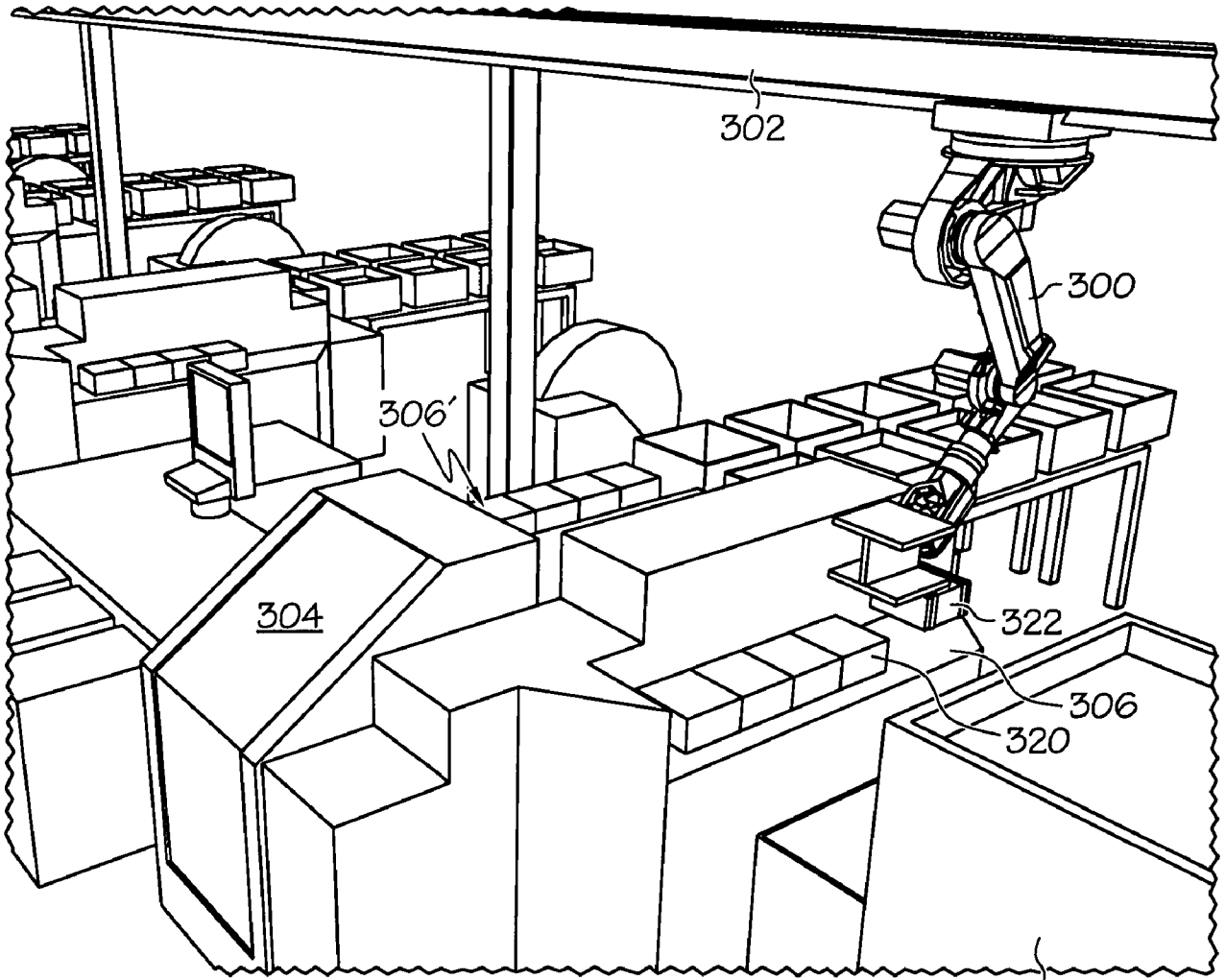
Figure 54:
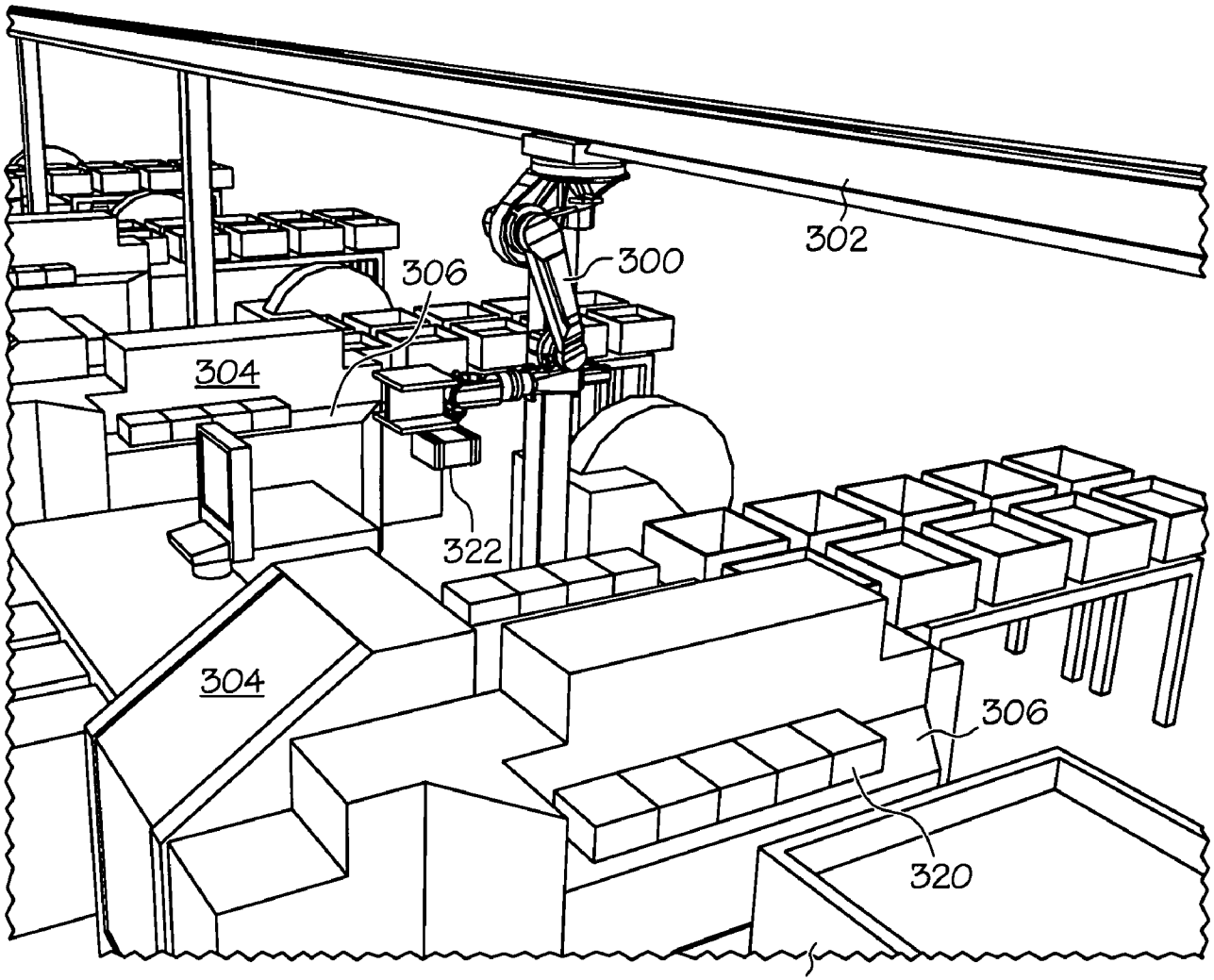
Figure 55:
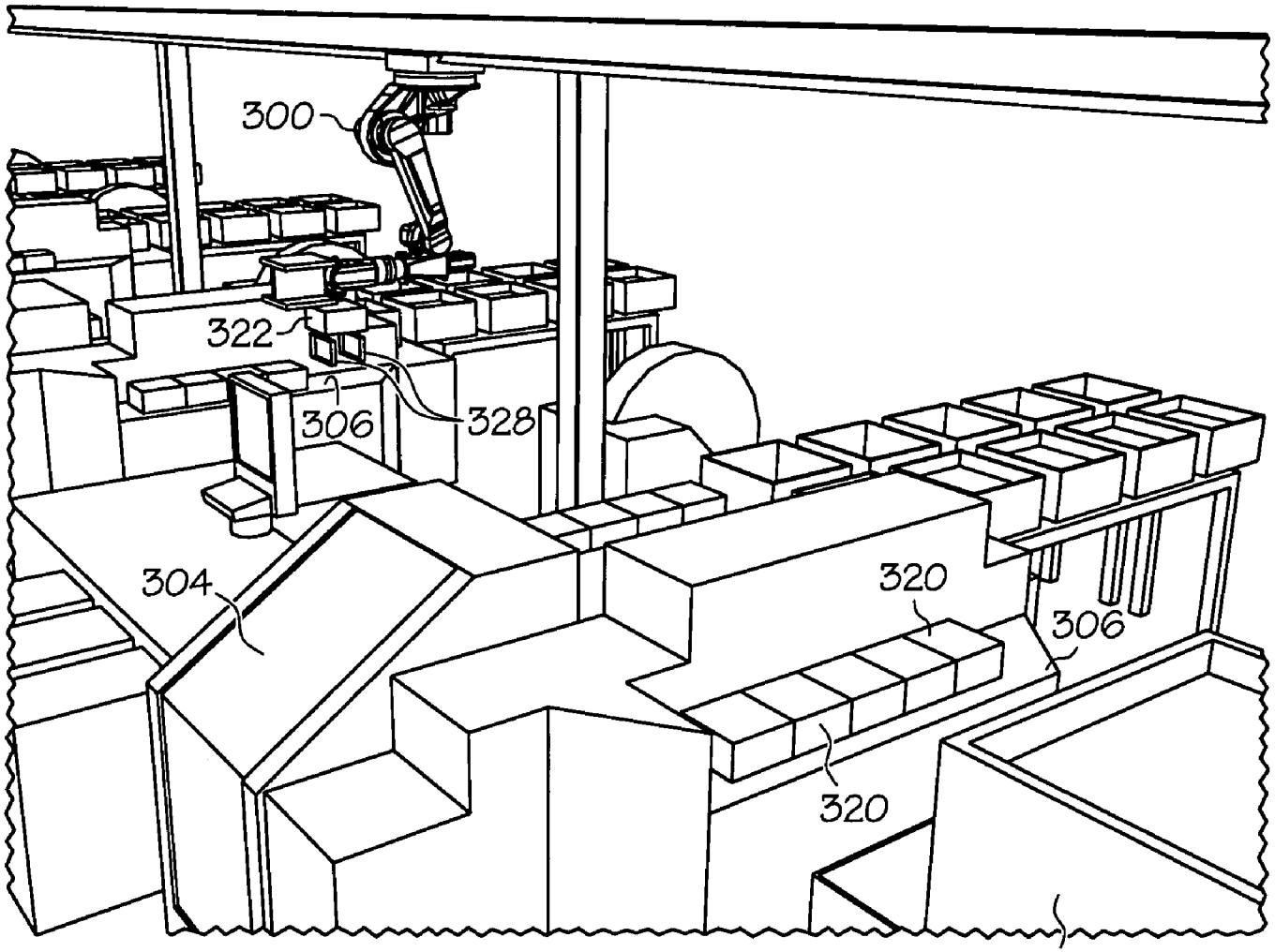
Figure 56:
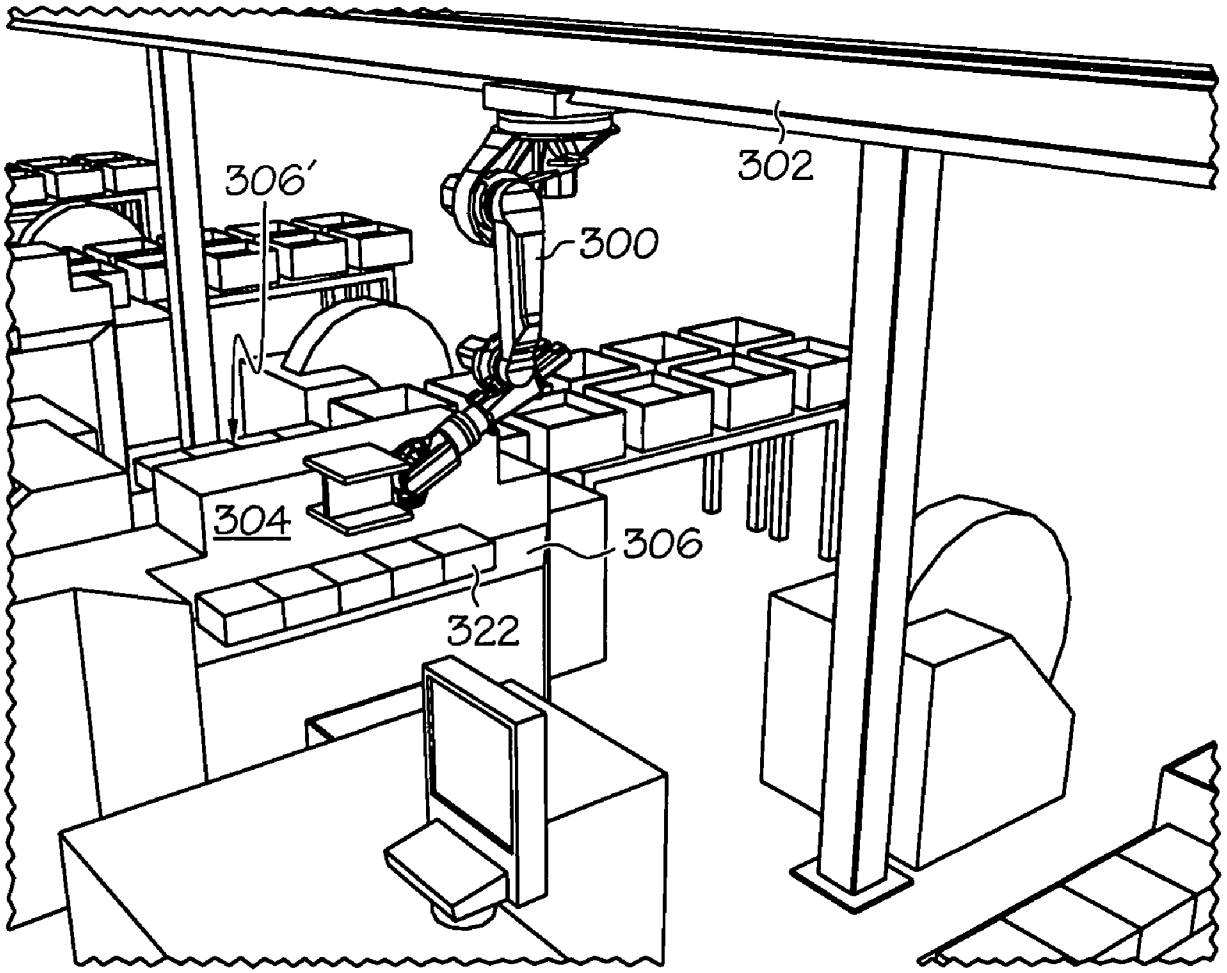

Next, as shown in FIG. 53, the envelope package 320 is deposited on a conveyor table 306 for an envelope inserting machine 304. Retaining means (not shown) may be utilized to keep the now loose stack of envelopes in place. As shown in FIG. 54, the robot arm 300 may then move along its overhead beam 302 to another envelope inserting machine 304 to deposit the remaining envelope package 322 on the envelope conveyor table 306 of that envelope inserting machine 304. As shown in FIG. 55, if not already removed, the bands 328 of the remaining envelope package 322 are removed and, as shown in FIG. 56, the remaining envelope package 322 is deposited on the conveyor table 306 of the associated envelope inserting machine 304. If the robot arm 300 initially picks up more than two envelope packages, the robot arm 300 can then move along its overhead beam 302 to position the remaining envelope packages onto the input tables 306 of the other envelope inserting machines 304.

If desired, the robot arm 300 may then enter a rest state until further action is required. Further action may involve returning to the container 324 to lift additional packages of banded envelopes and placing them on the input conveyor tables 306 of the envelope inserting machines 304.

Figure 57:
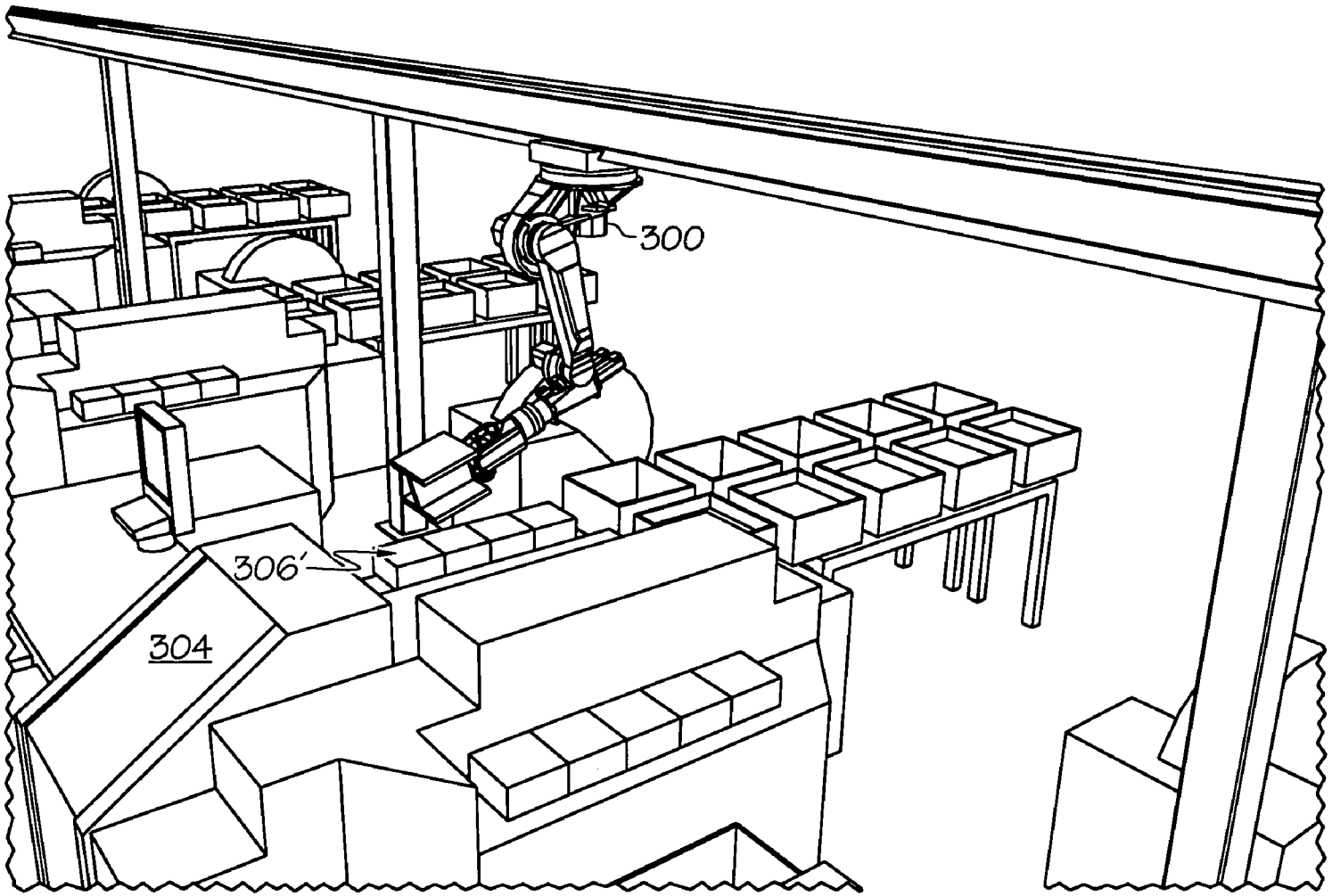
Figure 58:
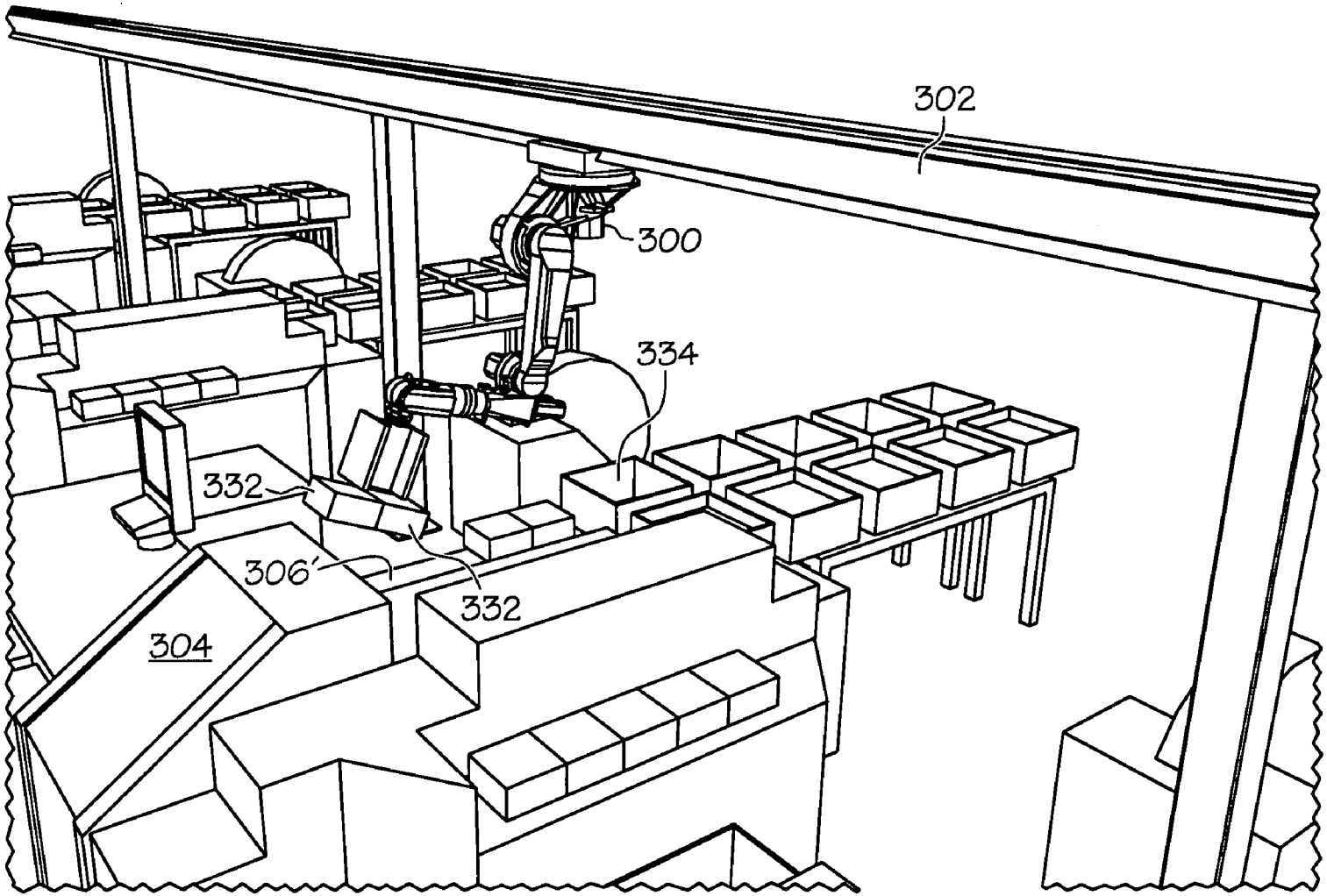
Figure 59:
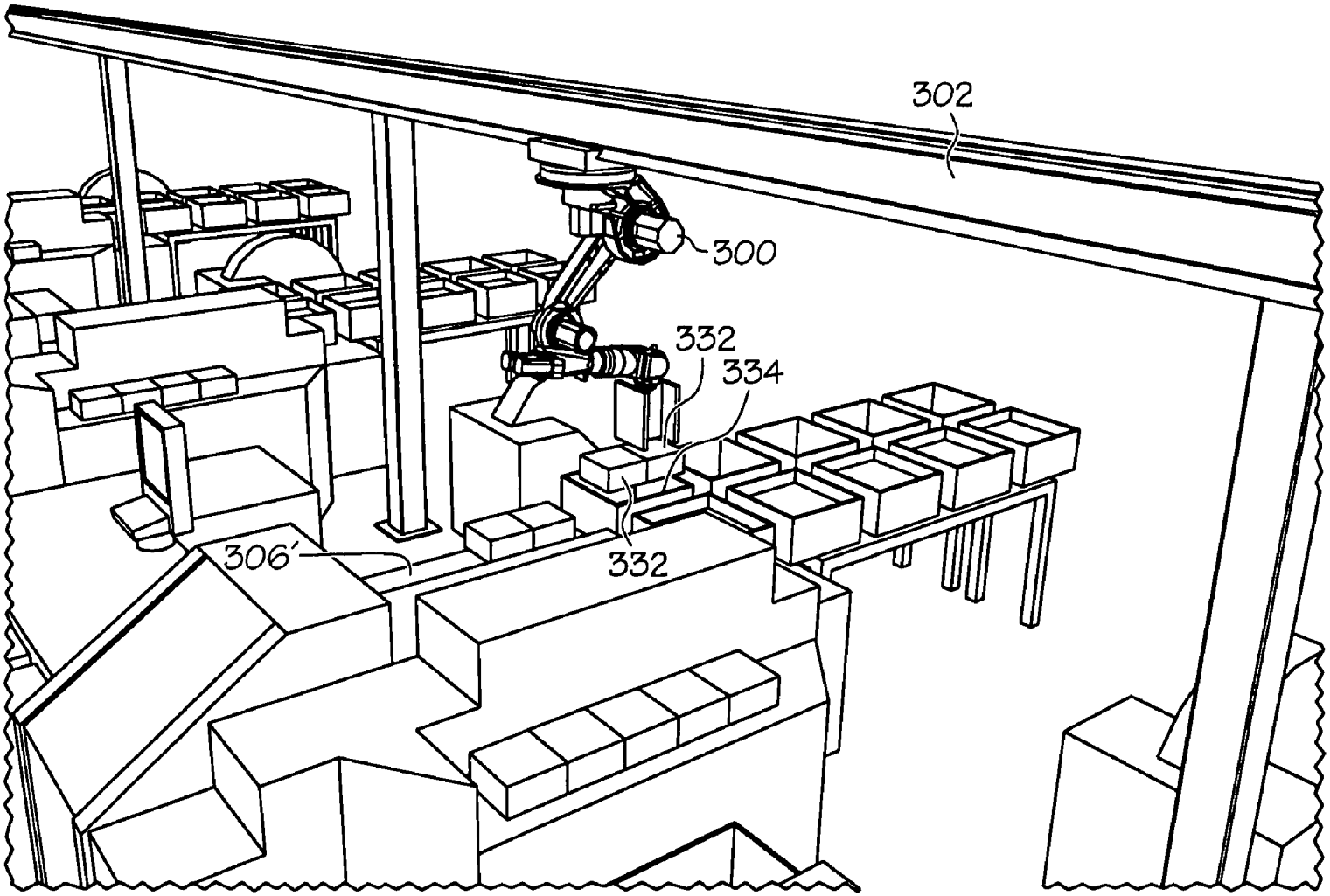
Figure 60:
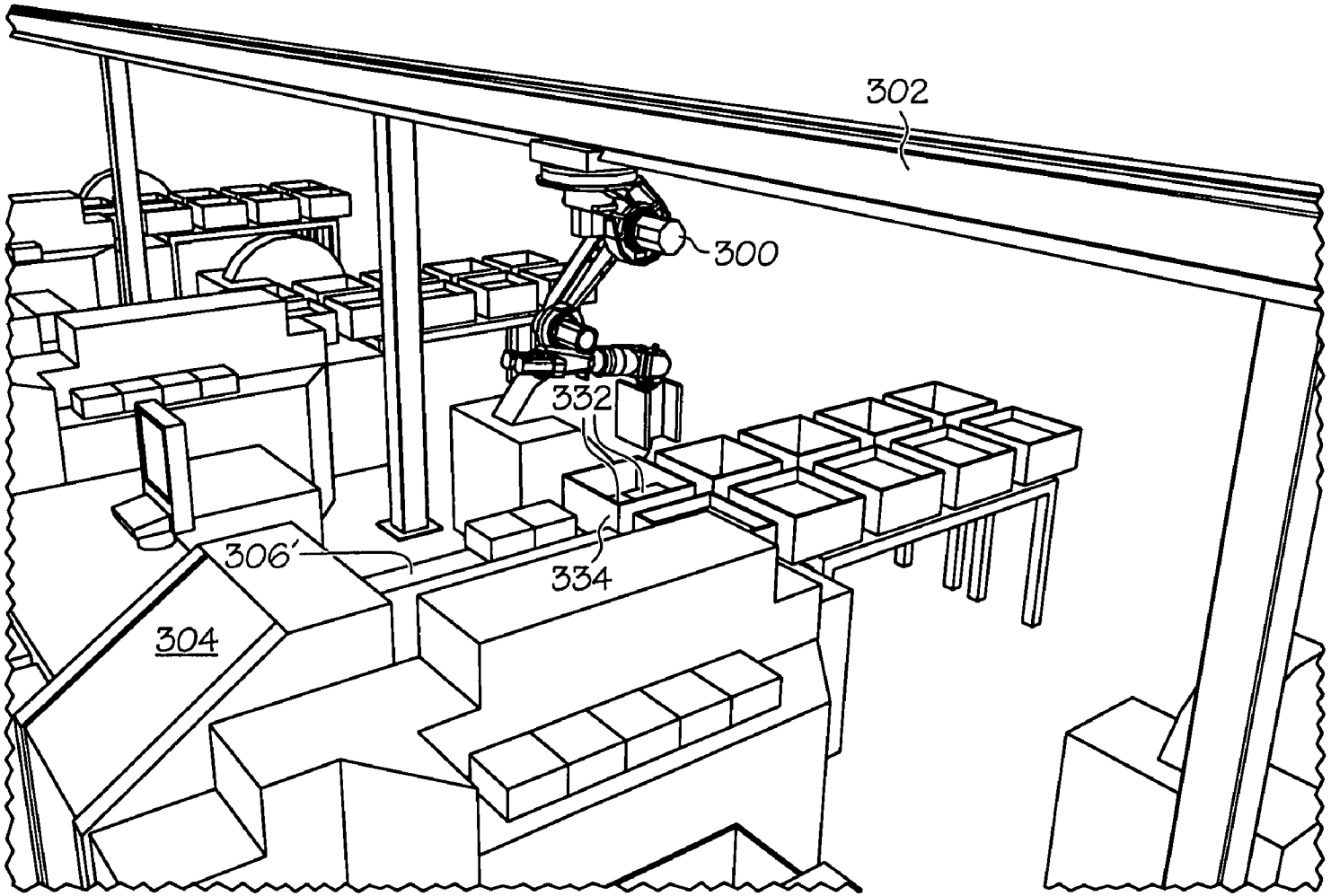
Figure 61:
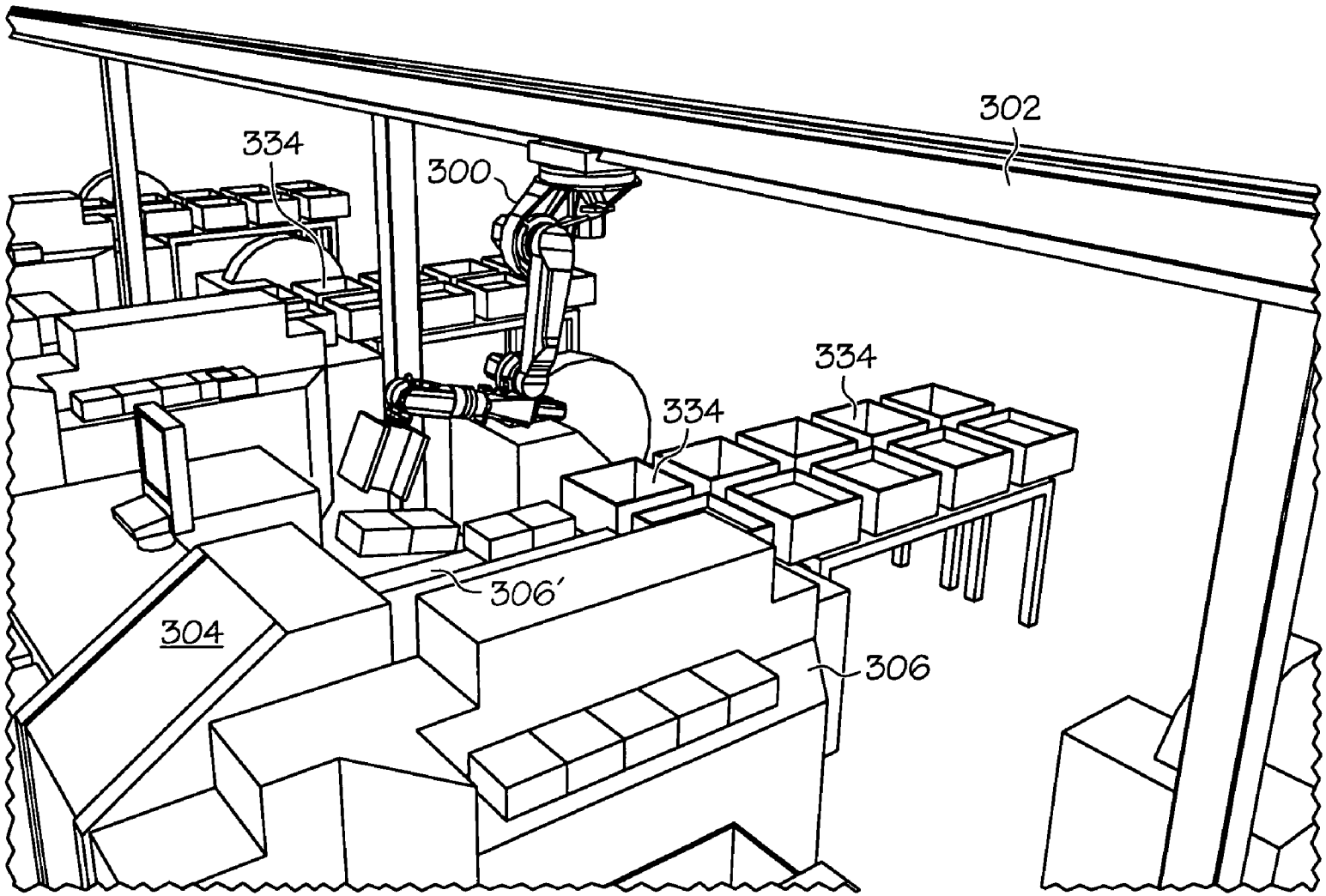

The robot arm 300 may also be utilized to process envelopes on the output conveyor table 306' of the envelope inserting machines 304. For example, as shown in FIG. 57, the robot arm 300 may position itself above an output conveyor table 306' of one of the envelope inserting machines 304. As shown in FIG. 58, the robot arm 300 then lifts two stacks of envelopes 332 off of the output table 306' of the envelope inserting machine 304. Because the envelopes on the output table 306' are not banded, the robot arm 306 may be required to utilize means or mechanisms other than suction cups to lift the envelope stacks 332 off of the output conveyor tables 306'. For example, the robot arm 300 may be able to compress a number of envelopes together or scoop a number of envelopes to thereby grip, lift and manipulate the envelope stack 332. Once the stacks of loose envelopes 332 are gripped and lifted (FIG. 58), the robot arm 300 may then position the gripped envelope stacks 332 over a shipping or storage box 334 (FIG. 59). The robot arm 300 may then position the outgoing envelopes 332 into the storage box 334 and release the envelope stacks 332 therein (FIG. 60).

Figure 62:
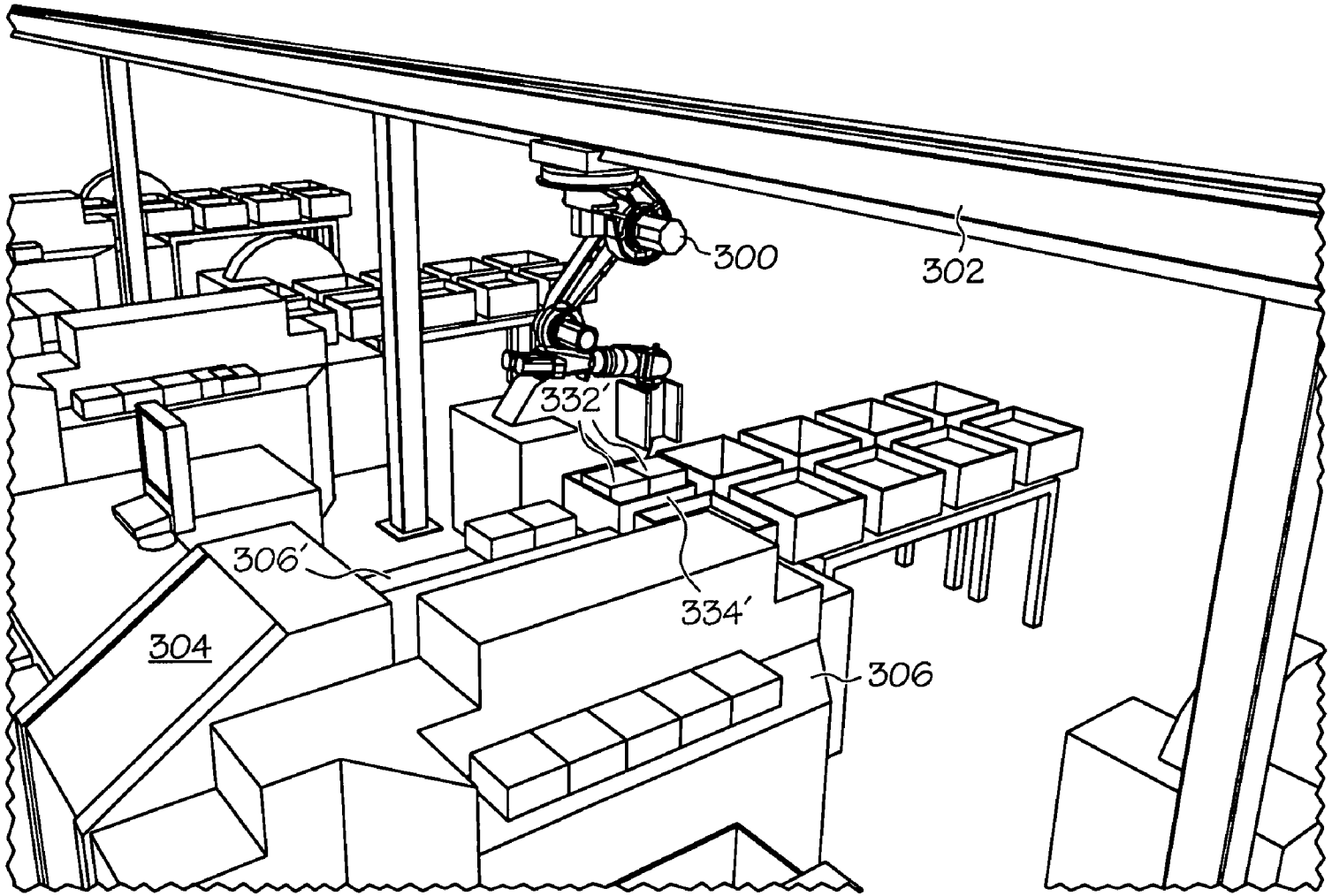

The lifting and packaging of outgoing, stuffed envelopes may then be carried out for other ones of the envelope inserting machines 304, for example loading envelope stacks 332' into a box 334' as shown in FIG. 62. In this manner, the robot arm 300 can ensure that the input conveyor tables 306 are constantly replenished with stacks of envelopes, and that the output conveyor tables 306' are periodically unloaded to accommodate processed envelopes.

Figure 63:
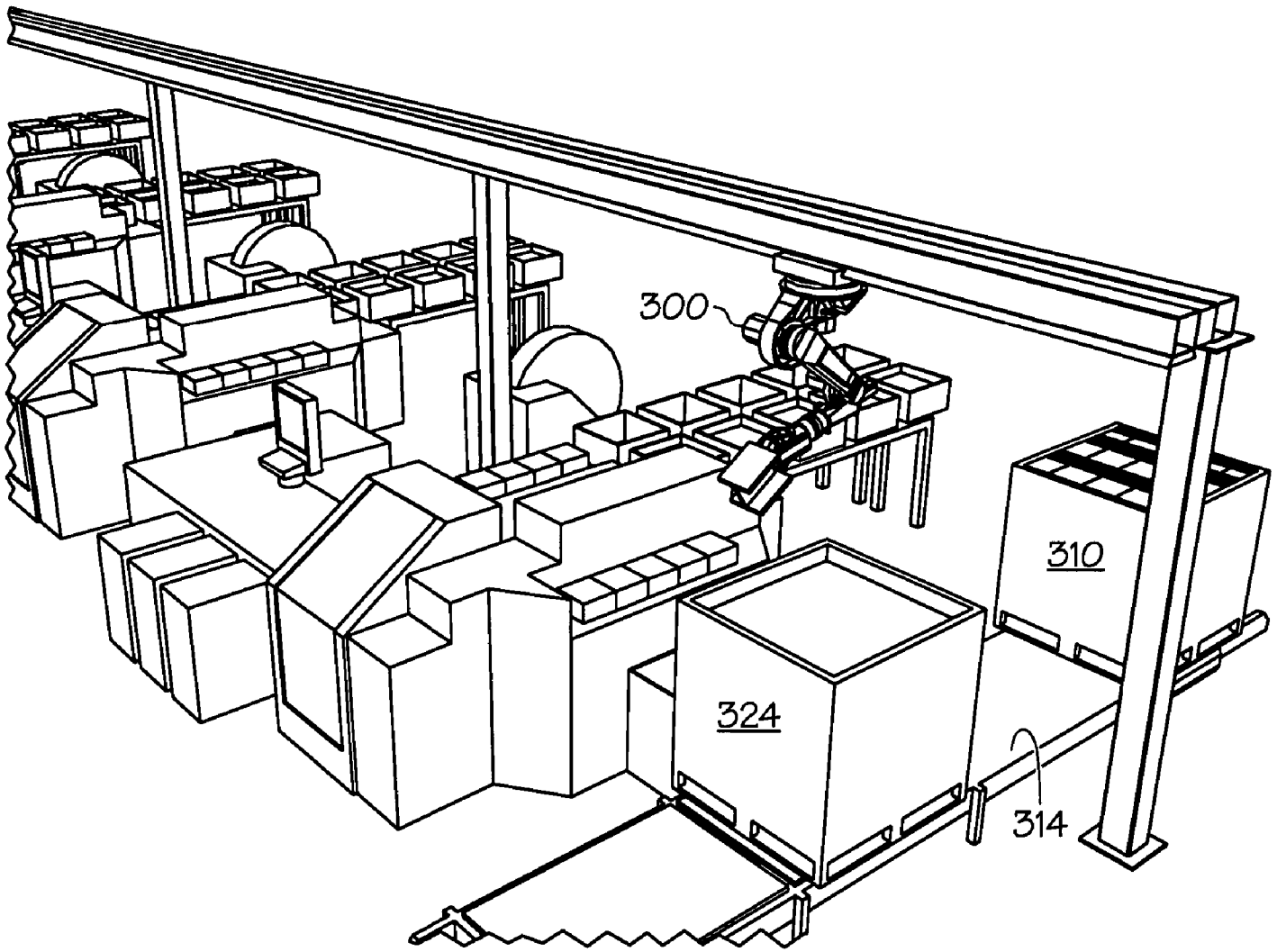
Figure 64:
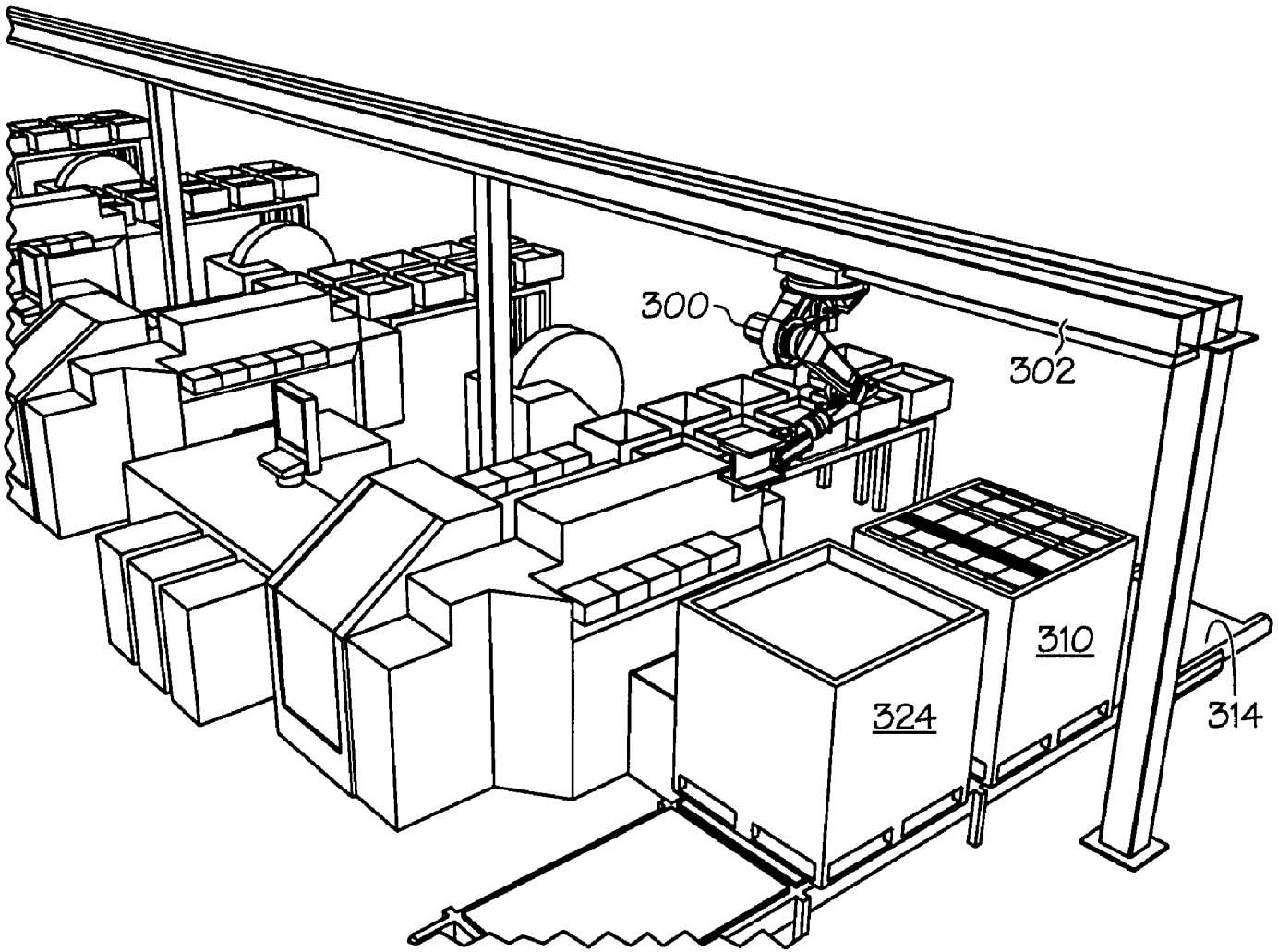

FIG. 63 illustrates the robot arm 300 in its home position wherein the robot arm 300 is positioned over the container 324 to grip and lift additional packages of envelopes for positioning on the input conveyor tables 306. As shown in FIG. 64, the conveyor belt 314 may be activated to move a newly deposited container 310 downstream so that the newly deposited container 310 can be moved into position and replace the container currently being accessed 324 once the container 324 is emptied. Thus, the envelope loading and unloading process may be fully automated such that an operator needs only to replace the input container 324, 310 and carry away the boxes loaded with inserted envelopes.

In this manner, it can be seen that the banded nature of the envelope stacks/packages allows for various improvements in storing, handling, and processing of the envelopes. Thus compression bound nature of the envelopes limits warpage. In addition, the bound stacks allows a plurality of envelopes to be handled as a unit, rather than on an individual basis. Various examples of these improvements are provided herein, although it should be understood that the envelope packages can provide various other advantages in storing, handling, processing or otherwise which are not explicitly mentioned.

Figure 65:
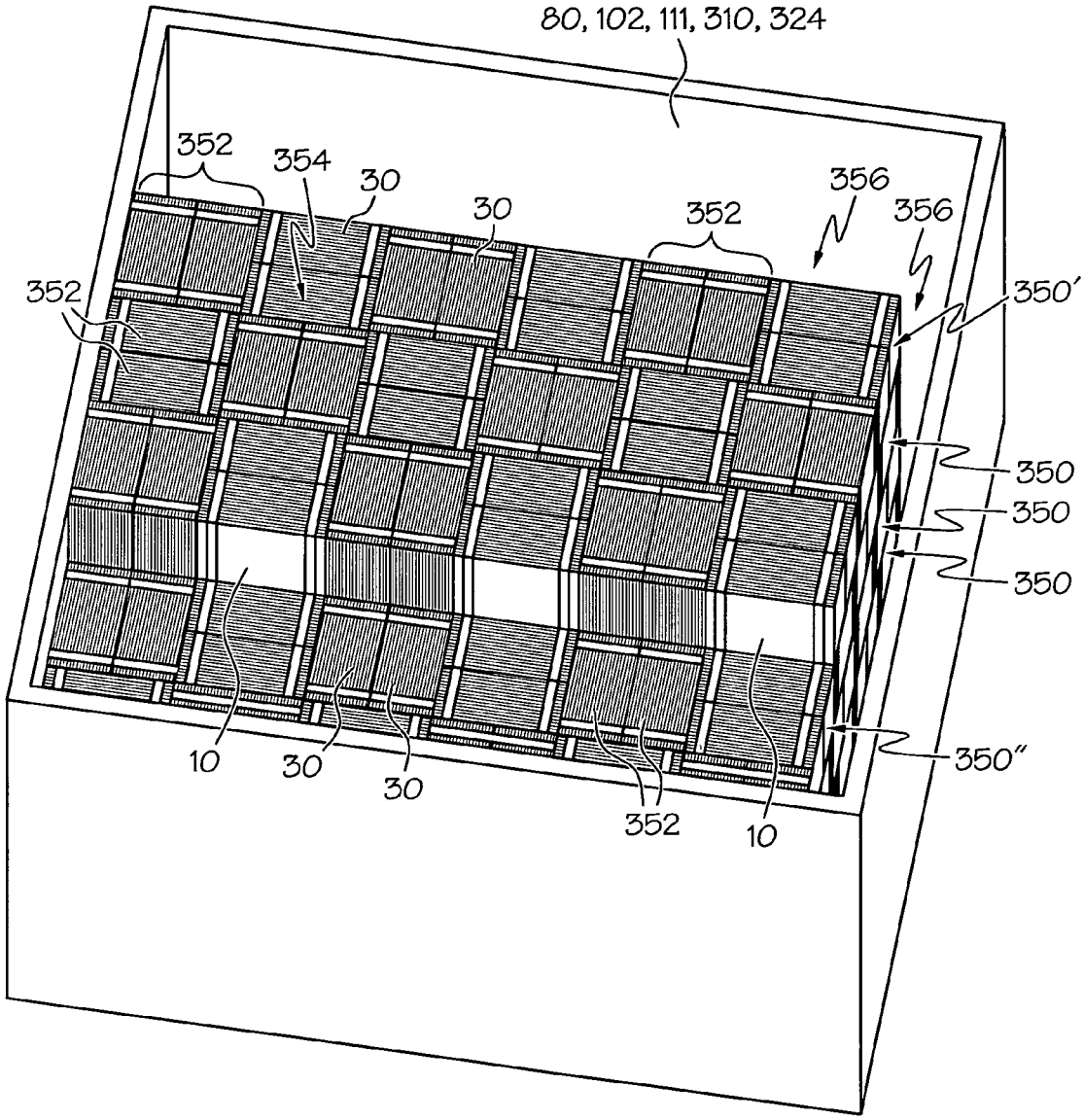
FIG. 65 is a top perspective view of a tray with a plurality of packages of banded envelopes stacked therein.

As shown in FIG. 65, the envelope packages 30 can be stacked in a rigid box, container, or tray, such as the components 80, 102, 111, 310, 324 described above. FIG. 65 illustrates a envelope packages 30 arranged in a plurality of horizontally-oriented, vertically spaced rows 350 to form a stack 354. Each row 350 includes a plurality of envelope packages 30 aligned in a generally horizontal row. The envelope packages 30 of FIG. 65 are arranged in a pattern wherein pairs of aligned adjacent envelope packages 30 form envelope package pairs 352. In one embodiment, each individual envelope package 30 has a length that is about twice its width such that each envelope package pair 352 is generally square in top view. It should be noted that each envelope package 30 in an envelope package pair 352 may not necessarily be directly coupled together, and may instead simply comprise two individual envelope packages 30 placed in an aligned, side-by-side configuration.

In FIG. 65 the envelope packages 30/envelope package pairs 352 are arranged in a so-called "herringbone" pattern. Each envelope package pair 352 in each row 350 is offset or rotated by 90 degrees from each abutting adjacent envelope package pair 352 (i.e. each non-diagonal adjacent envelope package pair 352). In addition, the stacking arrangement in each row 350 differs from the stacking arrangement in the row 350 immediately above or below.

FIG. 65 illustrates that each envelope package pair 352 of the top row 350' is offset or rotated 90 degrees from the associated envelope package pair 352 located immediately therebelow in the second row 350. This arrangement helps to ensure that each envelope 10 in each envelope package 30/envelope package pair 352 is offset by 90 degrees from any envelope 10 located thereabove or therebelow. Thus, in this case, envelope packages 30 of the upper row 350' contact and rest directly on, and have their weight fully supported by, envelope packages 30 of the second row 350" immediately therebelow. It should be noted that the stacking arrangement shown in the first two rows 350', 350" may be extrapolated and implemented in all of the rows of 350 of the stack 354 (i.e. the stack 354 may include a plurality of alternating rows 350', 350"). It should also be understood that the top row 350' will typically include the same number of envelope packages 30/envelope package pair 352 as all of the other rows 350 in the stack 354. However, in the embodiment shown in FIG. 65, portions of the top row 350' are removed to illustrate part of the second row 350".

This offset stacking arrangement ensures that the envelopes 10 of each package 30 do not slide into the gaps between envelopes 10 of an envelope package 30 positioned thereabove or therebelow, and thereby helps to provide increased structural integrity to the stack 354, reduces damage to the envelopes 10 and improves ease of handling (i.e., unstacking) the envelope packages 30. In addition, some existing envelope stacking arrangements may require seperator sheets or panels to be located between adjacent rows 350. However, the stacking arrangement of the present invention prevents envelopes from interleaving and thus renders the use of seperator sheets/panels unnecessary, which reduces materials costs and improves ease of packing and unpacking the tray 80.

Figure 66:
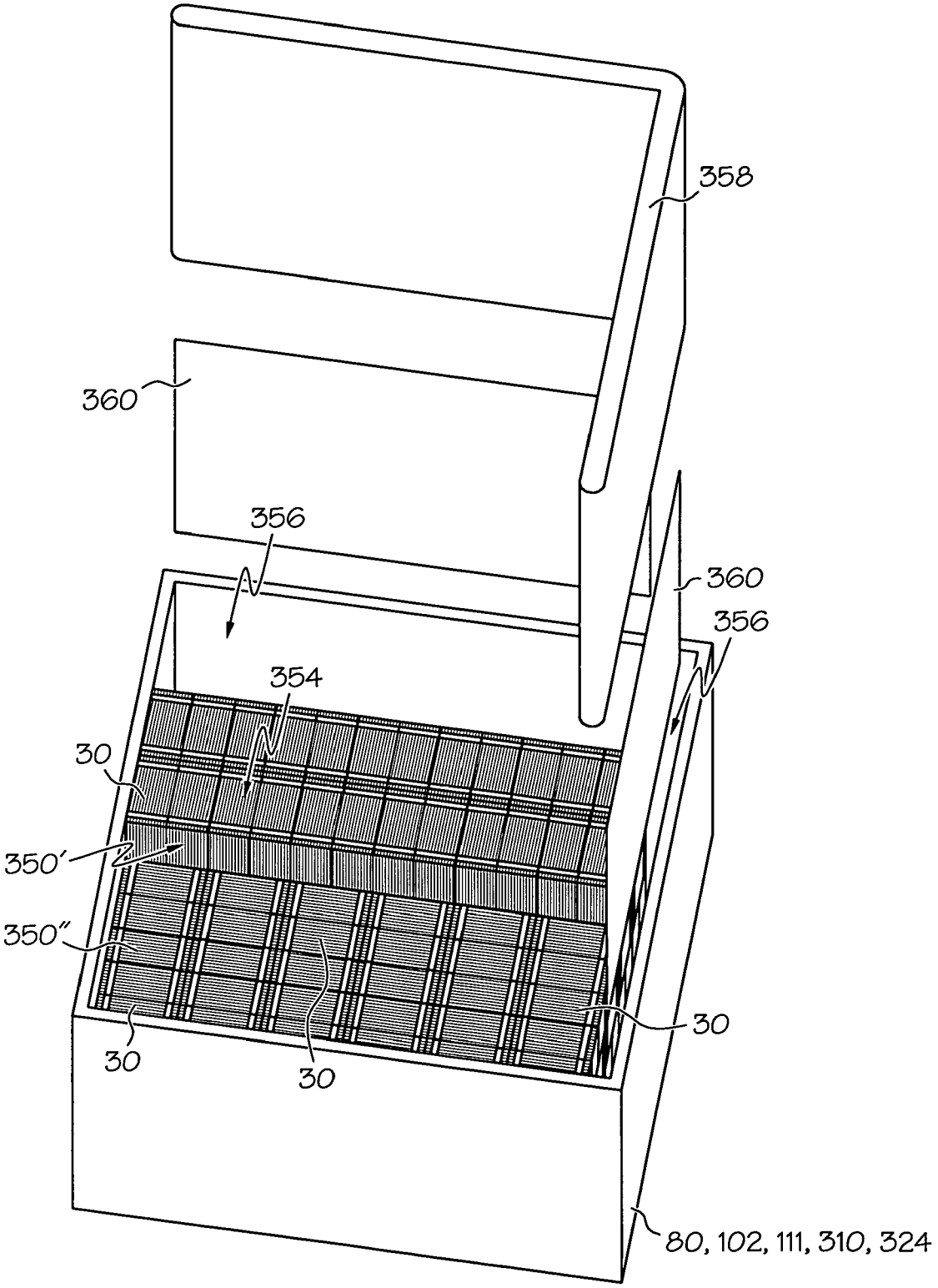
FIG. 66 is a top perspective view of a tray with a plurality of packages of banded envelopes stacked therein in a different manner than that of FIG. 65.

The herringbone pattern of FIG. 65 illustrates one particular stacking arrangement. However, it should be understood that nearly any stacking arrangement which provides envelope packages 30/envelopes 10 that are offset or rotated relative to envelope packages 30/envelopes 10 immediately thereabove or therebelow may be utilized. For example, FIG. 66 illustrates an alternate stacking arrangement wherein the envelope packages 30 in the top row 350' are all aligned in a first configuration or direction, and the envelope packages 30 in the second row 350" are all aligned in a second configuration or direction that is perpendicular to the first direction. This arrangement also ensures that each envelope 10 is perpendicular to any envelopes 10 located immediately thereabove or therebelow. Of course, the stacking arrangements which can be utilized to provide this offset stacking feature are nearly limitless, and the invention is not necessarily limited to the two specific stacking arrangements shown in FIGS. 65 and 66. For example, the stacking pattern within each layer 350 can be selected in order to maximize the number of envelope packages 30 that can be stored within a given tray 80.

As shown in FIG. 66, the stack 354 and the tray 80 may define a gap 356 therebetween, wherein the gap 356 is generally "L"-shaped and extends along two edges of the stack 354. In this case an inflatable air bag, bladder or bladder component 358 may be inserted into the gap. The bladder 358 is generally "L" shaped in top view to fit into the gap 356.

In order to utilize the bladder 358, the stack 354 is first formed in the desired configuration in a corner of the tray 80. The bladder 358 is then inserted into the gap 356 in an uninflated or less-than-fully inflated state. Air (or other gases/fluids, if desired) is then pumped into the bladder 358. As the bladder 358 inflates it expands and presses against the walls of the tray 80 and the stack 354 to form a tight fit and lock the stack 354 in place. In addition, as it is inflated the bladder 358 forces air out of the envelope packages 30, thereby further compressing the envelope packages 30 to provide a stack 354 with increased structural integrity which reduces damage to the envelopes 30 during shipping. Further removing air also increases the strength of the stack 354 and allows it to be stacked higher, and also prevents absorption of moisture. Once the tray 80 has been shipped to its desired location, the air bladder 358 can be uninflated and removed to allow easy access to the envelopes 10. The bladder 358 may have a refill valve or the like such that the bladder 358 can be repeatedly inflated and deflated so that the bladder 358 can be reused.

Because the bladder 358 is located along two edges of the stack 354, the bladder 358 provides compression along two different directions of the stack 354, thereby ensuring that all envelope packages 30 are compressed, regardless of their orientation. Of course, rather than utilizing a single "L" shaped bladder 358, two generally rectangular bladders may be utilized and arranged in a "L" shape. In addition, if desired protective sheets 360 may be positioned between the bladder 358 and the exposed surfaces of the stack 354 to protect the envelopes 10 of the stack 354. Although the bladder 358 is illustrated in conjunction with the stack 354 of FIG. 66, the bladder 358 may be used in conjunction with the stack 354 of FIG. 65, or any of the various other stack arrangements.

In this manner, the improved stacking arrangement and/or air bladder improve the stacking and shipping characteristics of the stack 354, thereby providing envelopes 10 of a more uniform shape in which damage, warping and the like is minimized. In addition, the bladder component 358 can be used when storing and/or shipping a wide variety of envelopes and/or envelope packages, and is not necessarily restricted for use with compression-bound envelope packages. Instead, the bladder component 358 can be used with nearly any type of arrangement of envelopes stacked in a container.

Having described the invention in detail and by reference to the preferred embodiments, it will be apparent that modifications and variations thereof are possible without departing from the scope of the invention.

What is claimed is:

1. An envelope package comprising:

a plurality of generally aligned envelopes, said plurality of envelopes being compressed together, the plurality of envelopes including at least 50 envelopes; and two or more generally non-elastic bands extending around said plurality of compressed envelopes and retaining said envelopes in a state of compression, and wherein said plurality of envelopes, due to the state of compression thereof, exerts an expansion force of at least about ½ pound such that said plurality of envelopes are sufficiently compressed to generally seal ambient air out of said plurality of envelopes and to reduce absorption of moisture therein, further wherein each envelope is generally flat and planar in the absence of outside forces, and wherein said bands retain said plurality of envelopes in a limited state of compression such that none of the banded envelopes are bowed out of plane by more than about 1/40 of the length of that envelope.

2. The envelope package of claim 1 wherein said bands retain said plurality of envelopes in a state of compression such that said plurality of envelopes are compressed at least about 10% from their uncompressed state.

3. The envelope package of claim 1 wherein each envelope includes a cavity having a throat and a flap which can selectively cover said throat.

4. The envelope package of claim 3 wherein each flap includes an adhesive located thereon such that each flap can be adhered to a body of an associated envelope to thereby seal the associated envelope.

5. The envelope package of claim 1 wherein each envelope is generally rectangular in front view and has a plurality of outer edges, and wherein the outer edges of each envelope are generally aligned such that said plurality of envelopes form a generally rectangular prism.

6. The envelope package of claim 1 wherein each envelope is generally flat and planar in the absence of outside forces, and wherein said plurality of envelopes are compressed in a direction generally perpendicular to said plane of each envelope.

7. The envelope package of claim 1 wherein at least one said band is made of a generally air-impermeable material.

8. The envelope package of claim 1 wherein at least one said band has a width of at least about 1 inch.

9. The envelope package of claim 1 wherein at least one said band extends around the center of said plurality of envelopes.

10. The envelope package of claim 1 wherein at least one said band includes a marking thereon.

11. The envelope package of claim 10 wherein said marking is located a predetermined distance from a side edge of said plurality of banded envelopes such that the marking is utilizable by a vision-guided robot or an optical recognition machine to determine at least one of the location of the side edge of said plurality of banded envelopes and the orientation for processing of said plurality of banded envelopes.

12. The envelope package of claim 1 including a third band extending around the plurality of envelopes and spaced apart from at least one other band such that said third band helps to retain said plurality of envelopes in a state of compression.

13. The envelope package of claim 1 wherein each envelope is generally flat and rectangular in front view and includes four outer edges, and wherein said band extends only around two of said outer edges of inner ones of said envelopes such that said inner ones of said envelopes each have two unbanded edges.

14. An envelope package including:

a plurality of generally aligned envelopes, said plurality of envelopes being compressed together; and two or more generally non-elastic bands extending around said plurality of compressed envelopes and retaining said envelopes in a state of compression, wherein said band retains said plurality of envelopes in a state of compression such that said plurality of envelopes are compressed at least about 10% from their uncompressed state such that said plurality of envelopes are sufficiently compressed to generally seal ambient air out of said plurality of envelopes and to reduce absorption of moisture therein, and further wherein the state of compression is limited such that none of the banded envelopes bow out of plane by more than about 1/40 of the length of a given envelope.

15. The envelope package of claim 14 wherein each band is spaced apart from another given band.

16. An envelope package comprising:

a plurality of generally aligned envelopes, said plurality of envelopes being compressed together, the plurality of envelopes together defining a stack of envelopes having a center portion and two edge portions, said center portion having more layers thereat than either of said two edge portions due to a configuration of said individual envelopes; and two or more generally non-elastic bands extending around said plurality of compressed envelopes and retaining said envelopes in a state of compression, wherein each envelope is generally flat and planar in the absence of outside forces, and wherein said plurality of envelopes are held in a limited state of compression by said bands such that said stack of envelopes does display bowing about said center portion thereof due to the relative number of layers thereat, yet such that none of the banded envelopes are bowed out of plane by more than about 1/40 of the length of a given envelope.

17. An envelope package comprising:

a plurality of generally aligned envelopes, said plurality of envelopes being compressed together; and a pair or more of bands extending around the plurality of envelopes and retaining the envelopes in a state of compression such that the plurality of envelopes are compressed at least about 10% from their uncompressed state, the bands retaining the plurality of envelopes in a limited state of compression such that none of the banded envelopes are bowed out of plane by more than about 1/40 of the length of a respective envelope, at least one of the bands having a marking thereon indicating the orientation for processing of the plurality of banded envelopes.

18. The envelope package of claim 17, wherein the plurality of envelopes is sufficiently compressed to generally seal ambient air out of the plurality of envelopes and to reduce absorption of moisture therein.

19. The envelope package of claim 17, wherein the marking is an arrow.

20. The envelope package of claim 19, wherein the stack of envelopes is sufficiently compressed to generally seal ambient air out of the plurality of envelopes and to reduce absorption of moisture therein.

21. An envelope package comprising:

a plurality of generally aligned envelopes, said plurality of envelopes being compressed together, the plurality of envelopes together defining a stack of envelopes, the plurality of envelopes together defining a stack of envelopes having a center portion and two edge portions, said center portion having more layers thereat than either of said two edge portions due to a configuration of the individual envelopes; and a pair or more of spaced-apart bands extending around the stack of envelopes and retaining the envelopes in a state of compression, the stack of envelopes displaying an amount of bowing in the center portion thereof due to the difference in the number of layers at the center portion relative to either of the two edge portions, the bands retaining the plurality of envelopes in a limited state of compression such that none of the banded envelopes are bowed out of plane by more than about 1/40 of the length of a respective envelope.

* * * * *